US008342879B2

(12) United States Patent
Amidon et al.

(10) Patent No.: US 8,342,879 B2
(45) Date of Patent: Jan. 1, 2013

(54) COAXIAL CABLE CONNECTOR

(75) Inventors: Jeremy Amidon, Marcellus, NY (US); Brian K. Hanson, East Syracuse, NY (US); Noah Montena, Syracuse, NY (US); Eric Purdy, Constantia, NY (US)

(73) Assignee: John Mezzalingua Associates, Inc., E. Syracuse, NY (US)

( * ) Notice: Subject to any disclaimer, the term of this patent is extended or adjusted under 35 U.S.C. 154(b) by 0 days.

(21) Appl. No.: 13/072,605

(22) Filed: Mar. 25, 2011

(65) Prior Publication Data

US 2012/0244733 A1 Sep. 27, 2012

(51) Int. Cl.
*H01R 9/05* (2006.01)

(52) U.S. Cl. ..... 439/584; 439/578; 439/320; 439/587

(58) Field of Classification Search ..... 439/578–585, 439/587–589, 320

See application file for complete search history.

(56) References Cited

U.S. PATENT DOCUMENTS

| | | | |
|---|---|---|---|
| 1,667,485 | A | 4/1928 | MacDonald |
| 1,766,869 | A | 6/1930 | Austin |
| 2,258,737 | A | 10/1941 | Browne |
| 2,325,549 | A | 7/1943 | Ryzowitz |
| 2,480,963 | A | 9/1949 | Quinn |
| 2,544,654 | A | 3/1951 | Brown |
| 2,549,647 | A | 4/1951 | Turenne |
| 2,694,187 | A | 11/1954 | Nash |
| 2,754,487 | A | 7/1956 | Carr et al. |
| 2,755,331 | A | 7/1956 | Melcher |
| 2,757,351 | A | 7/1956 | Klostermann |
| 2,762,025 | A | 9/1956 | Melcher |
| 2,805,399 | A | 9/1957 | Leeper |
| 2,870,420 | A | 1/1959 | Malek |
| 3,001,169 | A | 9/1961 | Blonder |
| 3,015,794 | A | 1/1962 | Kishbaugh |
| 3,091,748 | A | 5/1963 | Takes et al. |
| 3,094,364 | A | 6/1963 | Lingg |
| 3,184,706 | A | 5/1965 | Atkins |
| 3,196,382 | A | 7/1965 | Morello, Jr. |
| 3,245,027 | A | 4/1966 | Ziegler, Jr. |
| 3,275,913 | A | 9/1966 | Blanchard et al. |
| 3,278,890 | A | 10/1966 | Cooney |
| 3,281,757 | A | 10/1966 | Bonhomme |
| 3,292,136 | A | 12/1966 | Somerset |
| 3,320,575 | A | 5/1967 | Brown et al. |
| 3,321,732 | A | 5/1967 | Forney, Jr. |

(Continued)

FOREIGN PATENT DOCUMENTS

CA 2096710 A1 11/1994

(Continued)

OTHER PUBLICATIONS

Digicon AVL Connector. Arris Group Inc. [online]. 3 pages. [retrieved on Apr. 22, 2010]. Retrieved from the Internet< URL: http://www.arrisi.com/special/digiconAVL.asp>.

(Continued)

*Primary Examiner* — Gary F. Paumen

(74) *Attorney, Agent, or Firm* — Schmeiser, Olsen & Watts, LLP

(57) ABSTRACT

A connector used in coaxial cable communication applications, and more specifically to coaxial connectors having features for sealing against environmental contaminants, facilitating effective attachment to a corresponding interface port, and improving the efficiency of structures and processes for attaching the connectors to coaxial cables. Furthermore, an associated method is also provided.

18 Claims, 32 Drawing Sheets

U.S. PATENT DOCUMENTS

| | | | |
|---|---|---|---|
| 3,336,563 | A | 8/1967 | Hyslop |
| 3,348,186 | A | 10/1967 | Rosen |
| 3,350,677 | A | 10/1967 | Daum |
| 3,355,698 | A | 11/1967 | Keller |
| 3,373,243 | A | 3/1968 | Janowiak et al. |
| 3,390,374 | A | 6/1968 | Forney, Jr. |
| 3,406,373 | A | 10/1968 | Forney, Jr. |
| 3,448,430 | A | 6/1969 | Kelly |
| 3,453,376 | A | 7/1969 | Ziegler, Jr. et al. |
| 3,465,281 | A | 9/1969 | Florer |
| 3,475,545 | A | 10/1969 | Stark et al. |
| 3,498,647 | A | 3/1970 | Schroder |
| 3,517,373 | A | 6/1970 | Jamon |
| 3,533,051 | A | 10/1970 | Ziegler, Jr. |
| 3,537,065 | A | 10/1970 | Winston |
| 3,544,705 | A | 12/1970 | Winston |
| 3,551,882 | A | 12/1970 | O'Keefe |
| 3,564,487 | A | 2/1971 | Upstone et al. |
| 3,587,033 | A | 6/1971 | Brorein et al. |
| 3,601,776 | A | 8/1971 | Curl |
| 3,629,792 | A | 12/1971 | Dorrell |
| 3,633,150 | A | 1/1972 | Swartz |
| 3,646,502 | A | 2/1972 | Hutter et al. |
| 3,663,926 | A | 5/1972 | Brandt |
| 3,665,371 | A | 5/1972 | Cripps |
| 3,668,612 | A | 6/1972 | Nepovim |
| 3,669,472 | A | 6/1972 | Nadsady |
| 3,671,922 | A | 6/1972 | Zerlin et al. |
| 3,678,445 | A | 7/1972 | Brancaleone |
| 3,680,034 | A | 7/1972 | Chow et al. |
| 3,681,739 | A | 8/1972 | Kornick |
| 3,683,320 | A | 8/1972 | Woods et al. |
| 3,686,623 | A | 8/1972 | Nijman |
| 3,694,792 | A | 9/1972 | Wallo |
| 3,706,958 | A | 12/1972 | Blanchenot |
| 3,710,005 | A | 1/1973 | French |
| 3,739,076 | A | 6/1973 | Schwartz |
| 3,744,007 | A | 7/1973 | Horak |
| 3,744,011 | A | 7/1973 | Blanchenot |
| 3,778,535 | A | 12/1973 | Forney, Jr. |
| 3,781,762 | A | 12/1973 | Quackenbush |
| 3,781,898 | A | 12/1973 | Holloway |
| 3,793,610 | A | 2/1974 | Brishka |
| 3,798,589 | A | 3/1974 | Deardurff |
| 3,808,580 | A | 4/1974 | Johnson |
| 3,810,076 | A | 5/1974 | Hutter |
| 3,835,443 | A | 9/1974 | Arnold et al. |
| 3,836,700 | A | 9/1974 | Niemeyer |
| 3,845,453 | A | 10/1974 | Hemmer |
| 3,846,738 | A | 11/1974 | Nepovim |
| 3,854,003 | A | 12/1974 | Duret |
| 3,858,156 | A | 12/1974 | Zarro |
| 3,879,102 | A | 4/1975 | Horak |
| 3,886,301 | A | 5/1975 | Cronin et al. |
| 3,907,399 | A | 9/1975 | Spinner |
| 3,910,673 | A | 10/1975 | Stokes |
| 3,915,539 | A | 10/1975 | Collins |
| 3,936,132 | A | 2/1976 | Hutter |
| 3,953,097 | A | 4/1976 | Graham |
| 3,963,320 | A | 6/1976 | Spinner |
| 3,963,321 | A | 6/1976 | Burger et al. |
| 3,970,355 | A | 7/1976 | Pitschi |
| 3,972,013 | A | 7/1976 | Shapiro |
| 3,976,352 | A | 8/1976 | Spinner |
| 3,980,805 | A | 9/1976 | Lipari |
| 3,985,418 | A | 10/1976 | Spinner |
| 4,017,139 | A | 4/1977 | Nelson |
| 4,030,798 | A | 6/1977 | Paoli |
| 4,046,451 | A | 9/1977 | Juds et al. |
| 4,053,200 | A | 10/1977 | Pugner |
| 4,059,330 | A | 11/1977 | Shirey |
| 4,079,343 | A | 3/1978 | Nijman |
| 4,082,404 | A | 4/1978 | Flatt |
| 4,090,028 | A | 5/1978 | Vontobel |
| 4,093,335 | A | 6/1978 | Schwartz et al. |
| 4,106,839 | A | 8/1978 | Cooper |
| 4,125,308 | A | 11/1978 | Schilling |
| 4,126,372 | A | 11/1978 | Hashimoto et al. |
| 4,131,332 | A | 12/1978 | Hogendobler et al. |
| 4,150,250 | A | 4/1979 | Lundeberg |
| 4,153,320 | A | 5/1979 | Townshend |
| 4,156,554 | A | 5/1979 | Aujla |
| 4,165,911 | A | 8/1979 | Laudig |
| 4,168,921 | A | 9/1979 | Blanchard |
| 4,173,385 | A | 11/1979 | Fenn et al. |
| 4,174,875 | A | 11/1979 | Wilson et al. |
| 4,187,481 | A | 2/1980 | Boutros |
| 4,225,162 | A | 9/1980 | Dola |
| 4,227,765 | A | 10/1980 | Neumann et al. |
| 4,229,714 | A | 10/1980 | Yu |
| 4,250,348 | A | 2/1981 | Kitagawa |
| 4,280,749 | A | 7/1981 | Hemmer |
| 4,285,564 | A | 8/1981 | Spinner |
| 4,290,663 | A | 9/1981 | Fowler et al. |
| 4,296,986 | A | 10/1981 | Herrmann et al. |
| 4,307,926 | A | 12/1981 | Smith |
| 4,322,121 | A | 3/1982 | Riches et al. |
| 4,326,769 | A | 4/1982 | Dorsey et al. |
| 4,339,166 | A | 7/1982 | Dayton |
| 4,346,958 | A | 8/1982 | Blanchard |
| 4,354,721 | A | 10/1982 | Luzzi |
| 4,358,174 | A | 11/1982 | Dreyer |
| 4,373,767 | A | 2/1983 | Cairns |
| 4,389,081 | A | 6/1983 | Gallusser et al. |
| 4,400,050 | A | 8/1983 | Hayward |
| 4,407,529 | A | 10/1983 | Holman |
| 4,408,821 | A | 10/1983 | Forney, Jr. |
| 4,408,822 | A | 10/1983 | Nikitas |
| 4,412,717 | A | 11/1983 | Monroe |
| 4,421,377 | A | 12/1983 | Spinner |
| 4,426,127 | A | 1/1984 | Kubota |
| 4,444,453 | A | 4/1984 | Kirby et al. |
| 4,452,503 | A | 6/1984 | Forney, Jr. |
| 4,456,323 | A | 6/1984 | Pitcher et al. |
| 4,462,653 | A | 7/1984 | Flederbach et al. |
| 4,464,000 | A | 8/1984 | Werth et al. |
| 4,464,001 | A | 8/1984 | Collins |
| 4,469,386 | A | 9/1984 | Ackerman |
| 4,470,657 | A | 9/1984 | Deacon |
| 4,484,792 | A | 11/1984 | Tengler et al. |
| 4,484,796 | A | 11/1984 | Sato et al. |
| 4,506,943 | A | 3/1985 | Drogo |
| 4,515,427 | A | 5/1985 | Smit |
| 4,525,017 | A | 6/1985 | Schildkraut et al. |
| 4,531,805 | A | 7/1985 | Werth |
| 4,533,191 | A | 8/1985 | Blackwood |
| 4,540,231 | A | 9/1985 | Forney, Jr. |
| RE31,995 | E | 10/1985 | Ball |
| 4,545,637 | A | 10/1985 | Bosshard et al. |
| 4,575,274 | A | 3/1986 | Hayward |
| 4,580,862 | A | 4/1986 | Johnson |
| 4,580,865 | A | 4/1986 | Fryberger |
| 4,583,811 | A | 4/1986 | McMills |
| 4,585,289 | A | 4/1986 | Bocher |
| 4,588,246 | A | 5/1986 | Schildkraut et al. |
| 4,593,964 | A | 6/1986 | Forney, Jr. et al. |
| 4,596,434 | A | 6/1986 | Saba et al. |
| 4,596,435 | A | 6/1986 | Bickford |
| 4,598,961 | A | 7/1986 | Cohen |
| 4,600,263 | A | 7/1986 | DeChamp et al. |
| 4,613,199 | A | 9/1986 | McGeary |
| 4,614,390 | A | 9/1986 | Baker |
| 4,616,900 | A | 10/1986 | Cairns |
| 4,632,487 | A | 12/1986 | Wargula |
| 4,634,213 | A | 1/1987 | Larsson et al. |
| 4,640,572 | A | 2/1987 | Conlon |
| 4,645,281 | A | 2/1987 | Burger |
| 4,650,228 | A | 3/1987 | McMills et al. |
| 4,655,159 | A | 4/1987 | McMills |
| 4,655,534 | A | 4/1987 | Stursa |
| 4,660,921 | A | 4/1987 | Hauver |
| 4,668,043 | A | 5/1987 | Saba et al. |
| 4,674,818 | A | 6/1987 | McMills et al. |
| 4,676,577 | A | 6/1987 | Szegda |
| 4,682,832 | A | 7/1987 | Punako et al. |
| 4,684,201 | A | 8/1987 | Hutter |
| 4,688,876 | A | 8/1987 | Morelli |

4,688,878 A 8/1987 Cohen et al.
4,691,976 A 9/1987 Cowen
4,703,987 A 11/1987 Gallusser et al.
4,703,988 A 11/1987 Raux et al.
4,717,355 A 1/1988 Mattis
4,720,155 A 1/1988 Schildkraut et al.
4,734,050 A 3/1988 Negre et al.
4,734,666 A 3/1988 Ohya et al.
4,737,123 A 4/1988 Paler et al.
4,738,009 A 4/1988 Down et al.
4,738,628 A 4/1988 Rees
4,746,305 A 5/1988 Nomura
4,747,786 A 5/1988 Hayashi et al.
4,749,821 A 6/1988 Linton et al.
4,755,152 A 7/1988 Elliot et al.
4,757,297 A 7/1988 Frawley
4,759,729 A 7/1988 Kemppainen et al.
4,761,146 A 8/1988 Sohoel
4,772,222 A 9/1988 Laudig et al.
4,789,355 A 12/1988 Lee
4,806,116 A 2/1989 Ackerman
4,807,891 A 2/1989 Neher
4,808,128 A 2/1989 Werth
4,813,886 A 3/1989 Roos et al.
4,820,185 A 4/1989 Moulin
4,834,675 A 5/1989 Samchisen
4,835,342 A 5/1989 Guginsky
4,836,801 A 6/1989 Ramirez
4,838,813 A 6/1989 Pauza et al.
4,854,893 A 8/1989 Morris
4,857,014 A 8/1989 Alf et al.
4,867,706 A 9/1989 Tang
4,869,679 A 9/1989 Szegda
4,874,331 A 10/1989 Iverson
4,892,275 A 1/1990 Szegda
4,902,246 A 2/1990 Samchisen
4,906,207 A 3/1990 Banning et al.
4,915,651 A 4/1990 Bout
4,921,447 A 5/1990 Capp et al.
4,923,412 A 5/1990 Morris
4,925,403 A 5/1990 Zorzy
4,927,385 A 5/1990 Cheng
4,929,188 A 5/1990 Lionetto et al.
4,938,718 A 7/1990 Guendel
4,941,846 A 7/1990 Guimond et al.
4,952,174 A 8/1990 Sucht et al.
4,957,456 A 9/1990 Olson et al.
4,971,727 A 11/1990 Takahashi et al.
4,973,265 A 11/1990 Heeren
4,979,911 A 12/1990 Spencer
4,990,104 A 2/1991 Schieferly
4,990,105 A 2/1991 Karlovich
4,990,106 A 2/1991 Szegda
4,992,061 A 2/1991 Brush, Jr. et al.
5,002,503 A 3/1991 Campbell et al.
5,007,861 A 4/1991 Stirling
5,011,422 A 4/1991 Yeh
5,011,432 A 4/1991 Sucht et al.
5,021,010 A 6/1991 Wright
5,024,606 A 6/1991 Ming-Hwa
5,030,126 A 7/1991 Hanlon
5,037,328 A 8/1991 Karlovich
5,046,964 A 9/1991 Welsh et al.
5,052,947 A 10/1991 Brodie et al.
5,055,060 A 10/1991 Down et al.
5,062,804 A 11/1991 Jamet et al.
5,066,248 A 11/1991 Gaver, Jr. et al.
5,073,129 A 12/1991 Szegda
5,080,600 A 1/1992 Baker et al.
5,083,943 A 1/1992 Tarrant
5,120,260 A 6/1992 Jackson
5,127,853 A 7/1992 McMills et al.
5,131,862 A 7/1992 Gershfeld
5,137,470 A 8/1992 Doles
5,137,471 A 8/1992 Verespej et al.
5,141,448 A 8/1992 Mattingly et al.
5,141,451 A 8/1992 Down
5,149,274 A 9/1992 Gallusser et al.
5,154,636 A 10/1992 Vaccaro et al.
5,161,993 A 11/1992 Leibfried, Jr.
5,166,477 A 11/1992 Perin, Jr. et al.
5,169,323 A 12/1992 Kawai et al.
5,181,161 A 1/1993 Hirose et al.
5,183,417 A 2/1993 Bools
5,186,501 A 2/1993 Mano
5,186,655 A 2/1993 Glenday et al.
5,195,905 A 3/1993 Pesci
5,195,906 A 3/1993 Szegda
5,205,547 A 4/1993 Mattingly
5,205,761 A 4/1993 Nilsson
5,207,602 A 5/1993 McMills et al.
5,215,477 A 6/1993 Weber et al.
5,217,391 A 6/1993 Fisher, Jr.
5,217,393 A 6/1993 Del Negro et al.
5,227,093 A 7/1993 Cole et al.
5,227,587 A 7/1993 Paterek
5,247,424 A 9/1993 Harris et al.
5,269,701 A 12/1993 Leibfried, Jr.
5,283,853 A 2/1994 Szegda
5,284,449 A 2/1994 Vaccaro
5,294,864 A 3/1994 Do
5,295,864 A 3/1994 Birch et al.
5,316,494 A 5/1994 Flanagan et al.
5,318,459 A 6/1994 Shields
5,334,032 A 8/1994 Myers et al.
5,334,051 A 8/1994 Devine et al.
5,338,225 A 8/1994 Jacobsen et al.
5,342,218 A 8/1994 McMills et al.
5,354,217 A 10/1994 Gabel et al.
5,359,735 A 11/1994 Stockwell
5,362,250 A 11/1994 McMills et al.
5,371,819 A 12/1994 Szegda
5,371,821 A 12/1994 Szegda
5,371,827 A 12/1994 Szegda
5,380,211 A 1/1995 Kawaguchi et al.
5,389,005 A 2/1995 Kodama
5,393,244 A 2/1995 Szegda
5,413,504 A 5/1995 Kloecker et al.
5,431,583 A 7/1995 Szegda
5,435,745 A 7/1995 Booth
5,439,386 A 8/1995 Ellis et al.
5,444,810 A 8/1995 Szegda
5,455,548 A 10/1995 Grandchamp et al.
5,456,611 A 10/1995 Henry et al.
5,456,614 A 10/1995 Szegda
5,464,661 A 11/1995 Lein et al.
5,466,173 A 11/1995 Down
5,470,257 A 11/1995 Szegda
5,474,478 A 12/1995 Ballog
5,490,801 A 2/1996 Fisher, Jr. et al.
5,494,454 A 2/1996 Johnsen
5,499,934 A 3/1996 Jacobsen et al.
5,501,616 A 3/1996 Holliday
5,516,303 A 5/1996 Yohn et al.
5,525,076 A 6/1996 Down
5,542,861 A 8/1996 Anhalt et al.
5,548,088 A 8/1996 Gray et al.
5,550,521 A 8/1996 Bernaud et al.
5,564,938 A 10/1996 Shenkal et al.
5,571,028 A 11/1996 Szegda
5,586,910 A 12/1996 Del Negro et al.
5,595,499 A 1/1997 Zander et al.
5,598,132 A 1/1997 Stabile
5,607,325 A 3/1997 Toma
5,620,339 A 4/1997 Gray et al.
5,632,637 A 5/1997 Diener
5,632,651 A 5/1997 Szegda
5,644,104 A 7/1997 Porter et al.
5,651,698 A 7/1997 Locati et al.
5,651,699 A 7/1997 Holliday
5,653,605 A 8/1997 Woehl et al.
5,667,405 A 9/1997 Holliday
5,681,172 A 10/1997 Moldenhauer
5,683,263 A 11/1997 Hse
5,696,196 A 12/1997 DiLeo
5,702,263 A 12/1997 Baumann et al.
5,722,856 A 3/1998 Fuchs et al.
5,735,704 A 4/1998 Anthony 5,746,617 A 5/1998 Porter, Jr. et al.
5,746,619 A 5/1998 Harting et al.
5,769,652 A 6/1998 Wider
5,770,216 A 6/1998 Mitchnick et al.
5,775,927 A 7/1998 Wider
5,863,220 A 1/1999 Holliday
5,877,452 A 3/1999 McConnell
5,879,191 A 3/1999 Burris
5,882,226 A 3/1999 Bell et al.
5,921,793 A 7/1999 Phillips
5,938,465 A 8/1999 Fox, Sr.
5,944,548 A 8/1999 Saito
5,949,029 A 9/1999 Crotzer et al.
5,957,716 A 9/1999 Buckley et al.
5,967,852 A 10/1999 Follingstad et al.
5,975,949 A 11/1999 Holliday et al.
5,975,951 A 11/1999 Burris et al.
5,977,841 A 11/1999 Lee et al.
5,997,350 A * 12/1999 Burris et al. ..... 439/585
6,010,349 A 1/2000 Porter, Jr.
6,019,635 A 2/2000 Nelson
6,022,237 A 2/2000 Esh
6,032,358 A 3/2000 Wild
6,042,422 A 3/2000 Youtsey
6,048,229 A 4/2000 Lazaro, Jr.
6,053,777 A 4/2000 Boyle
6,083,053 A 7/2000 Anderson, Jr. et al.
6,089,903 A 7/2000 Stafford Gray et al.
6,089,912 A 7/2000 Tallis et al.
6,089,913 A 7/2000 Holliday
6,117,539 A 9/2000 Crotzer et al.
6,123,567 A 9/2000 McCarthy
6,146,197 A 11/2000 Holliday et al.
6,152,753 A 11/2000 Johnson et al.
6,153,830 A 11/2000 Montena
6,180,221 B1 1/2001 Crotzer et al.
6,210,216 B1 4/2001 Tso-Chin et al.
6,210,222 B1 4/2001 Langham et al.
6,217,383 B1 4/2001 Holland et al.
6,239,359 B1 5/2001 Lilienthal, II et al.
6,241,553 B1 6/2001 Hsia
6,261,126 B1 7/2001 Stirling
6,271,464 B1 8/2001 Cunningham
6,331,123 B1 12/2001 Rodrigues
6,332,815 B1 12/2001 Bruce
6,358,077 B1 3/2002 Young
6,375,866 B1 4/2002 Paneccasio, Jr. et al.
D458,904 S 6/2002 Montena
6,406,330 B2 6/2002 Bruce
D460,739 S 7/2002 Fox
D460,740 S 7/2002 Montena
D460,946 S 7/2002 Montena
D460,947 S 7/2002 Montena
D460,948 S 7/2002 Montena
6,416,847 B1 7/2002 Lein et al.
6,422,900 B1 7/2002 Hogan
6,425,782 B1 7/2002 Holland
D461,166 S 8/2002 Montena
D461,167 S 8/2002 Montena
D461,778 S 8/2002 Fox
D462,058 S 8/2002 Montena
D462,060 S 8/2002 Fox
6,439,899 B1 8/2002 Muzslay et al.
D462,327 S 9/2002 Montena
6,465,550 B1 10/2002 Kleyer et al.
6,468,100 B1 10/2002 Meyer et al.
6,491,546 B1 12/2002 Perry
D468,696 S 1/2003 Montena
6,506,083 B1 1/2003 Bickford et al.
6,530,807 B2 3/2003 Rodrigues et al.
6,540,531 B2 4/2003 Syed et al.
6,558,194 B2 5/2003 Montena
6,572,419 B2 6/2003 Feye-Homann
6,576,833 B2 6/2003 Covaro et al.
6,619,876 B2 9/2003 Vaitkus et al.
6,676,446 B2 1/2004 Montena
6,683,253 B1 1/2004 Lee
6,692,285 B2 2/2004 Islam
6,692,286 B1 2/2004 De Cet
6,712,631 B1 3/2004 Youtsey
6,716,041 B2 4/2004 Ferderer et al.
6,716,062 B1 4/2004 Palinkas et al.
6,733,336 B1 5/2004 Montena et al.
6,733,337 B2 5/2004 Kodaira
6,767,248 B1 7/2004 Hung
6,780,052 B2 8/2004 Montena et al.
6,780,068 B2 8/2004 Bartholoma et al.
6,786,767 B1 9/2004 Fuks et al.
6,790,081 B2 9/2004 Burris et al.
6,805,584 B1 10/2004 Chen
6,817,896 B2 11/2004 Derenthal
6,848,939 B2 2/2005 Stirling
6,848,940 B2 2/2005 Montena
6,884,113 B1 4/2005 Montena
6,884,115 B2 4/2005 Malloy
6,887,103 B2 * 5/2005 Montena et al. ..... 439/583
6,929,508 B1 8/2005 Holland
6,939,169 B2 9/2005 Islam et al.
6,971,912 B2 12/2005 Montena et al.
6,994,588 B2 * 2/2006 Montena ..... 439/578
7,026,382 B2 4/2006 Akiba et al.
7,029,326 B2 4/2006 Montena
7,070,447 B1 7/2006 Montena
7,070,477 B2 7/2006 Morisawa
7,086,897 B2 8/2006 Montena
7,097,499 B1 8/2006 Purdy
7,102,868 B2 9/2006 Montena
7,114,990 B2 10/2006 Bence et al.
7,118,416 B2 10/2006 Montena et al.
7,125,283 B1 10/2006 Lin
7,131,868 B2 11/2006 Montena
7,144,271 B1 12/2006 Burris et al.
7,147,509 B1 12/2006 Burris et al.
7,156,696 B1 1/2007 Montena
7,161,785 B2 1/2007 Chawgo
7,229,303 B2 6/2007 Vermoesen et al.
7,252,546 B1 8/2007 Holland
7,255,598 B2 8/2007 Montena et al.
7,299,550 B2 11/2007 Montena
7,364,462 B2 4/2008 Holland
7,375,533 B2 5/2008 Gale
7,393,245 B2 7/2008 Palinkas et al.
7,404,737 B1 7/2008 Youtsey
7,452,239 B2 11/2008 Montena
7,455,550 B1 11/2008 Sykes
7,462,068 B2 12/2008 Amidon
7,476,127 B1 1/2009 Wei
7,479,035 B2 1/2009 Bence et al.
7,488,210 B1 2/2009 Burris et al.
7,494,355 B2 2/2009 Hughes et al.
7,497,729 B1 3/2009 Wei
7,507,116 B2 3/2009 Laerke et al.
7,507,117 B2 3/2009 Amidon
7,544,094 B1 6/2009 Paglia et al.
7,566,236 B2 7/2009 Malloy et al.
7,607,942 B1 10/2009 Van Swearingen
7,674,132 B1 3/2010 Chen
7,682,177 B2 3/2010 Berthet
7,727,011 B2 6/2010 Montena et al.
7,753,705 B2 7/2010 Montena
7,794,275 B2 9/2010 Rodrigues
7,806,725 B1 10/2010 Chen
7,811,133 B2 10/2010 Gray
7,824,216 B2 11/2010 Purdy
7,828,595 B2 11/2010 Mathews
7,830,154 B2 11/2010 Gale
7,833,053 B2 11/2010 Mathews
7,845,976 B2 12/2010 Mathews
7,845,978 B1 12/2010 Chen
7,850,487 B1 12/2010 Wei
7,857,661 B1 12/2010 Islam
7,874,870 B1 1/2011 Chen
7,887,354 B2 2/2011 Holliday
7,892,005 B2 2/2011 Haube
7,892,024 B1 2/2011 Chen
7,927,135 B1 4/2011 Wlos
7,950,958 B2 5/2011 Mathews
7,997,930 B2 * 8/2011 Ehret et al. ..... 439/578

| | | | | |
|---|---|---|---|---|
| 8,016,613 | B2 * | 9/2011 | Paglia et al. | 439/578 |
| 8,029,315 | B2 | 10/2011 | Purdy et al. | |
| 8,062,044 | B2 | 11/2011 | Montena et al. | |
| 8,070,504 | B2 * | 12/2011 | Amidon et al. | 439/321 |
| 8,075,338 | B1 | 12/2011 | Montena | |
| 8,079,860 | B1 | 12/2011 | Zraik | |
| 8,113,879 | B1 * | 2/2012 | Zraik | 439/584 |
| 2002/0013088 | A1 | 1/2002 | Rodrigues et al. | |
| 2002/0038720 | A1 | 4/2002 | Kai et al. | |
| 2003/0214370 | A1 | 11/2003 | Allison et al. | |
| 2003/0224657 | A1 | 12/2003 | Malloy | |
| 2004/0018312 | A1 | 1/2004 | Halladay | |
| 2004/0077215 | A1 | 4/2004 | Palinkas et al. | |
| 2004/0102089 | A1 | 5/2004 | Chee | |
| 2004/0209516 | A1 | 10/2004 | Burris et al. | |
| 2004/0219833 | A1 | 11/2004 | Burris et al. | |
| 2004/0229504 | A1 | 11/2004 | Liu | |
| 2005/0042919 | A1 | 2/2005 | Montena | |
| 2005/0109994 | A1 | 5/2005 | Matheson et al. | |
| 2005/0208827 | A1 | 9/2005 | Burris et al. | |
| 2005/0233636 | A1 | 10/2005 | Rodrigues et al. | |
| 2006/0099853 | A1 | 5/2006 | Sattele et al. | |
| 2006/0110977 | A1 | 5/2006 | Matthews | |
| 2006/0154519 | A1 | 7/2006 | Montena | |
| 2007/0026734 | A1 | 2/2007 | Bence et al. | |
| 2007/0077360 | A1 | 4/2007 | Kashiwagi et al. | |
| 2007/0123101 | A1 | 5/2007 | Palinkas | |
| 2007/0175027 | A1 | 8/2007 | Khemakhem et al. | |
| 2008/0102696 | A1 | 5/2008 | Montena | |
| 2009/0029590 | A1 | 1/2009 | Sykes et al. | |
| 2009/0098770 | A1 | 4/2009 | Bence et al. | |
| 2010/0081321 | A1 | 4/2010 | Malloy et al. | |
| 2010/0081322 | A1 | 4/2010 | Malloy et al. | |
| 2010/0105246 | A1 | 4/2010 | Burris et al. | |
| 2010/0233901 | A1 | 9/2010 | Wild et al. | |
| 2010/0239871 | A1 | 9/2010 | Scheffer et al. | |
| 2010/0255721 | A1 | 10/2010 | Purdy et al. | |
| 2010/0279548 | A1 | 11/2010 | Montena et al. | |
| 2010/0297871 | A1 | 11/2010 | Haube | |
| 2010/0297875 | A1 | 11/2010 | Purdy et al. | |
| 2011/0021072 | A1 | 1/2011 | Purdy | |
| 2011/0053413 | A1 | 3/2011 | Mathews | |
| 2011/0111626 | A1 * | 5/2011 | Paglia et al. | 439/584 |
| 2011/0117774 | A1 | 5/2011 | Malloy et al. | |
| 2011/0143567 | A1 | 6/2011 | Purdy et al. | |
| 2011/0230089 | A1 | 9/2011 | Amidon | |
| 2011/0230091 | A1 | 9/2011 | Krenceski et al. | |
| 2012/0021642 | A1 | 1/2012 | Zraik | |

FOREIGN PATENT DOCUMENTS

| | | | |
|---|---|---|---|
| CN | 201149936 | Y | 11/2008 |
| CN | 201149937 | Y | 11/2008 |
| CN | 201178228 | Y | 1/2009 |
| DE | 47931 | C | 10/1888 |
| DE | 102289 | C | 4/1899 |
| DE | 1117687 | B | 11/1961 |
| DE | 1191880 | | 4/1965 |
| DE | 1515398 | B1 | 4/1970 |
| DE | 2225764 | A1 | 12/1972 |
| DE | 2221936 | A1 | 11/1973 |
| DE | 2261973 | A1 | 6/1974 |
| DE | 3211008 | A1 | 10/1983 |
| DE | 9001608.4 | U1 | 4/1990 |
| EP | 116157 | A1 | 8/1984 |
| EP | 167738 | A2 | 1/1986 |
| EP | 0072104 | A1 | 2/1986 |
| EP | 0265276 | A2 | 4/1988 |
| EP | 0428424 | A2 | 5/1991 |
| EP | 1191268 | A1 | 3/2002 |
| EP | 1501159 | A1 | 1/2005 |
| EP | 1701410 | A2 | 9/2006 |
| FR | 2232846 | A1 | 1/1975 |
| FR | 2234680 | A2 | 1/1975 |
| FR | 2312918 | | 12/1976 |
| FR | 2462798 | A1 | 2/1981 |
| FR | 2494508 | A1 | 5/1982 |
| GB | 589697 | A | 6/1947 |
| GB | 1087228 | A | 10/1967 |
| GB | 1270846 | A | 4/1972 |
| GB | 1401373 | A | 7/1975 |
| GB | 2019665 | A | 10/1979 |
| GB | 2079549 | A | 1/1982 |
| GB | 2252677 | A | 8/1992 |
| GB | 2264201 | A | 8/1993 |
| GB | 2331634 | A | 5/1999 |
| JP | 3280369 | B2 | 5/2002 |
| KR | 2006100622526 | B1 | 9/2006 |
| TW | 427044 | B | 3/2001 |
| WO | 8700351 | | 1/1987 |
| WO | 0186756 | A1 | 11/2001 |
| WO | 2004013883 | A2 | 2/2004 |
| WO | 2006081141 | A1 | 8/2006 |
| WO | 2011128665 | A1 | 10/2011 |
| WO | 2011128666 | A1 | 10/2011 |

OTHER PUBLICATIONS

U.S. Appl. No. 13/072,350, filed Mar. 25, 2011.
U.S. Appl. No. 12/843,971, filed Jul. 27, 2010.

* cited by examiner

COAXIAL CABLE CONNECTOR

FIELD OF TECHNOLOGY

The following relates to connectors used in coaxial cable communication applications, and more specifically to coaxial connectors having features for sealing against environmental contaminants, facilitating effective attachment to a corresponding interface port, and improving the efficiency of structures and processes for attaching the connectors to coaxial cables.

BACKGROUND

Broadband communications have become an increasingly prevalent form of electromagnetic information exchange and coaxial cables are common conduits for transmission of broadband communications. Coaxial cables are typically designed so that an electromagnetic field carrying communications signals exists only in the space between inner and outer coaxial conductors of the cables. This allows coaxial cable runs to be installed next to metal objects without the power losses that occur in other transmission lines, and provides protection of the communications signals from external electromagnetic interference. Connectors for coaxial cables are typically connected onto complementary interface ports to electrically integrate coaxial cables to various electronic devices and cable communication equipment. Connection is often made through rotatable operation of an internally coupling member of the connector about a corresponding externally threaded interface port. Fully tightening the threaded connection of the coaxial cable connector to the interface port helps to ensure a ground connection between the connector and the corresponding interface port. However, often connectors are not properly tightened or otherwise installed to the interface port and proper electrical mating of the connector with the interface port does not occur. Moreover, when attached to an interface port, common connectors are often still susceptible to the unwanted introduction of environmental contaminants into the connector. In addition, common connectors often utilize cumbersome and/or costly components and installation processes associated with attaching the connectors to coaxial cables. Hence a need exists for an improved connector having structural features that facilitate efficient connection of the connector to an interface port, that help prevent the entry of unwanted environmental contaminants into the coaxial cable connector, and that improve cost and effectiveness with relation to how the connector attaches to a coaxial cable.

SUMMARY

A first aspect of the present invention relates to a coaxial cable connector comprising a connector body; a post, engageable with the connector body; a coupling member, axially rotatable with respect to the connector body, the coupling member having a first end and opposing second end; an outer sleeve engageable with the coupling member, the sleeve configured to rotate the coupling member; and a compression portion structurally integral with the connector body, wherein the compression portion is configured to break apart from the body when axially compressed.

A second aspect of the present invention relates to a coaxial cable connector comprising; a connector body; a post engageable with connector body; a coupling member, axially rotatable with respect to the connector body, the coupling member having a first end and opposing second end portion; a sealing element attached to the coupling member, wherein the sealing element prevents ingress of environmental elements proximate the first end of the coupling member; and an outer sleeve engageable with the coupling member, the sleeve configured to rotate the coupling member.

A third aspect of the present invention relates to a coaxial cable connector comprising: a connector body; a post engageable with connector body; a coupling member, axially rotatable with respect to the connector body, the coupling member having a first end and opposing second end; a sealing element attached to the coupling member, wherein the sealing element prevents ingress of environmental elements proximate the first end of the coupling member; and a compression portion structurally integral with the connector body, wherein the compression portion is configured to break apart from the body when axially compressed.

A fourth aspect of the present invention relates to a method of fastening a coaxial cable to a communication port, the method comprising: providing a coaxial cable connector including: a connector body; a post operably attached to the connector body; a coupling member axially rotatable with respect to the connector body; an outer sleeve engageable with the coupling member; and a compression portion structurally integral with the connector body; axially compressing the compression portion to form an environmental seal around the coaxial cable, wherein when axially compressed, the compression portion breaks away from the body and securely connects to the coaxial cable; and fastening the coupling member to an interface port by operating the outer sleeve.

The foregoing and other features of construction and operation of the invention will be more readily understood and fully appreciated from the following detailed disclosure, taken in conjunction with accompanying drawings.

BRIEF DESCRIPTION OF THE DRAWINGS

Some of the embodiments will be described in detail, with reference to the following figures, wherein like designations denote like members, wherein.

DETAILED DESCRIPTION

Figure 1A:
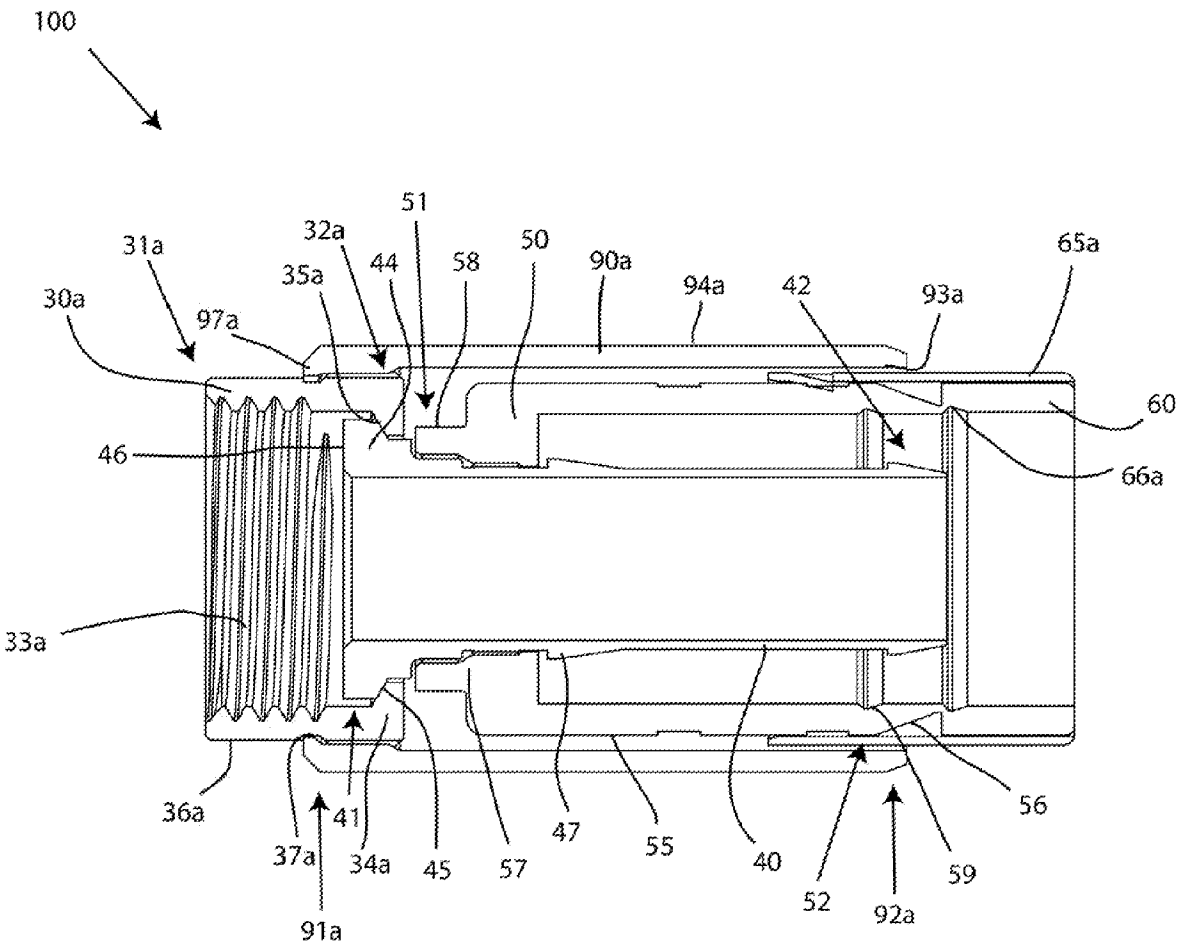
FIG. 1A depicts a cross-section view of a first embodiment of a coaxial cable connector including an embodiment of an outer sleeve, an embodiment of a compression portion, and an embodiment of a radial restriction member.

Although certain embodiments of the present invention are shown and described in detail, it should be understood that various changes and modifications may be made without departing from the scope of the appended claims. The scope of the present invention will in no way be limited to the number of constituting components, the materials thereof, the shapes thereof, the relative arrangement thereof, etc., and are disclosed simply as an example of embodiments of the present invention.

As a preface to the detailed description, it should be noted that, as used in this specification and the appended claims, the singular forms "a", "an" and "the" include plural referents, unless the context clearly dictates otherwise.

Referring to the drawings, FIGS. 1A-29 depict embodiments of a coaxial cable connector 100-128. The coaxial cable connector 100-128 may be operably affixed, or otherwise functionally attached, to a coaxial cable 10 having a protective outer jacket 12, a conductive grounding shield 14, an interior dielectric 16 and a center conductor 18 (the cable 10 being shown in FIG. 1C). The coaxial cable 10 may be prepared as embodied in FIG. 1C by removing the protective outer jacket 12 and drawing back the conductive grounding shield 14 to expose a portion of the interior dielectric 16. Further preparation of the embodied coaxial cable 10 may include stripping the dielectric 16 to expose a portion of the center conductor 18. The protective outer jacket 12 is intended to protect the various components of the coaxial cable 10 from damage which may result from exposure to dirt or moisture and from corrosion. Moreover, the protective outer jacket 12 may serve in some measure to secure the various components of the coaxial cable 10 in a contained cable design that protects the cable 10 from damage related to movement during cable installation. The conductive grounding shield 14 may be comprised of conductive materials suitable for providing an electrical ground connection, such as cuprous braided material, aluminum foils, thin metallic elements, or other like structures. Various embodiments of the shield 14 may be employed to screen unwanted noise. For instance, the shield 14 may comprise a metal foil wrapped around the dielectric 16, or several conductive strands formed in a continuous braid around the dielectric 16. Combinations of foil and/or braided strands may be utilized wherein the conductive shield 14 may comprise a foil layer, then a braided layer, and then a foil layer. Those in the art will appreciate that various layer combinations may be implemented in order for the conductive grounding shield 14 to effectuate an electromagnetic buffer helping to prevent ingress of environmental noise that may disrupt broadband communications. The dielectric 16 may be comprised of materials suitable for electrical insulation, such as plastic foam material, paper materials, rubber-like polymers, or other functional insulating materials. It should be noted that the various materials of which all the various components of the coaxial cable 10 are comprised should have some degree of elasticity allowing the cable 10 to flex or bend in accordance with traditional broadband communication standards, installation methods and/or equipment. It should further be recognized that the radial thickness of the coaxial cable 10, protective outer jacket 12, conductive grounding shield 14, interior dielectric 16 and/or center conductor 18 may vary based upon generally recognized parameters corresponding to broadband communication standards and/or equipment.

Referring further to FIGS. 1A-29, a connector, such as connector 100-128 may also interact with a coaxial cable interface port 20. The coaxial cable interface port 20 includes a conductive receptacle for receiving a portion of a coaxial cable center conductor 18 sufficient to make adequate electrical contact. The coaxial cable interface port 20 may further comprise a threaded exterior surface 23. It should be recognized that the radial thickness and/or the length of the coaxial cable interface port 20 and/or the conductive receptacle of the port 20 may vary based upon generally recognized parameters corresponding to broadband communication standards and/or equipment. Moreover, the pitch and height of threads which may be formed upon the threaded exterior surface 23 of the coaxial cable interface port 20 may also vary based upon generally recognized parameters corresponding to broadband communication standards and/or equipment. Furthermore, it should be noted that the interface port 20 may be formed of a single conductive material, multiple conductive materials, or may be configured with both conductive and non-conductive materials corresponding to the port's 20 operable electrical interface with a connector 100-128. However, the receptacle of the port 20 should be formed of a conductive material, such as a metal, like brass, copper, or aluminum. Further still, it will be understood by those of ordinary skill that the interface port 20 may be embodied by a connective interface component of a coaxial cable communications device, a television, a modem, a computer port, a network receiver, or other communications modifying devices such as a signal splitter, a cable line extender, a cable network module and/or the like.

Figure 28:
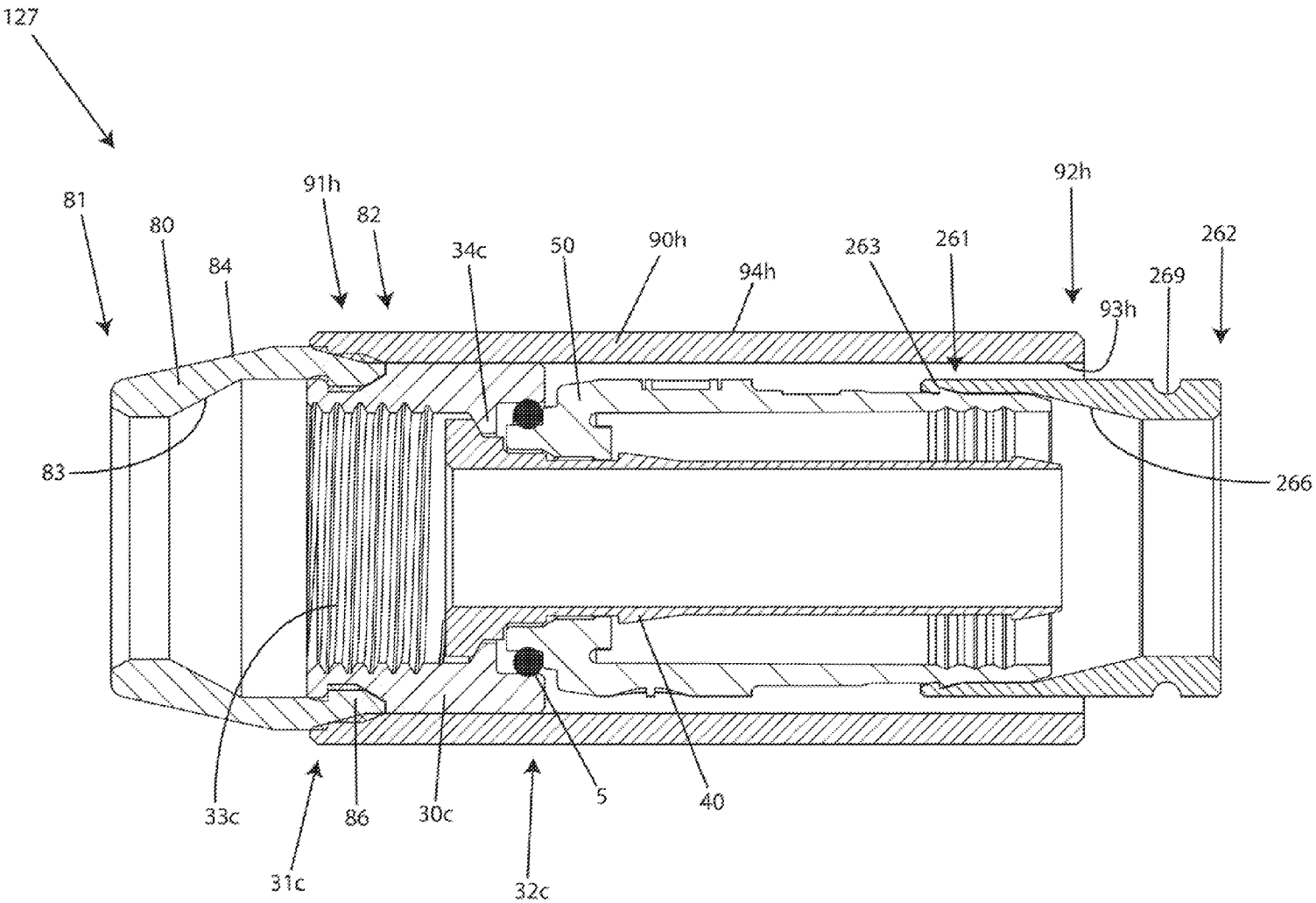
FIG. 28 depicts a cross-section view of a twenty-eighth embodiment of a coaxial cable connector including an embodiment of a sealing member, an embodiment of an outer sleeve, an embodiment of a compression portion configured to move axially external to an embodiment of a connector body.

Referring now to FIGS. 1A-25, embodiments of a coaxial cable connector 100-123 may further comprise a coupling member 30, a post 40, a connector body 50, an outer sleeve 90, a compression portion 60, a radial restriction member 65, and a connector body seal member 5 (as shown in FIG. 28), such as, for example, a body O-ring configured to fit around a portion of the connector body 50. Embodiments of coupling member 30 may be coupling member 30*a*, 30*b*, or 30*c* described in further detail infra. Embodiments of sleeve 90 may be sleeve 90*a*, 90*b*, 90*c*, 90*d*, 90*e*, 90*f*, 90*g*, or 90*h*, described in further detail infra. Similarly, embodiments of radial restriction member 65 may be 65*a*, 65*b*, or 65*c*, described in further detail infra. Connector 100-123 may come in a preassembled configuration or may require additional operable attachment of the sleeve 90 to connector 100-123 during installation.

Referring now to FIG. 1A, embodiments of connector 100 may include a coupling member 30*a*, a post 40, a connector body 50, an outer sleeve 90*a*, a compression portion 60, and a radial restriction member 65*a*.

Embodiments of connector 100 may include a coupling member 30*a*. The coupling member 30*a* of embodiments of a coaxial cable connector 100 has a first forward end 31*a* and opposing second rearward end 32*a*. The coupling member 30*a* may comprise internal threading 33*a* extending axially from the edge of first forward end 31*a* a distance sufficient to provide operably effective threadable contact with the external threads 23 of a standard coaxial cable interface port 20 (as shown, by way of example, in FIG. 1C). The coupling member 30*a* includes an internal lip 34*a*, such as an annular protrusion, located proximate the second rearward end 32*a* of the coupling member. The internal lip 34*a* includes a surface 35*a* facing the first forward end 31*a* of the coupling member 30*a*. The forward facing surface 35*a* of the lip 34*a* may be a tapered surface or side facing the first forward end 31*a* of the coupling member 30*a*. However, the internal lip 34*a* of coupling member 30*a* may define the second end 32*a* of the coupling member 30*a*, eliminating excess material from the coupling member 30*a*. Located somewhere on the outer surface 36*a* of the coupling member 30*a* may be a retaining structure 37*a*. The retaining structure 37*a* of the coupling member 30*a* may be an annular groove or recess that extends completely or partially around the outer surface 36*a* of the coupling member 30*a* to retain, accommodate, receive, or mate with an engagement member 97 of the sleeve 90. Alternatively, the retaining structure 37*a* may be an annular protrusion that extends completely or partially around the outer surface 36*a* of the coupling member 30*a* to retain or mate with the engagement member 97 of the outer sleeve 90. The retaining structure 37*a* may be placed at various axial positions from the first end 31*a* to the 32*a*, depending on the configuration of the sleeve 90 and other design requirements of connector 100.

Moreover, embodiments of coupling member 30*a* may include an outer surface feature(s) 38*a* proximate or otherwise near the second end 32*a* to improve mechanical interference or friction between the coupling member 30*a* and the sleeve 90. For instance, the outer surface feature 38*a* may extend completely or partially around the outer surface 36*a* proximate the second 32*a* of the coupling member 30*a* to increase a retention force between an inner surface 93 of the sleeve 90 and the outer surface 36*a* of the coupling member 30*a*. The outer surface feature 38*a* may include a knurled surface, a slotted surface, a plurality of bumps, ridges, grooves, or any surface feature that may facilitate contact between the sleeve 90 and the coupling member 30*a*. In one embodiment, the coupling member 30*a* may be referred to as a press-fit coupling member.

The structural configuration of the coupling member 30*a* may vary according differing connector design parameters to accommodate different functionality of a coaxial cable connector 100. For instance, the first forward end 31*a* of the coupling member 30*a* may include internal and/or external structures such as ridges, grooves, curves, detents, slots, openings, chamfers, or other structural features, etc., which may facilitate the operable joining of an environmental sealing member, such a water-tight seal or other attachable component element, that may help prevent ingress of environmental contaminants, such as moisture, oils, and dirt, at the first forward end 31*a* of the coupling member 30*a*, when mated with an interface port 20. Those in the art should appreciate that the coupling member 30*a* need not be threaded. Moreover, the coupling member 30*a* may comprise a coupler commonly used in connecting RCA-type, or BNC-type connectors, or other common coaxial cable connectors having standard coupler interfaces. The coupling member 30*a* may be formed of conductive materials, such as copper, brass, aluminum, or other metals or metal alloys, facilitating grounding through the coupling member 30*a*. Further embodiments of the coupling member 30*a* may be formed of polymeric materials and may be non-conductive. Accordingly, the coupling member 30*a* may be configured to extend an electromagnetic buffer by electrically contacting conductive surfaces of an interface port 20 when a connector 100 is advanced onto the port 20. In addition, the coupling member 30*a* may be formed of both conductive and non-conductive materials. For example the external surface of the coupling member 30*a* may be formed of a polymer, while the remainder of the coupling member 30*a* may be comprised of a metal or other conductive material. The coupling member 30*a* may be formed of metals or polymers or other materials that would facilitate a rigidly formed coupling member body. Manufacture of the coupling member 30*a* may include casting, extruding, cutting, knurling, turning, tapping, drilling, injection molding, blow molding, combinations thereof, or other fabrication methods that may provide efficient production of the component. The forward facing surface 35*a* of the coupling member 30*a* faces a flange 44 the post 40 when operably assembled in a connector 100, so as to allow the coupling member 30*a* to rotate with respect to the other component elements, such as the post 40 and the connector body 50, of the connector 100.

Embodiments of connector 100 may include a post 40. The post 40 comprises a first forward end 41 and an opposing second rearward end 42. Furthermore, the post 40 may comprise a flange 44, such as an externally extending annular protrusion, located at the first end 41 of the post 40. The flange 44 includes a rearward facing surface 45 that faces the forward facing surface 35*a*, 35*b*, 35*c* of the coupling member 30*a*, 30*b*, 30*c* when operably assembled in a coaxial cable connector, so as to allow the coupling member 30 to rotate with respect to the other component elements, such as the post 40 and the connector body 50, of the connector 100-128. The rearward facing surface 45 of flange 44 may be a tapered surface facing the second rearward end 42 of the post 40. Further still, an embodiment of the post 40 may include a surface feature 47 such as a lip or protrusion that may engage a portion of a connector body 50 to secure axial movement of the post 40 relative to the connector body 50. However, the post need not include such a surface feature 47, and the coaxial cable connector 100-128 may rely on press-fitting and friction-fitting forces and/or other component structures having features and geometries to help retain the post 40 in secure location both axially and rotationally relative to the connector body 50. The location proximate or near where the connector body is secured relative to the post 40 may include surface features 43, such as ridges, grooves, protrusions, or knurling, which may enhance the secure attachment and locating of the post 40 with respect to the connector body 50. Moreover, various components having larger or smaller diameters can be readily press-fit or otherwise secured into connection with each other. Additionally, the post 40 may include a mating edge 46, which may be configured to make physical and electrical contact with a corresponding mating edge 26 of an interface port 20 (as shown in exemplary fashion in FIG. 1C) The post 40 should be formed such that portions of a prepared coaxial cable 10 including the dielectric 16 and center conductor 18 (examples shown in FIG. 1C) may pass axially into the second end 42 and/or through a portion of the tube-like body of the post 40. Moreover, the post 40 should be dimensioned, or otherwise sized, such that the post 40 may be inserted into an end of the prepared coaxial cable 10, around the dielectric 16 and under the protective outer jacket 12 and conductive grounding shield 14. Accordingly, where an embodiment of the post 40 may be inserted into an end of the prepared coaxial cable 10 under the drawn back conductive grounding shield 14, substantial physical and/or electrical contact with the shield 14 may be accomplished thereby facilitating grounding through the post 40. The post 40 should be conductive and may be formed of metals or may be formed of other conductive materials that would facilitate a rigidly formed post body. In addition, the post may be formed of a combination of both conductive and non-conductive materials. For example, a metal coating or layer may be applied to a polymer of other non-conductive material. Manufacture of the post 40 may include casting, extruding, cutting, turning, drilling, knurling, injection molding, spraying, blow molding, component overmolding, combinations thereof, or other fabrication methods that may provide efficient production of the component.

Embodiments of a coaxial cable connector, such as connector 100, may include a connector body 50. The connector body 50 may comprise a first end 51 and opposing second end 52. Moreover, the connector body may include a post mounting portion 57 proximate or otherwise near the first end 51 of the body 50, the post mounting portion 57 configured to securely locate the body 50 relative to a portion of the outer surface of post 40, so that the connector body 50 is axially secured with respect to the post 40, in a manner that prevents the two components from moving with respect to each other in a direction parallel to the axis of the connector 100. The internal surface of the post mounting portion 57 may include an engagement feature, such as an annular detent or ridge having a different diameter than the rest of the post mounting portion 57. However other features such as grooves, ridges, protrusions, slots, holes, keyways, bumps, nubs, dimples, crests, rims, or other like structural features may be included. In addition, the connector body 50 may include an outer annular recess 58 located proximate or near the first end 51 of the connector body 50. Furthermore, the connector body 50 may include a semi-rigid, yet compliant outer surface 55, wherein the outer surface 55 may be configured to form an annular seal when the second end 52 is deformably compressed against a received coaxial cable 10 by operation of a compression portion 60. The connector body 50 may include an outer ramped surface 56 and an internal annular notch 59 or groove proximate the second end 52 to structurally facilitate the deformation of the connector body 50, as described in further detail infra.

Moreover, the connector body 50 may include an external annular detent located proximate or close to the second end 52 of the connector body 50. Further still, the connector body 50 may include internal surface features, such as annular serrations formed near or proximate the internal surface of the second end 52 of the connector body 50 and configured to enhance frictional restraint and gripping of an inserted and received coaxial cable 10, through tooth-like interaction with the cable. The connector body 50 may be formed of materials such as plastics, polymers, bendable metals or composite materials that facilitate a semi-rigid, yet compliant outer surface 55. Further, the connector body 50 may be formed of conductive or non-conductive materials or a combination thereof. Manufacture of the connector body 50 may include casting, extruding, cutting, turning, drilling, knurling, injection molding, spraying, blow molding, component overmolding, combinations thereof, or other fabrication methods that may provide efficient production of the component.

With continued reference to FIG. 1A, embodiments of connector 100 may include a sleeve 90*a*. The sleeve 90*a* may be engageable with the coupling member 30*a*. The sleeve 90*a* may include a first end 91*a*, a second 91*a*, an inner surface 93*a*, and an outer surface 94*a*. The sleeve 90*a* may be a generally annular member having a generally axial opening therethrough. The sleeve 90*a* may be radially disposed over the coupling member 30*a*, or a portion thereof, the connector body 50, or a portion thereof the compression portion 60, or a portion thereof, and radial restriction member 65, or a portion thereof, while operably assembled and/or in a compressed position. Proximate or otherwise near the first end 91*a*, the sleeve 90*a* may include an engagement member 97*a* configured to mate or engage with the retaining structure 37*a* of the coupling member 30*a*. The engagement member 97*a* may be an annular lip or protrusion that may enter or reside within the retaining structure 37*a* of the coupling member 30*a*. For example, in embodiments where the retaining structure 37*a* is an annular groove, the engagement member 97*a* may be a protrusion or lip that may snap into the groove located on the coupling member 30*a* to retain the sleeve 90*a* in a single axial position. In other words, the cooperating surfaces of the groove-like retaining structure 37*a* and the lip or protruding engagement member 97*a* may prevent axial movement of the sleeve 90*a* once the connector 100 is in an assembled configuration. Alternatively, the engagement member 97*a* may be an annular groove or recess that may receive or engage with the retaining structure 37*a* of the coupling member 30*a*. For example, in embodiments where the retaining structure 37*a* of the coupling member 30*a* is an annular protrusion, the engagement member 97*a* may be a groove or recess that may allow the annular protruding retaining structure 37*a* of the coupling member 30*a* to snap into to retain the sleeve 90*a* in a single axial position. In other words, the cooperating surfaces of the protruding retaining structure 37*a* and the groove-like engagement member 97*a* may prevent axial movement of the sleeve 90*a* once the connector 100 is in an assembled configuration. Those having skill in the art should understand that various surface features effectuating cooperating surfaces between the coupling member 30 and the sleeve 90 may be implemented to retain the sleeve 90*a* with respect to the rest of the connector 100 in an axial direction. Furthermore, the engagement member 97*a* of the sleeve 90*a* may be segmented such that one or more gaps may separate portions of the engagement member 97*a*, while still providing sufficient structural engagement with the retaining structure 37*a*.

Figure 1B:
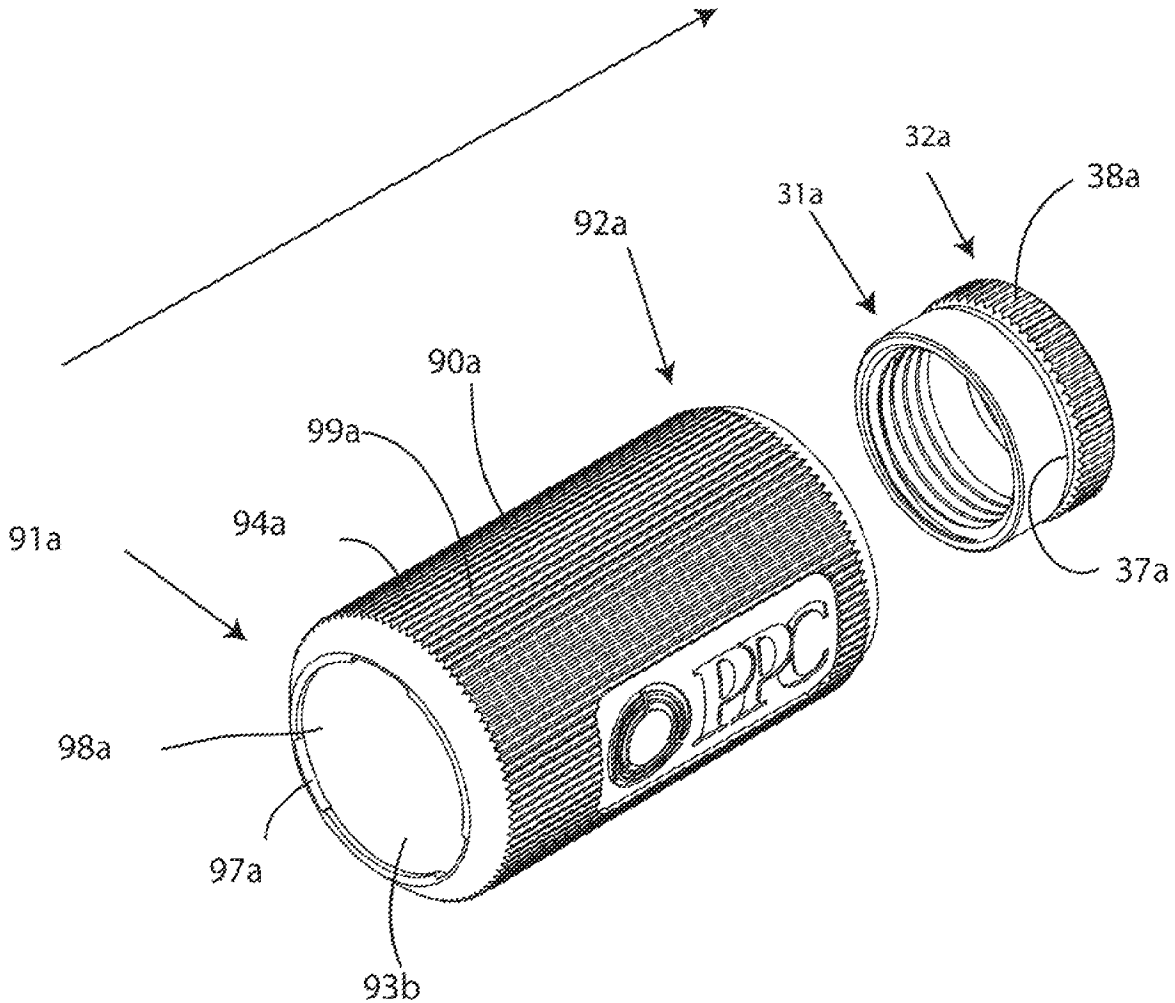
FIG. 1B depicts a perspective view of the first embodiment of the coaxial cable connector prior to an embodiment of the sleeve is operably attached to an embodiment of a coupling member.

An embodiment of an assembled configuration of connector 100 with respect to the sleeve 90*a* may involve sliding the sleeve 90*a* over the coupling member 30*a* in an axial direction starting from the first end 31*a* and continuing toward the second end 32*a* of the coupling member 30*a* until sufficient mating and/or engagement occurs between the engagement member 97*a* of the sleeve 90*a* and the retaining structure 37*a* of the coupling member 30*a*, as shown in FIG. 1B. Once in the assembled configuration, rotation of the sleeve 90*a* may in turn cause the coupling member 30*a* to simultaneously rotate in the same direction as the sleeve 90*a* due to mechanical interference between the inner surface 93*a* of the sleeve 90*a* and the outer surface 36*a* of the coupling member 30*a*. In some embodiments, the interference between the sleeve 90*a* and the coupling member 30*a* relies simply on a friction fit or interference fit between the components. Other embodiments include a coupling member 30*a* with an outer surface feature(s) 38*a*, as described supra, to improve the mechanical interference between the components. Further embodiments include a sleeve 90*a* with internal surface features 98*a* positioned on the inner surface 93*a* to improve the contact between the components. Even further embodiments of connector 100 may include a sleeve 90*a* and a coupling member 30*a* both having surface features 98*a*, 38*a*, respectively. Embodiments of the inner surface features 98*a* of the sleeve 90*a* may include a knurled surface, a slotted surface, a plurality of bumps, ridges, rib, grooves, or any surface feature that may facilitate contact between the sleeve 90*a* and the coupling member 30. In many embodiments, the inner surface features 98*a* of the sleeve 90*a* and the outer surface features 38*a* of the coupling member 30*a* may structurally correspond with each other. For example, the inner geometry of the sleeve 90*a* may reflect and/or structurally correspond with the outer geometric shape of the coupling member 30*a*. Due to the engagement between the sleeve 90*a* and the coupling member 30*a*, a user may simply grip and rotate/twist the sleeve 90*a* to thread the coupling element 30*a* onto an interface port, such as interface port 20. Further still, embodiments of the sleeve 90*a* may include outer surface features 99*a*, such as annular serrations or slots, configured to enhance gripping of the sleeve 90*a* while connecting the connector 100 onto an interface port. The sleeve 90*a* may be formed of materials such as plastics, polymers, bendable metals or composite materials that facilitate a rigid body. Further, the sleeve 90*a* may be formed of conductive or non-conductive materials or a combination thereof. Manufacture of the sleeve 90*a* may include casting, extruding, cutting, turning, drilling, knurling, injection molding, spraying, blow molding, component overmolding, combinations thereof, or other fabrication methods that may provide efficient production of the component.

Figure 1C:
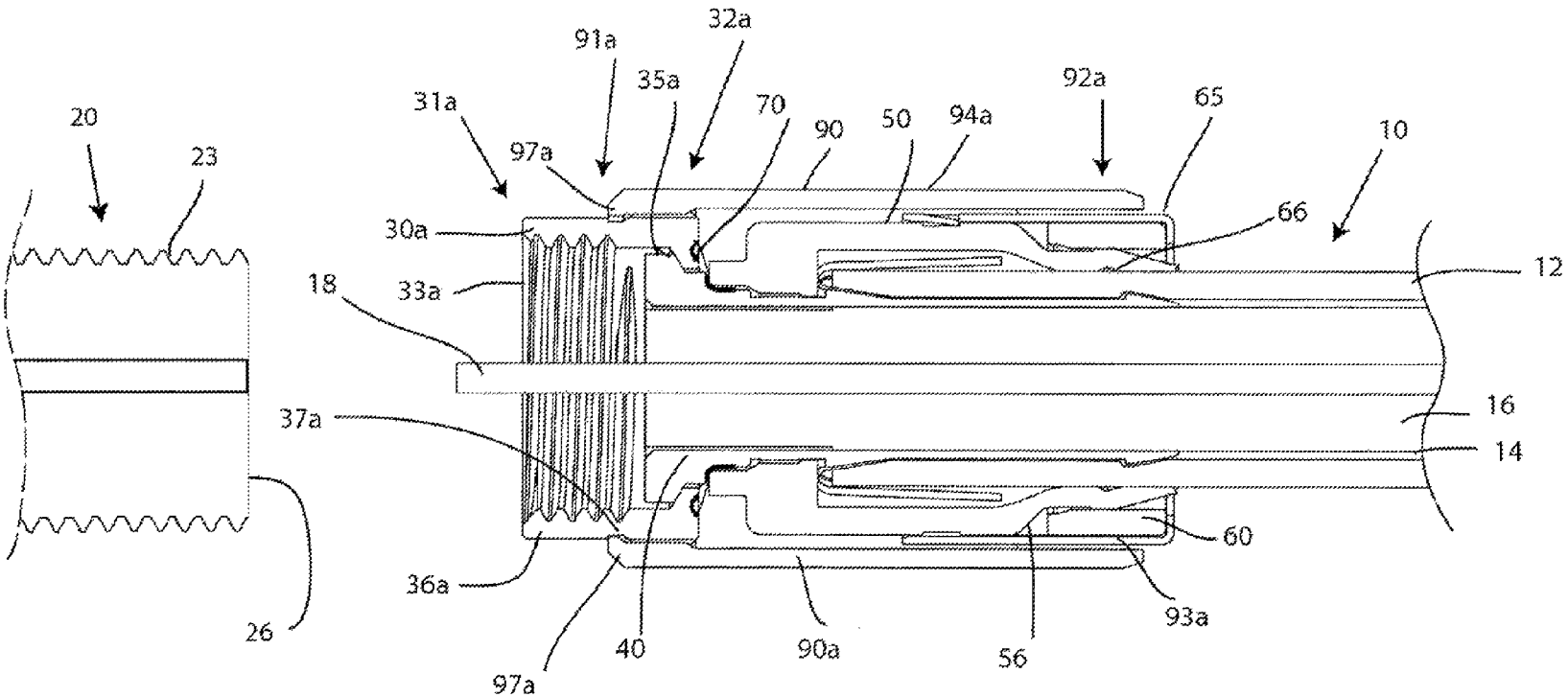
FIG. 1C depicts a cross-section view of the first embodiment of the coaxial cable connector after secure attachment to an embodiment of a coaxial cable.

Embodiments of connector 100 may include a compression portion 60. Compression portion 60 may be operably attached to the connector body 50. For instance, the compression portion 60 may be structurally integral with the connector body 50, wherein the compression portion 60 separates or shears from the connector body 50 upon an axial force which in turn radially compresses the second end 52 of the connector body 50 onto the coaxial cable 10, as shown in FIG. 1C. The structural connection between the connector body 50 and the compression portion 60 may be thin or otherwise breakable when compressive, axial force is applied (e.g. by an axial compression tool). For example, the compression portion 60 may have a frangible connection with the connector body 50. Moreover, the structural connection or configuration between the connector body 50 and the compression portion 60 may be defined by an internal annular notch 66 or groove of the compression portion 60 and an outer ramped surface 56 of the connector body 50. The annular notch 59 of the connector body 50 may further facilitate the deformation of the second end 52 of the connector body 1350. The compression portion 60 may be formed of the same material as connector body 50 because they may be structurally integral with each other. For example, the compression portion 60 may be comprised of materials such as plastics, polymers, bendable metals or composite materials that facilitate a rigid body. Further, the compression portion 60 may be formed of conductive or non-conductive materials or a combination thereof. Manufacture of the compression member 60 may include casting, extruding, cutting, turning, drilling, knurling, injection molding, spraying, blow molding, component overmolding, combinations thereof, or other fabrication methods that may provide efficient production of the component.

Furthermore, embodiments of connector 100 may include a radial restriction member 65*a*. The radial restriction member 65*a* may be a bushing or similar annular tubular member disposed proximate the rearward second end 52 of the connector body 50. For instance, the radial restriction member 65*a* may surround the compression portion 60 and a portion of the connector body 50 proximate the rearward second end 52. The radial restriction member 65*a* may be a generally annular, hollow cylindrically-shaped sleeve-like member comprised of stainless steel or other substantially rigid materials which may structurally assist the crack and seal process of compression portion 60. For instance, when the compression portion 60 is axially compressed in a direction towards the coupling member 30, the radial restriction member 65*a* may axially displace along with the compression portion 60 and may prevent the compression portion 60 from splintering or otherwise displacing in a direction other than substantially axial towards the coupling member 30.

Embodiments of the compression portion 60 may create an environmental seal around the coaxial cable 10 when in the fully compressed position. Specifically, when the compression portion 60 (and the radial restriction member 65*a*) is axially slid or compressed towards the coupling member 30, the structural connection between the compression portion 60 and the connector body 50 is severed, sheared, ruptured, etc., and the compression portion 60 comes into contact with the outer ramped surface 56 of the connector body 50. The severing of the structural connection between the connector body 50 and the compression portion 60 essentially turns the internal notch 66*a* into a cooperative ramped surface with the outer ramped surface 56 of the connector body 50. Due to the cooperative ramped surfaces, the axial compression (displacement) of the compression portion 60 evenly compresses the second end 52 of the connector body 50 onto the outer jacket 12 of the coaxial cable 10 and deforms the outer ramped surface 56, as shown in FIG. 1C. Accordingly, the compression portion 60 and potentially the radial restriction member 65*a* may be referred to as a crack and seal compression means with a radial restriction member 65*a*. Those skilled in the requisite art should appreciate that the seal may be created by the compression portion 60 without the radial restriction member 65*a*. However, the radial restriction member 65*a* significantly enhances the structural integrity and functional operability of the compression portion, for example, when it is compressed and sealed against an attached coaxial cable 10.

Figure 2:
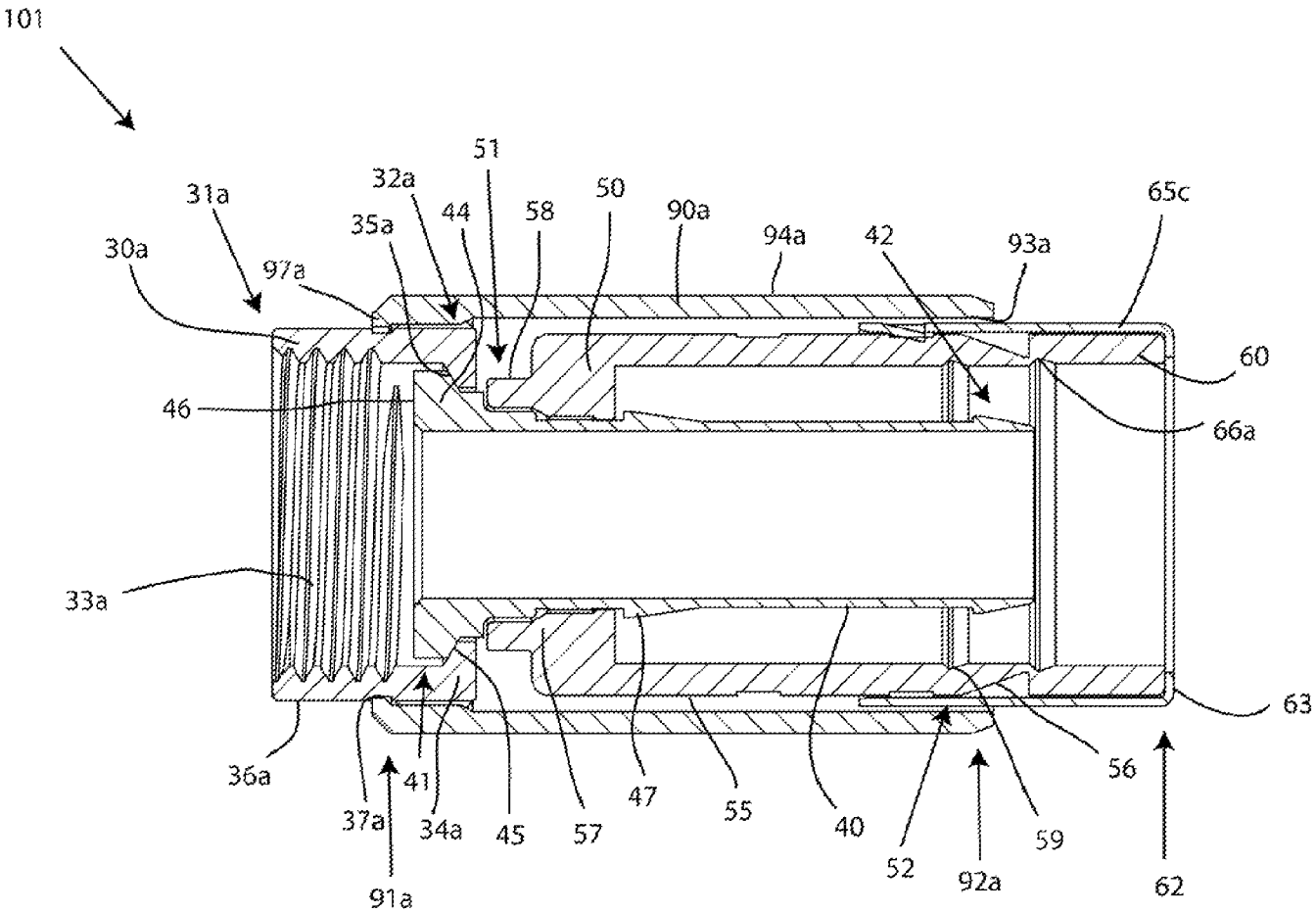
FIG. 2 depicts a cross-section view of a second embodiment of a coaxial cable connector including an embodiment of an outer sleeve, an embodiment of a compression portion, and an embodiment of a radial restriction member.

With reference to FIG. 2, embodiments of connector 101 may include a coupling member 30*a*, a post 40, a connector body 50, an outer sleeve 90*a*, a compression portion 60, and a radial restriction member 65*c*. Radial restriction member 65*c* may share the same or substantially the same function as radial restriction member 65*a*. However, radial restriction member 65*c* may be a cap member, or similar generally annular, tubular member having an engagement surface for operable engagement with a compression tool. For instance, embodiments of the radial restriction member 65*c* may include an internal annular lip 63 or inwardly extending flange proximate a rearward end 62 of the radial restriction member 65*c*. The radial restriction member 65*c* may surround or partially surround the compression portion 60 and a portion of the connector body 50 proximate the rearward second end 52, wherein the internal annular lip 63 of the radial restriction member 65*c* may be configured to contact the compression portion 6*a* prior to or upon axial compression of the connector. The radial restriction member 65*c* may be comprised of stainless steel or other substantially rigid materials which may structurally assist the crack and seal process of compression portion 60. For instance, when the compression portion 60 is axially compressed in a direction towards the coupling member 30, the radial restriction member 65*c* may axially displace along with the compression portion 60 and may prevent the compression portion 60 from splintering or otherwise displacing in a direction other than substantially axial towards the coupling member 30. Additionally, the internal lip 63 proximate the rearward end 62 of the radial restriction member 65*c* may provide an engagement surface for operable engagement with a compression tool, or other device/means that provides the necessary compression to compress seal connector 1302.

Figure 3:
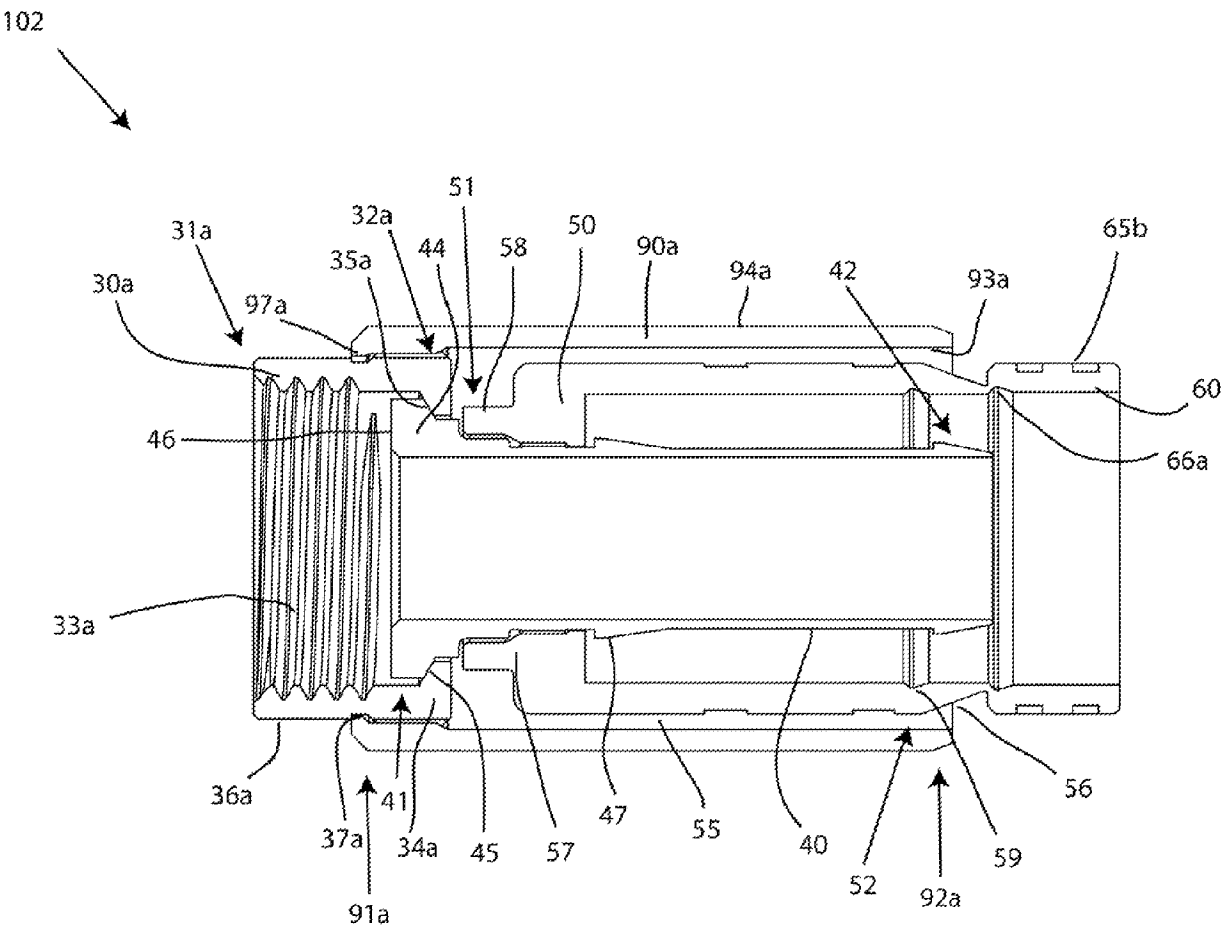
FIG. 3 depicts a cross-section view of a third embodiment of a coaxial cable connector including an embodiment of an outer sleeve, an embodiment of a compression portion, and an embodiment of a radial restriction member.

Referring now to FIG. 3, embodiments of connector 102 may include a coupling member 30*a*, a post 40, a connector body 50, an outer sleeve 90*a*, a compression portion 60, and a radial restriction member 65*b*. Radial restriction member 65*b* may share the same or substantially the same function as radial restriction member 65*a*. However, radial restriction member 65*b* may be one or more straps or bands that extend annularly around or partially around the compression portion 60. The radial restriction member 65*b* may be structurally attached to the compression portion 60 in a variety of methods, such as press-fit, adhesion, cohesion, fastened, etc. For instance, the radial restriction member 65*b* may reside within annular notches or grooves in the compression portion 60. The notches or grooves may have various depths to allow the radial restriction member 65 to be flush with the outer surface of the compression portion 60, to protrude from the outer surface of the compression portion 60, or to reside completely beneath the outer surface of the compression portion 60. Moreover, the radial restriction member 65 may be comprised of stainless steel or other substantially rigid materials which may structurally assist the crack and seal process of compression portion 60. For instance, when the compression portion 60 is axially compressed in a direction towards the coupling member 30*a*, the radial restriction member 65*b* may also prevent the compression portion 60 from splintering or otherwise displacing in a direction other than substantially axial towards the coupling member 30*a*.

Figure 4A:
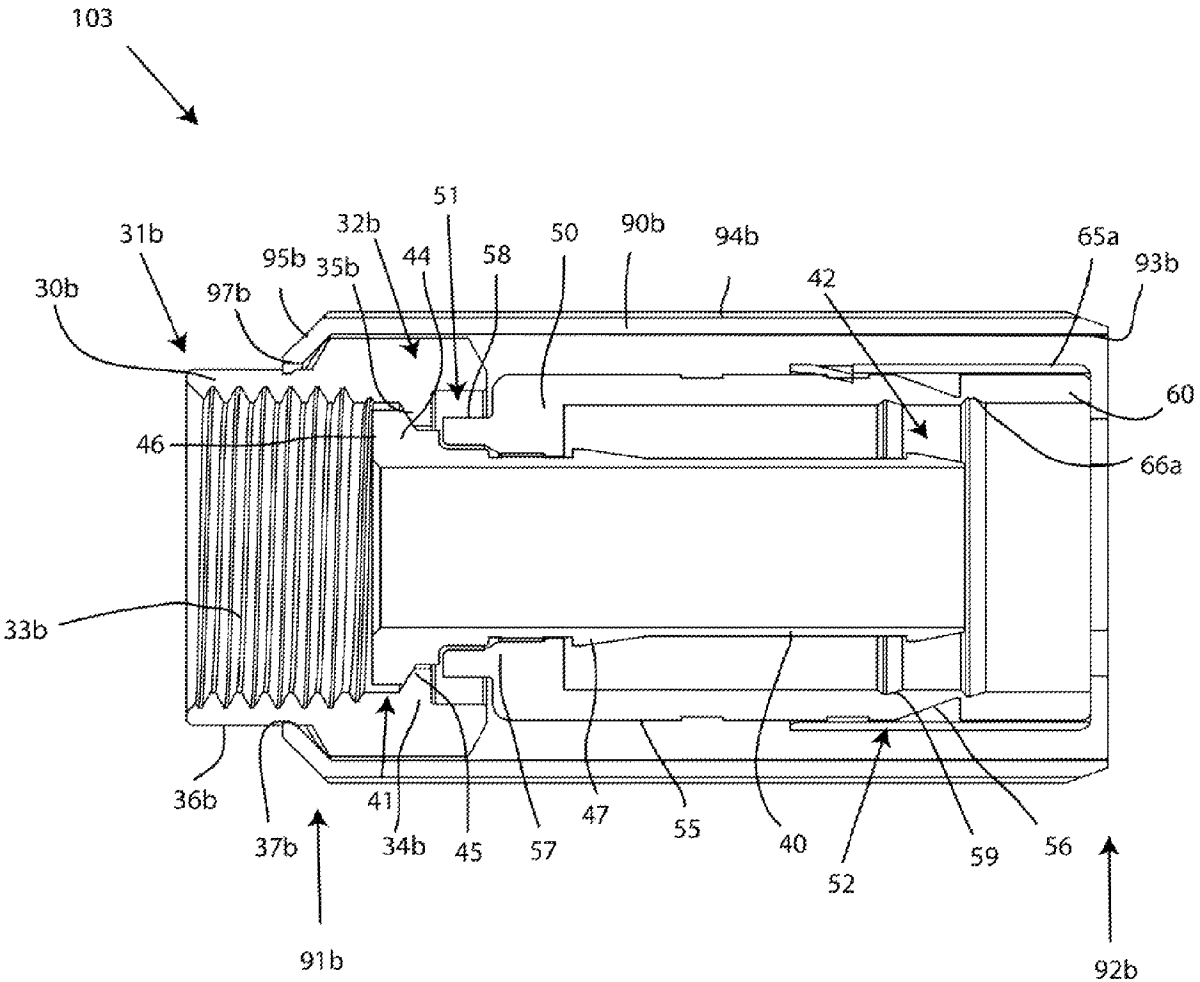
FIG. 4A depicts a cross-section view of a fourth embodiment of a coaxial cable connector including an embodiment of an outer sleeve, an embodiment of a compression portion, and an embodiment of a radial restriction member.

With reference to FIG. 4A, embodiments of connector 103 may include a coupling member 30*b*, a post 40, a connector body 50, an outer sleeve 90*b*, a compression portion 60, and a radial restriction member 65*a*.

Embodiments of a connector 103 may include a coupling member 30*b*. Coupling member 30*b* may share the same or substantially the same structural and functional aspects of coupling member 30*a*. Accordingly, coupling member 30*b* has a first forward end 31*b*, an opposing second rearward end 32*b*, internal threading 33*b*, an internal lip 34*b* including a surface 35*b* facing the first forward end 31*b* of the coupling member 30*b*. However, the second rearward end 32*b*, of the coupling member 30*b* may extend a significant axial distance to reside radially extent, or otherwise partially surround, a portion of the connector body 50, although the extended portion of the coupling member 30*b* need not contact the connector body 50. Additionally, coupling member 30*b* may include a retaining structure 37*b* on an outer surface 36*b* of the coupling member 30*b*. The retaining structure 37*b* may share the same or substantially same structural and functional aspects of the retaining structure 37*a* described in association with, for example, connector 100. Manufacture of the coupling member 30*b* may include casting, extruding, cutting, knurling, turning, tapping, drilling, injection molding, blow molding, combinations thereof, or other fabrication methods that may provide efficient production of the component. The forward facing surface 35*b* of the coupling member 30*b* faces a flange 44 the post 40 when operably assembled in a coaxial cable connector, so as to allow the coupling member 30*b* to rotate with respect to the other component elements, such as the post 40 and the connector body 50.

Figure 4B:
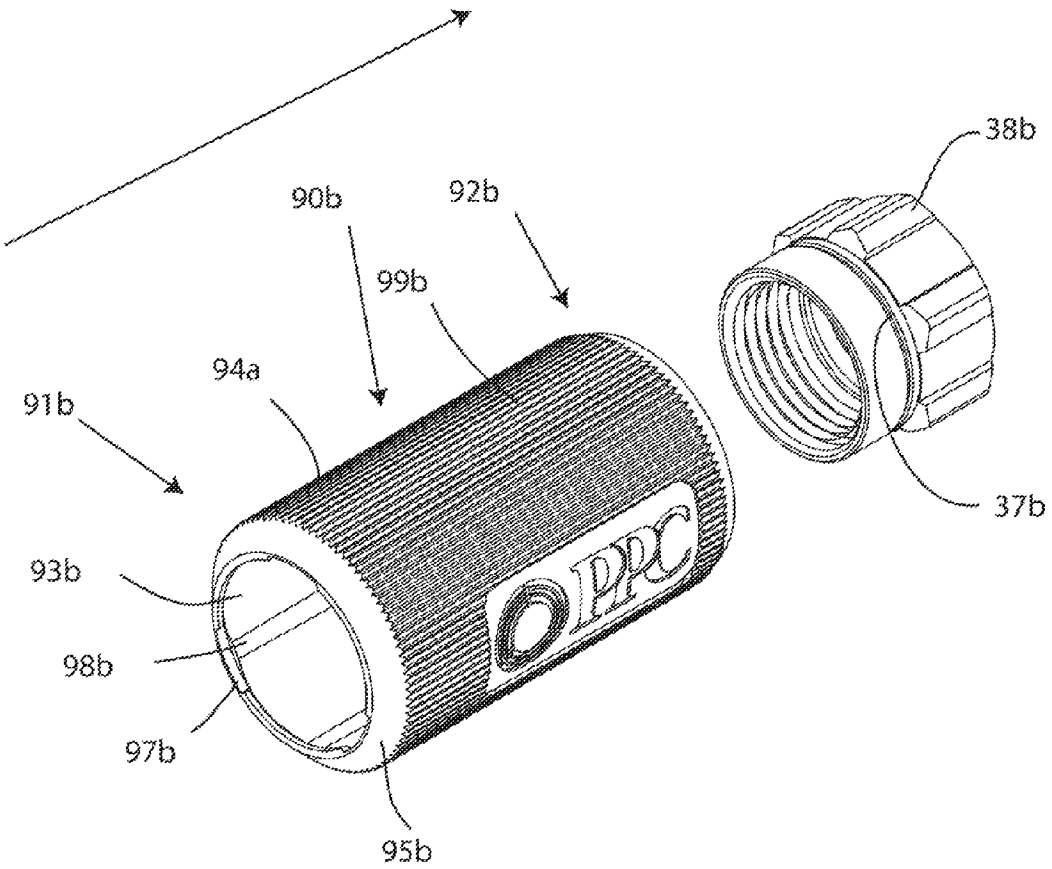
FIG. 4B depicts a perspective view of the fourth embodiment of the coaxial cable connector prior to an embodiment of a sleeve is operably attached to an embodiment of a coupling member.

Embodiments of connector 103 may include an outer sleeve 90*b*. Sleeve 90*b* may share the same structural and functional aspects of sleeve 90*a* described in association with, for example, connector 100. Accordingly, sleeve 90*b* may include an engagement member 97*b* that is configured to mate or engage with a retaining structure 37*b* of the coupling member 30*b*. For example, the sleeve 90*b* may include a first end 91*b*, a second end 92*b*, an inner surface 93*b*, and an outer surface 94*b*, and may be a generally annular member having a generally axial opening therethrough. However, the sleeve 90*b* may be radially disposed over the coupling member 30*b*, or a portion thereof, the connector body 50, or a portion thereof, the compression portion 60, or a portion thereof, and the radial restriction member 65, while operably assembled and/or in a compressed position. Additionally, the sleeve 90*b* may include an annular ramped surface 95*b* or chamfer proximate or otherwise near the first end 91*b* to accommodate an increased diameter or general size of the coupling member 30*b* proximate a second, rearward end 32*b* of the coupling member 30*b*. Embodiments of the ramped surface 95*b* may be structurally integral with the engagement member 97*b* and the body of the sleeve 90*b*. Furthermore, embodiments of an assembled configuration of connector 103 with respect to the sleeve 90*b* may involve sliding the sleeve 90*b* over the coupling member 30*b* in an axial direction starting from the first end 31*b* and continuing toward the second end 32*b* of the coupling member 30*b* until sufficient mating and/or engagement occurs between the engagement member 97*b* of the sleeve 90*b* and the retaining structure 37*b* of the coupling member 30*b*, as shown in FIG. 4B. Sleeve 90*b* may also include outer surface feature(s) 99*b*, such as annular serrations or slots, configured to enhance gripping of the sleeve 90 while connecting the coaxial cable connector onto an interface port.

Figure 5:
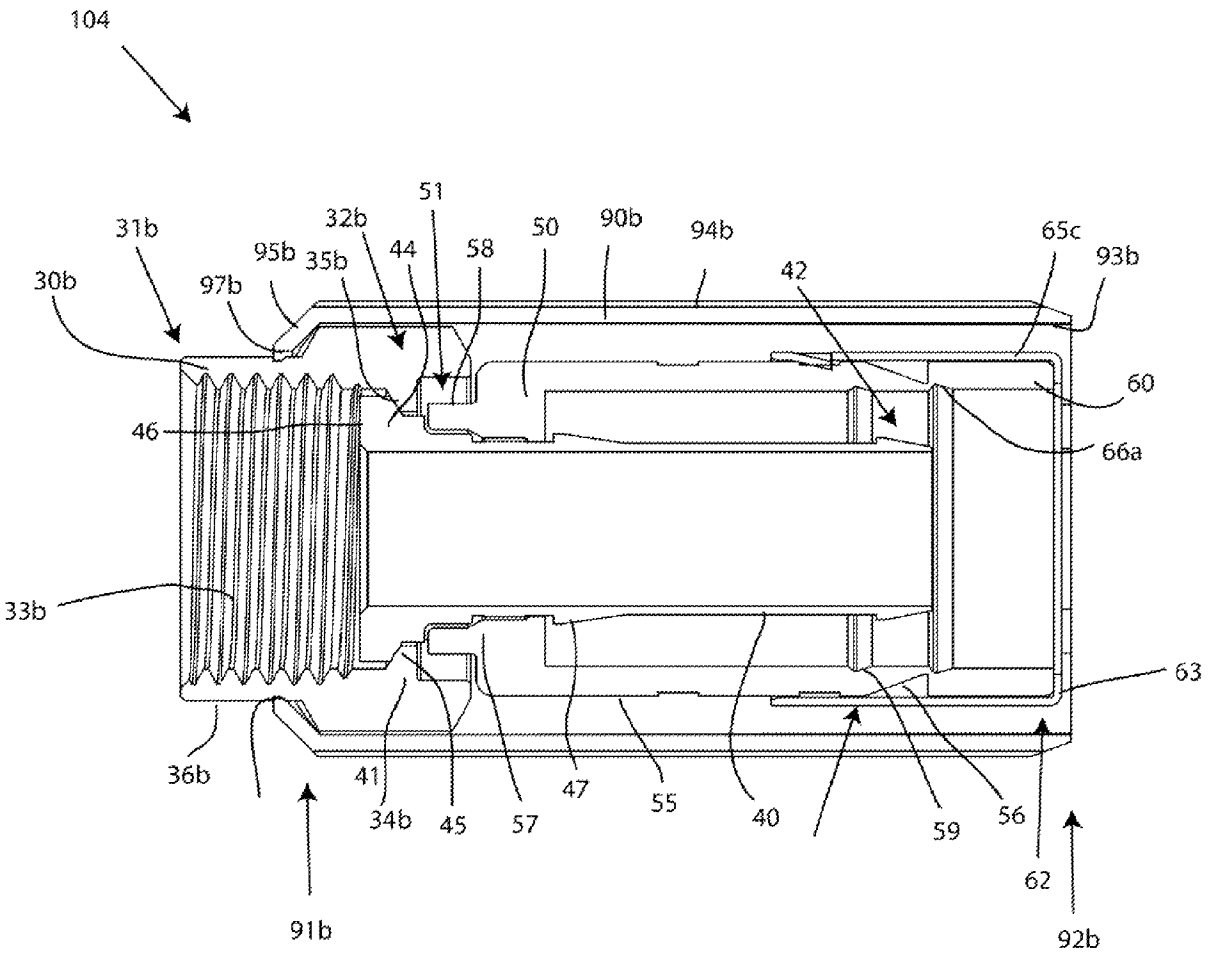
FIG. 5 depicts a cross-section view of a fifth embodiment of a coaxial cable connector including an embodiment of an outer sleeve, an embodiment of a compression portion, and an embodiment of a radial restriction member.

FIG. 5 depicts an embodiment of connector 104. Embodiments of connector 104 may include a coupling member 30*b*, a post 40, a connector body 50, an outer sleeve 90*b*, a compression portion 60, and a radial restriction member 65*c*.

Figure 6:
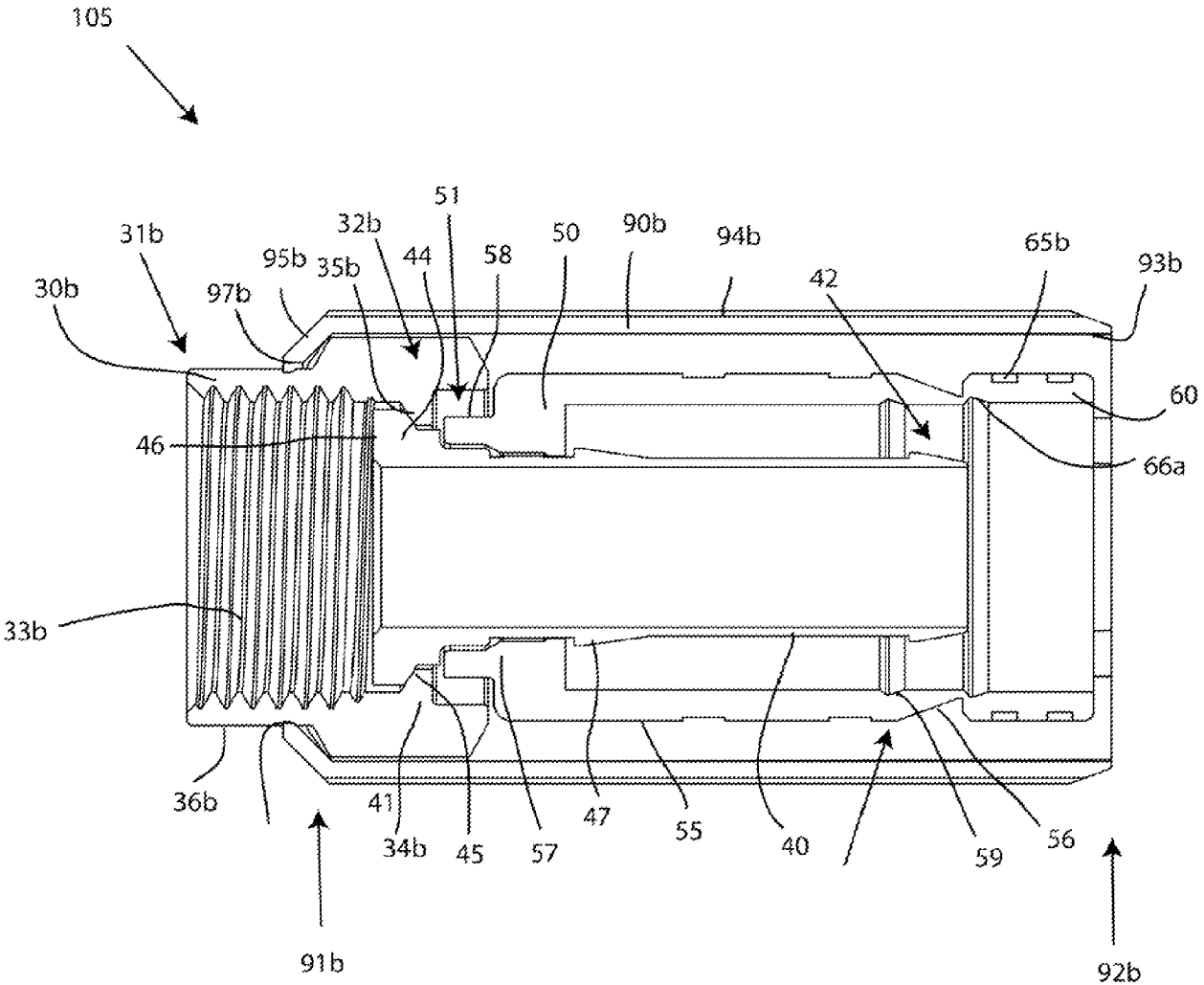
FIG. 6 depicts a cross-section view of a sixth embodiment of a coaxial cable connector including an embodiment of an outer sleeve, an embodiment of a compression portion, and an embodiment of a radial restriction member.

FIG. 6 depicts an embodiment of connector 105. Embodiments of connector 105 may include a coupling member 30*b*, a post 40, a connector body 50, an outer sleeve 90*b*, a compression portion 60, and a radial restriction member 65*b*

Figure 7:
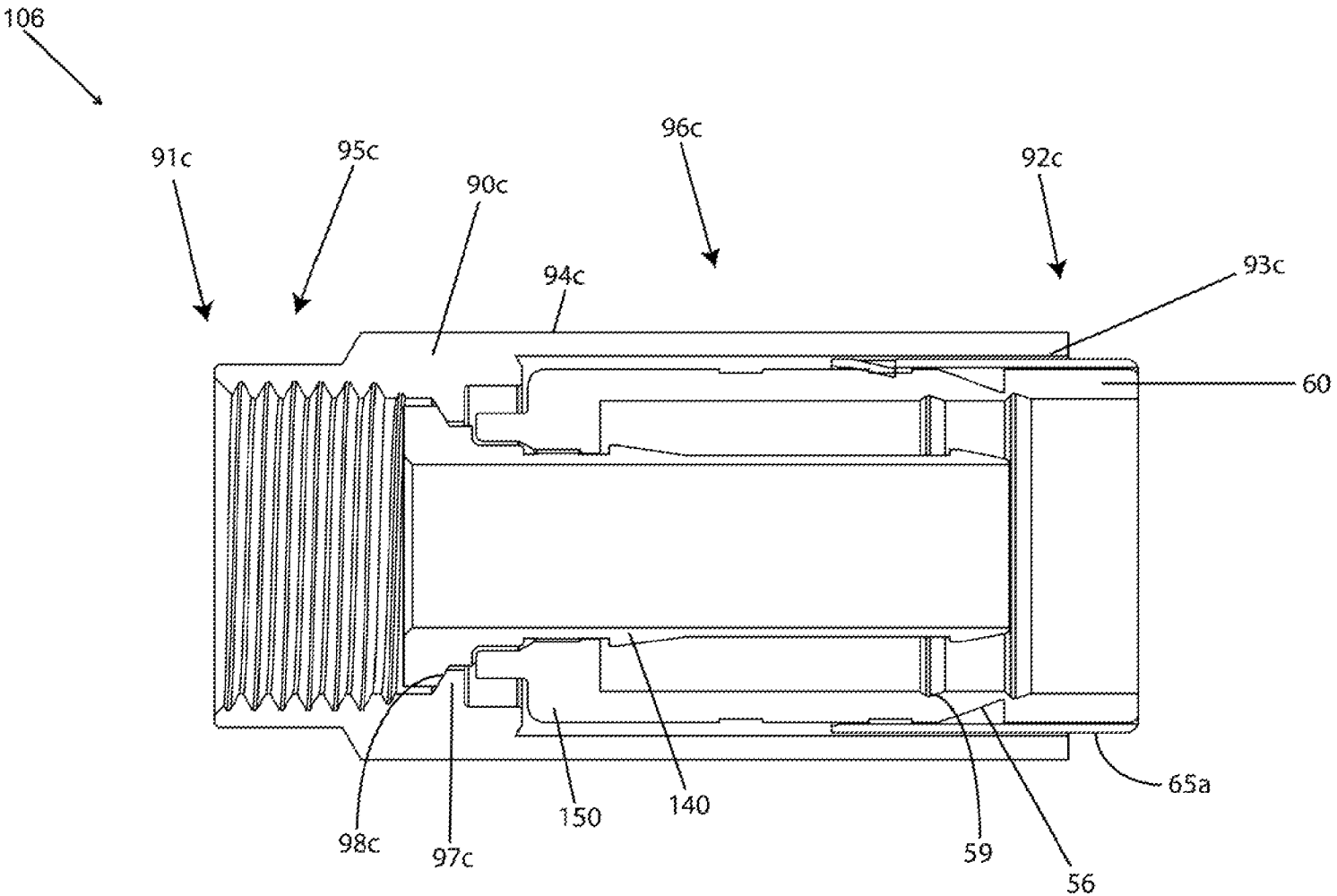
FIG. 7 depicts a cross-section view of an seventh embodiment of a coaxial cable connector including an embodiment of an outer integral sleeve, an embodiment of a compression portion, and an embodiment of a radial restriction member.

Referring now to FIG. 7, embodiments of connector 106 may include an integral sleeve 90*c*, a post 40, a connector body 50, a compression portion 60, and a radial restriction member 65*a*.

Embodiments of connector 106 may include an integral sleeve 90*c*. An integral sleeve 90*c* may be a generally annular member having a generally axial opening therethrough. The integral sleeve 90*c* may include a first end 91*c*, a second end 1392*c*, an outer surface 93*c*, and an outer surface 94*c*. Furthermore, the integral sleeve 90*c* may include a coupling portion 95*c* proximate the first end 91*c* and a body portion 96*c* structurally integral with the coupling portion 95*c*. The coupling portion 95*c* may include internal threads for operable engagement with an interface port, such as interface port 20. For instance, the internal threads of the coupling portion 95*c* of the integral sleeve 90*c* may correspond to threads on the outer surface of an interface port. The coupling portion 95*c* may also include an internal lip 97*c*, such as an annular protrusion. The internal lip 97*c* includes a surface 98*c* facing the first forward end 91*c* of the integral sleeve 90*c*. The forward facing surface 98*c* of the lip 97*c* may be a tapered surface that corresponds to a tapered surface 45 of the post 40. The forward facing surface 98*c* of the coupling portion 95*c* faces the flange 44 of the post 40 when operably assembled in a connector 106, so as to allow the integral sleeve 90*c* to rotate with respect to the other component elements, such as the post 40 and the connector body 50. The structural configuration of the coupling portion 95*c* of integral sleeve 90*c* may vary according to differing connector design parameters to accommodate different functionality of a coaxial cable connector. For instance, the first forward end 91*c* of the integral sleeve 90*c* may include internal and/or external structures such as ridges, grooves, curves, detents, slots, openings, chamfers, or other structural features, etc., which may facilitate the operable joining of an environmental sealing member, such a water-tight seal or other attachable component element, that may help prevent ingress of environmental contaminants, such as moisture, oils, and dirt, at the first forward end 91*c* of the integral sleeve 90*c*, when mated with an interface port 20. Those in the art should appreciate that the coupling portion 95*c* need not be threaded.

Moreover, the integral sleeve 90*c* includes a body portion 96*c* that may be structurally integral with the coupling portion 95*c* to form an outer sleeve that may surround the post 40, the connector body 50, the compression portion 60, or a portion thereof, and the radial restriction member 65, or a portion thereof when in an assembled and/or compressed position. Because the body portion 96*c* may be structurally integral with the coupling portion 95*c*, rotation or twisting of the body portion 96*c* can cause rotation or twisting of the coupling portion 95*c* to operably mate a coaxial cable connector, such as connector 106, onto an interface port. Thus, the integral sleeve 90*c* includes a larger surface area to grip and twist the integral sleeve 90*c* to thread the coupling portion 95*c* fully onto the interface port, such as interface port 20. Embodiments of the body portion 96*c* of the integral sleeve 90*c* may include outer surface features, such as annular serrations or slots, configured to enhance gripping of the integral sleeve 90*c* while connecting the coaxial cable connector onto an interface port. The body portion 96*c* of the sleeve 90*c* may be formed of materials such as plastics, polymers, bendable metals or composite materials that facilitate a rigid body, while the coupling portion 95*c* may be formed of conductive materials, such as copper, brass, aluminum, or other metals or metal alloys, facilitating grounding through the connector. In other words, the integral sleeve 90*c* may be formed of both conductive and non-conductive materials. For example, the external surface of the coupling portion 95*c* of the integral sleeve 90*c* may be formed of a polymer, while the remainder of the coupling portion 95*c* may be comprised of a metal or other conductive material. Alternatively, the coupling portion 95*c* and the body portion 96*c* of the integral sleeve 90*c* may be formed of conductive materials such as metals or metal alloys, or may both be formed of polymers or other materials that would facilitate a rigidly formed component. Manufacture of the integral sleeve 90*c* may include casting, extruding, cutting, knurling, turning, tapping, drilling, injection molding, blow molding, combinations thereof, or other fabrication methods that may provide efficient production of the component.

Figure 8:
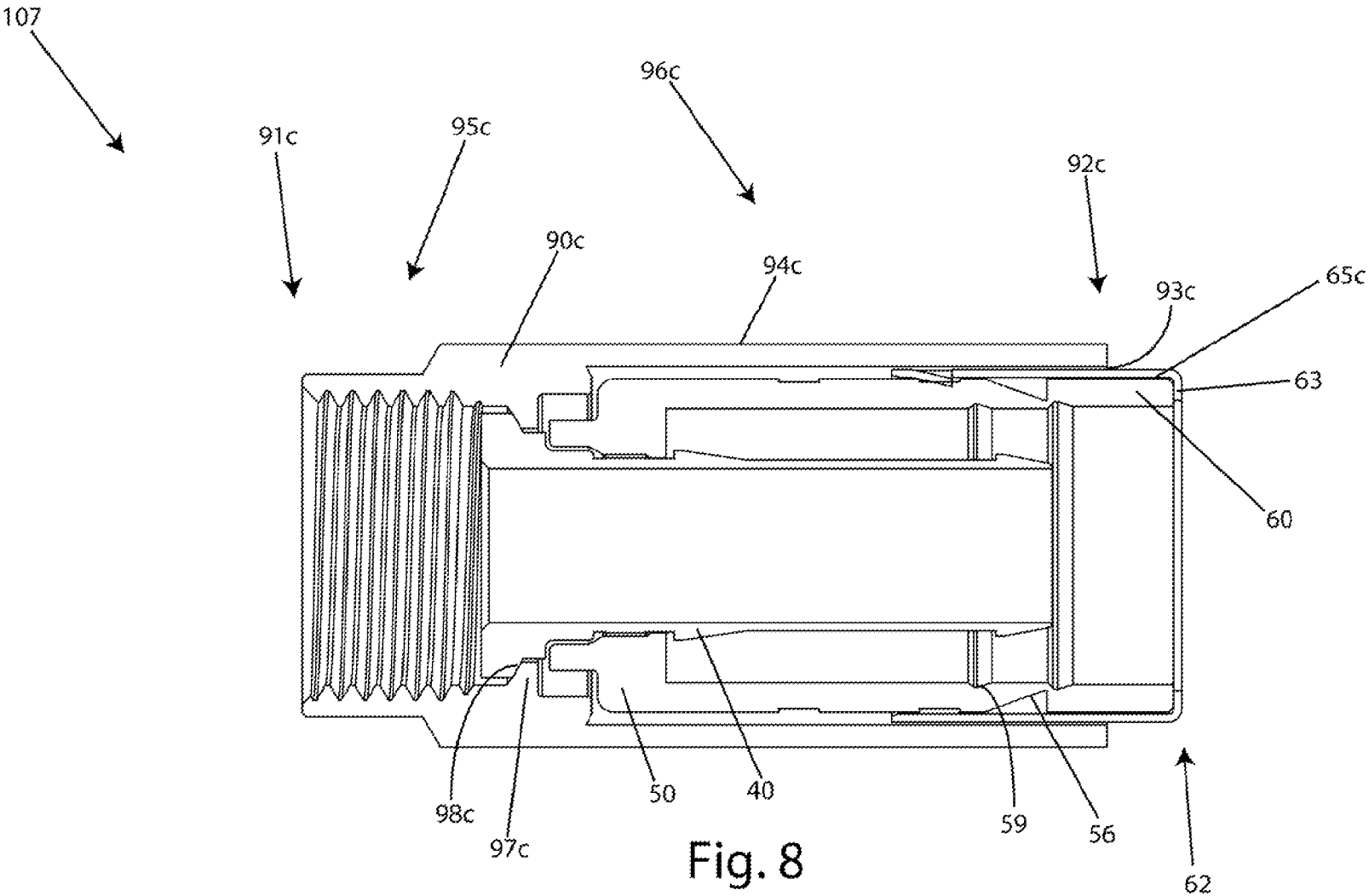
FIG. 8 depicts a cross-section view of an eighth embodiment of a coaxial cable connector including an embodiment of an outer integral sleeve, an embodiment of a compression portion, and an embodiment of a radial restriction member.

FIG. 8 depicts an embodiment of connector 107. Embodiments of connector 107 may include an integral sleeve 90*c*, a post 40, a connector body 50, a compression portion 60, and a radial restriction member 65*c*.

Figure 9:
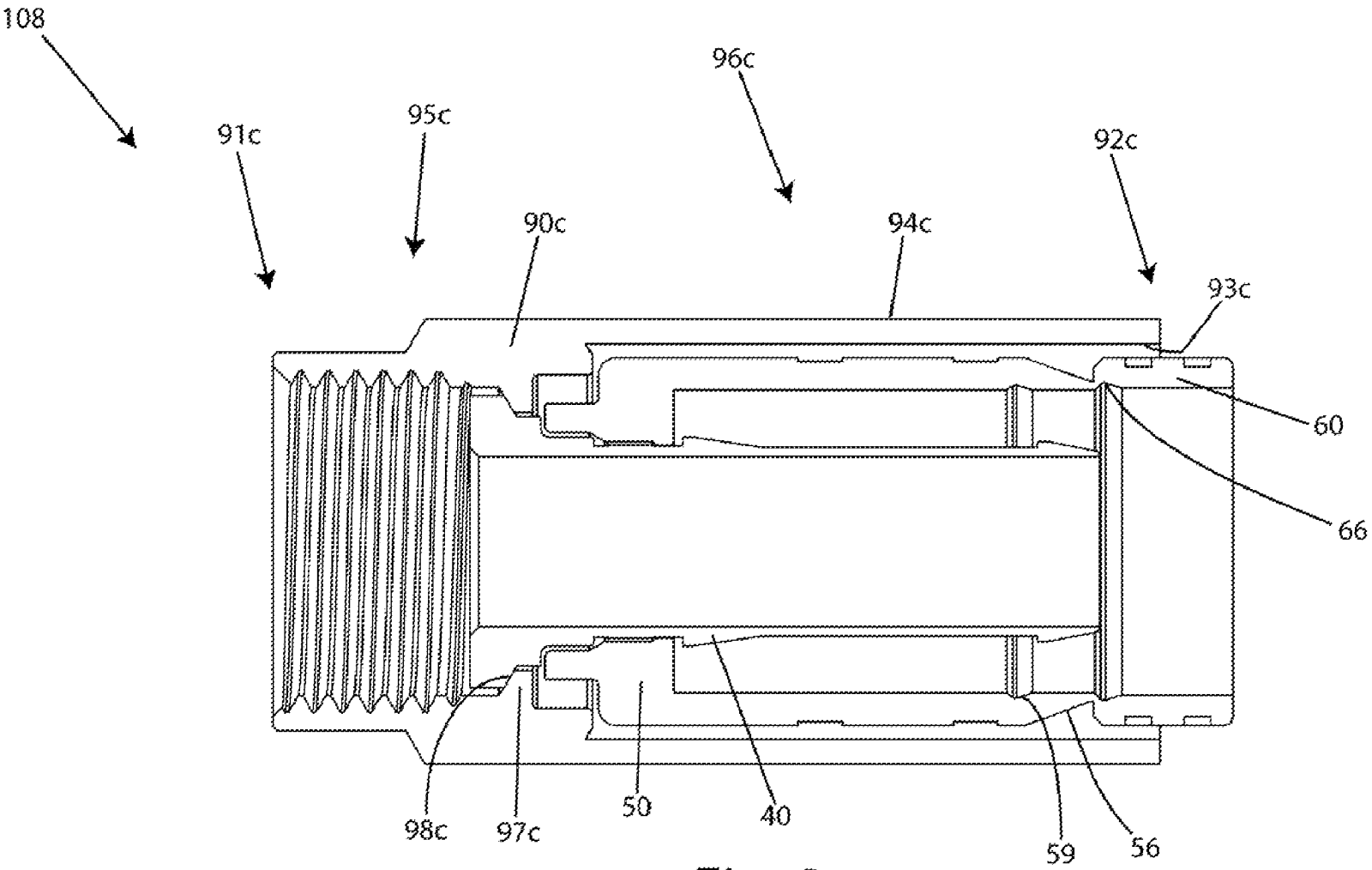
FIG. 9 depicts a cross-section view of a ninth embodiment of a coaxial cable connector including an embodiment of an outer integral sleeve, an embodiment of a compression portion, and an embodiment of a radial restriction member.

FIG. 9 depicts an embodiment of connector 108. Embodiments of connector 108 may include an integral sleeve 90*c*, a post 40, a connector body 50, a compression portion 60, and a radial restriction member 65*b*.

Figure 10:
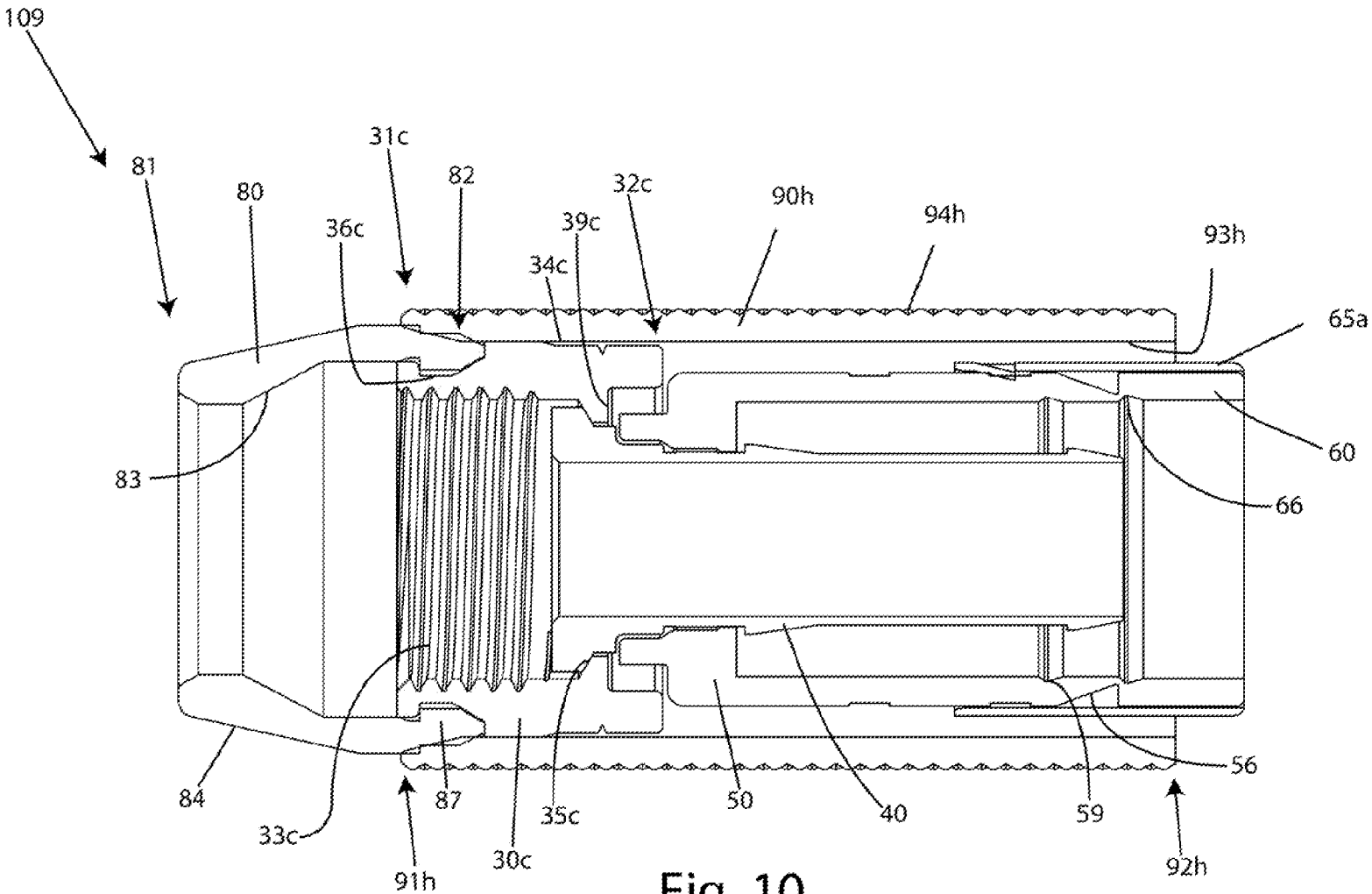
FIG. 10 depicts a cross-section view of a tenth embodiment of a coaxial cable connector including an embodiment of a sealing member, an embodiment of an outer sleeve, an embodiment of a compression portion, and an embodiment of a radial restriction member.

With reference now to FIG. 10, embodiments of connector 109 may include a coupling member 30*c*, a post 40, a connector body 50, a sleeve 90*h*, a sealing member 80, a compression portion 60, and a radial restriction member 65*a*.

Embodiments of connector 109 may include a coupling member 30*c*. Coupling member 30*c* may share some of the structural and functional aspects of embodiments of coupling member 30*a*, 30*b*, such as being mated, threaded or otherwise, to a corresponding interface port 20. Coupling member 30*c* may include a first end 31*c*, a second end 32*c*, an inner surface 33*c*, at least a portion of which is threaded, a connector-grasping portion 39*c*, and an outer surface 34*c*, including a seal-grasping surface portion 36*c*. The seal-grasping surface portion 36*c* may be a flat, smooth surface or a flat, roughened surface suitable to frictionally and/or adhesively engage an interior sealing surface 83 of the sealing member 80. Embodiments of the seal-grasping surface portion 36*c* may also contain a ridge that together with the seal grasping surface portion 36*c* forms a groove or shoulder that is suitably sized and shaped to correspondingly engage an internal shoulder 87 of the sealing member 80 adjacent the interior sealing surface 83 in a locking-type interference fit between the coupling member 30*c* and the sealing member 80.

Moreover, the coupling member 30*c* may further include a coupling member-turning surface portion on an outer surface 84 of the sealing member 80. The coupling member-turning surface portion may have at least two flat surface regions that allow engagement with the surfaces of a tool such as a wrench. In one embodiment, the coupling member-turning surface is hexagonal. Alternatively, the coupling member-turning surface may be a knurled surface to facilitate hand-turning of the nut component. Furthermore, upon engagement of the sealing member 80 with the coupling member 30*c*, a rear sealing surface of the sealing member 80 abuts a side/edge surface of the coupling member 30*c* to form a sealing relationship in that region. In one embodiment, the connector-grasping portion 36*c* of the coupling member 30*c* is an internally-projecting shoulder that engages a flange 44 of the post 40 in such a manner that the coupling member 30*c* can be freely rotated as it is held in place as part of the connector.

With continued reference to FIG. 10, connector 109 may include a sealing member 80. The sealing member may include a first end 81, a second end 82, an inner surface 83, and an outer surface 84. The sealing member 80 may have a generally tubular body that is elastically deformable by nature of its material characteristics and design. In most embodiments, the seal member 80 is a one-piece element made of a compression molded, elastomer material having suitable chemical resistance and material stability (i.e., elasticity) over a temperature range between about −40° C. to +40° C. For example, the sealing member 80 may be made of silicone rubber. Alternatively, the material may be propylene, a typical O-ring material. Other materials known in the art may also be suitable. Furthermore, the first end 81 of sealing member 80 may be a free end for ultimate engagement with a port, while the second end 82 may be for ultimate connection to the coupling member 30*c*. The sealing member 80 may have a forward sealing surface, a rear sealing portion including an interior sealing surface 83 that integrally engages the coupling member 30*c*, and an integral joint-section intermediate the first and second end 81, 82 of the tubular body of the sealing member 80. The forward sealing surface 85 at the first end 81 of the sealing member 80 may include annular facets to assist in forming a seal with the port, such as interface port 20. Alternatively, forward sealing surface 85 may be a continuous rounded annular surface that forms effective seals through the elastic deformation of the inner surface 83 and end of the sealing member 80 compressed against the port. The integral joint-section includes a portion of the length of the sealing member 80 which is relatively thinner in radial cross-section to encourage an outward expansion or bowing of the seal upon its axial compression. In an exemplary embodiment, the coupling member grasping surface includes an interior sealing surface which forms an annular surface on the inside of the tubular body, and an internal shoulder 87 of the tubular body adjacent the second end 82. Accordingly, compressive axial force may be applied against one or both ends of the seal depending upon the length of the port intended to be sealed. The force will act to axially compress the seal whereupon it will expand radially in the vicinity of the integral joint-section. In one embodiment, the integral joint-section is located axially asymmetrically intermediate the first end 81 and the second end 82 of the tubular body, and adjacent an anterior end of the interior sealing surface 83. Embodiments of the sealing member 80 may have an interior diameter at the integral joint-section equal to about 0.44 inches in an uncompressed state; the tubular body of the sealing member 80 may have a length from the first end 81 to the second end 82 of about 0.36 inches in an uncompressed state. However, it is contemplated that the joint-section can be designed to be inserted anywhere between she sealing surface and the first end 81. The sealing member 80 may prevent the ingress of corrosive elements when the seal is used for its intended function.

Referring still to FIG. 10, embodiments of connector 109 may include an outer sleeve 90*h*. The outer sleeve 90*h* may be engageable with coupling member 30*c*. Sleeve 90 *h* may share the same or substantially the same structural and functional aspects of sleeve 90*a*, described supra, and sleeve 90*d*, 90*f*, described infra. Accordingly, the sleeve 90*h* may include a first end 91*h*, a second end 92*h*, an inner surface 93*h*, and an outer surface 94*h*. However, the sleeve 90*h* need not include an engagement member, such as an embodiment of engagement member 97*a*. The mechanical interference to effectuate simultaneous rotation/twisting of the sleeve 90*h* and the coupling member 30*c* between coupling member 30*c* and sleeve 90*h* may rely on a press-fit or interference fit between the components. Alternatively, the sleeve 90*h* may and coupling member 30*c* may include corresponding internal (sleeve 90*h*) and external (coupling member 30*c*) surface features to facilitate mechanical interference between the components. Internal and external surface features of sleeve 90*h* and coupling member 30*c* may share the structural and functional aspects as surface features 98*a* and 38*a*, as described in association with, for example, connector 100.

Figure 11:
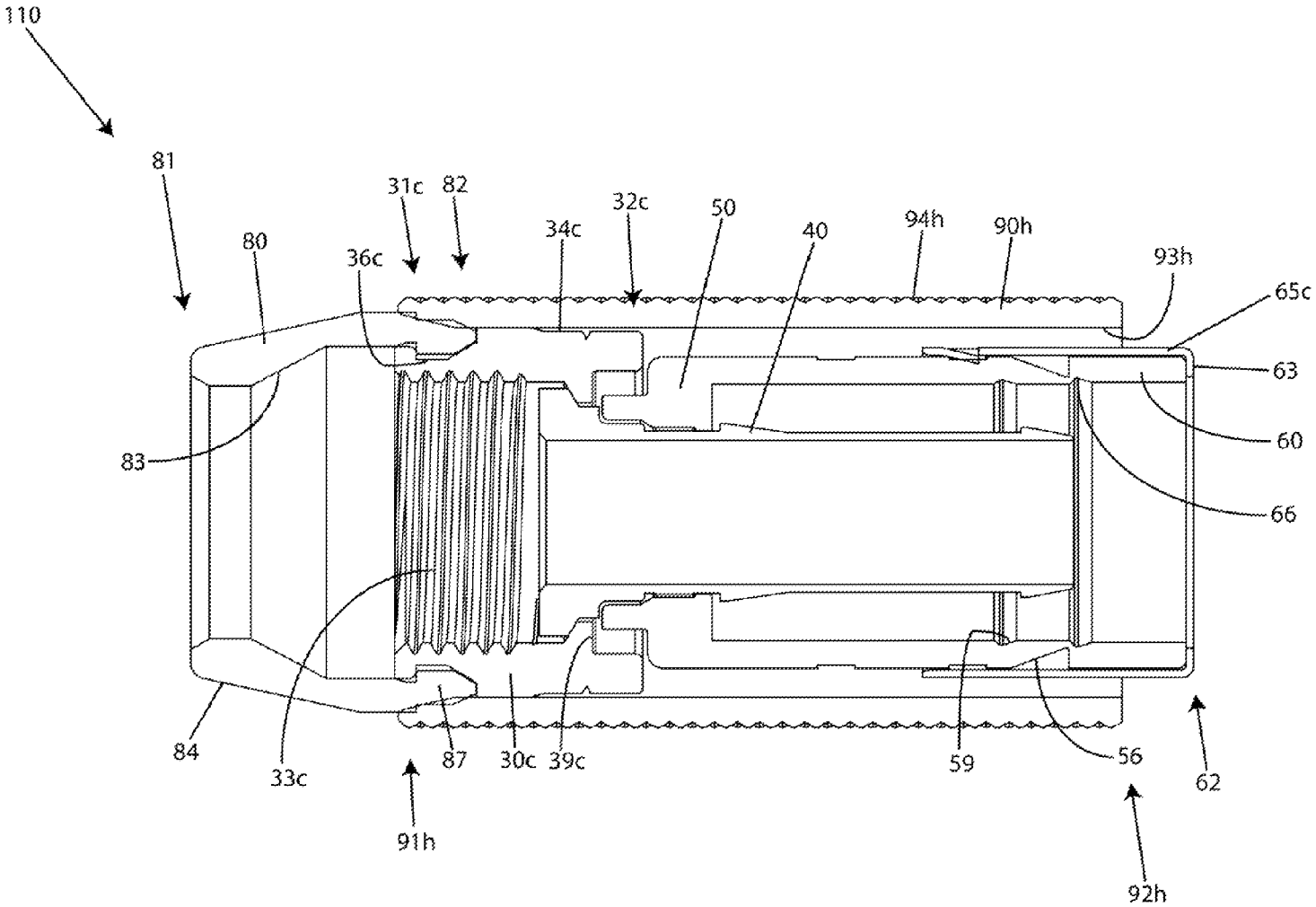
FIG. 11 depicts a cross-section view of an eleventh embodiment of a coaxial cable connector including an embodiment of a sealing member, an embodiment of an outer sleeve, an embodiment of a compression portion, and an embodiment of a radial restriction member.

FIG. 11 depicts an embodiment of connector 110. Embodiments of connector 110 may include a coupling member 30*c*, a post 40, a connector body 50, a sleeve 90*h*, a sealing member 80, a compression portion 60, and a radial restriction member 65*c*.

Figure 12:
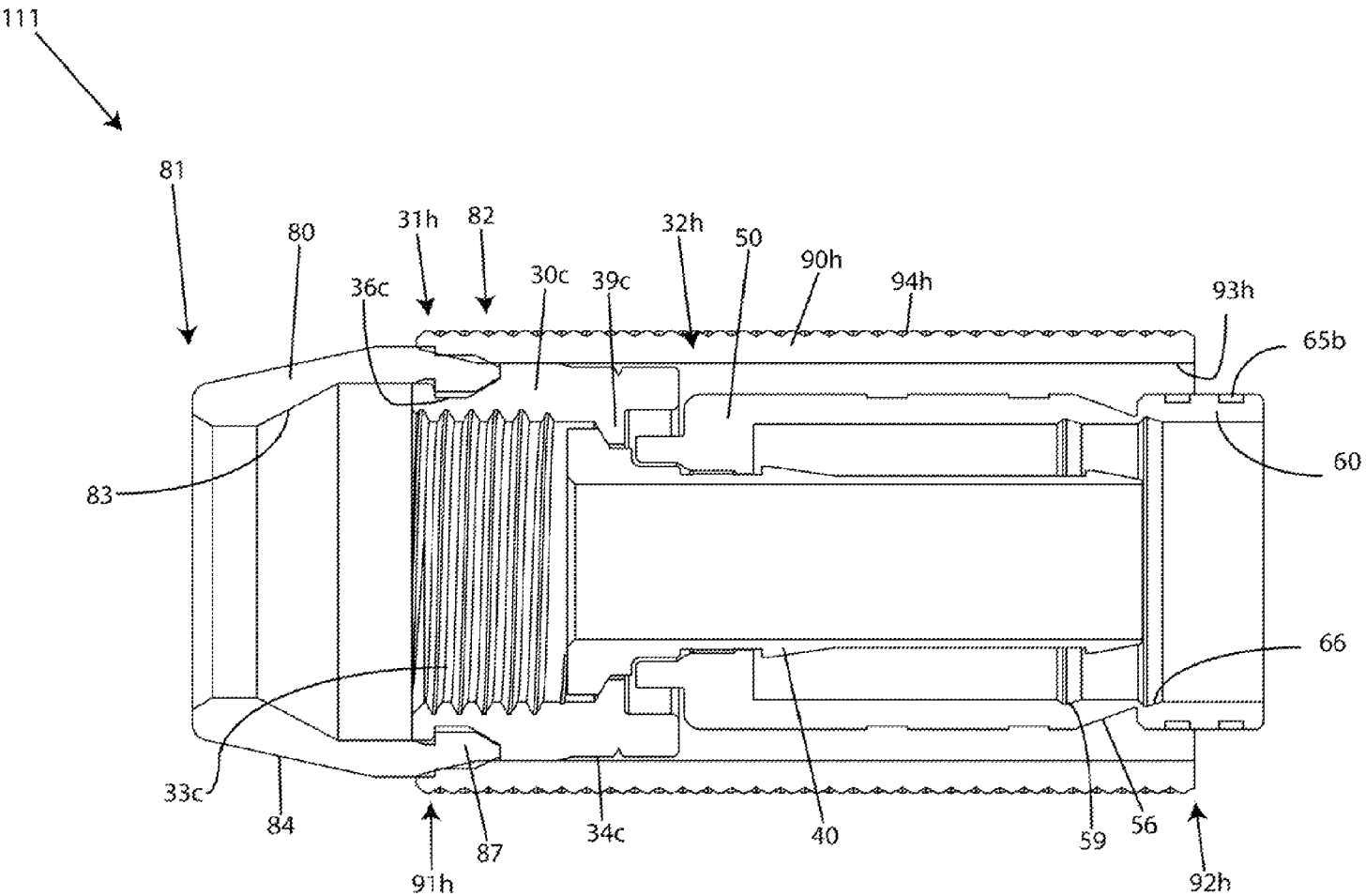
FIG. 12 depicts a cross-section view of a twelfth embodiment of a coaxial cable connector including an embodiment of an outer sleeve, an embodiment of a sealing member, an embodiment of a compression portion, and an embodiment of a radial restriction member.

FIG. 12 depicts an embodiment of connector 111. Embodiments of connector 111 may include a coupling member 30*c*, a post 40, a connector body 50, a sleeve 90*h*, a sealing member 80, a compression portion 60, and a radial restriction member 65*b*.

Figure 13:
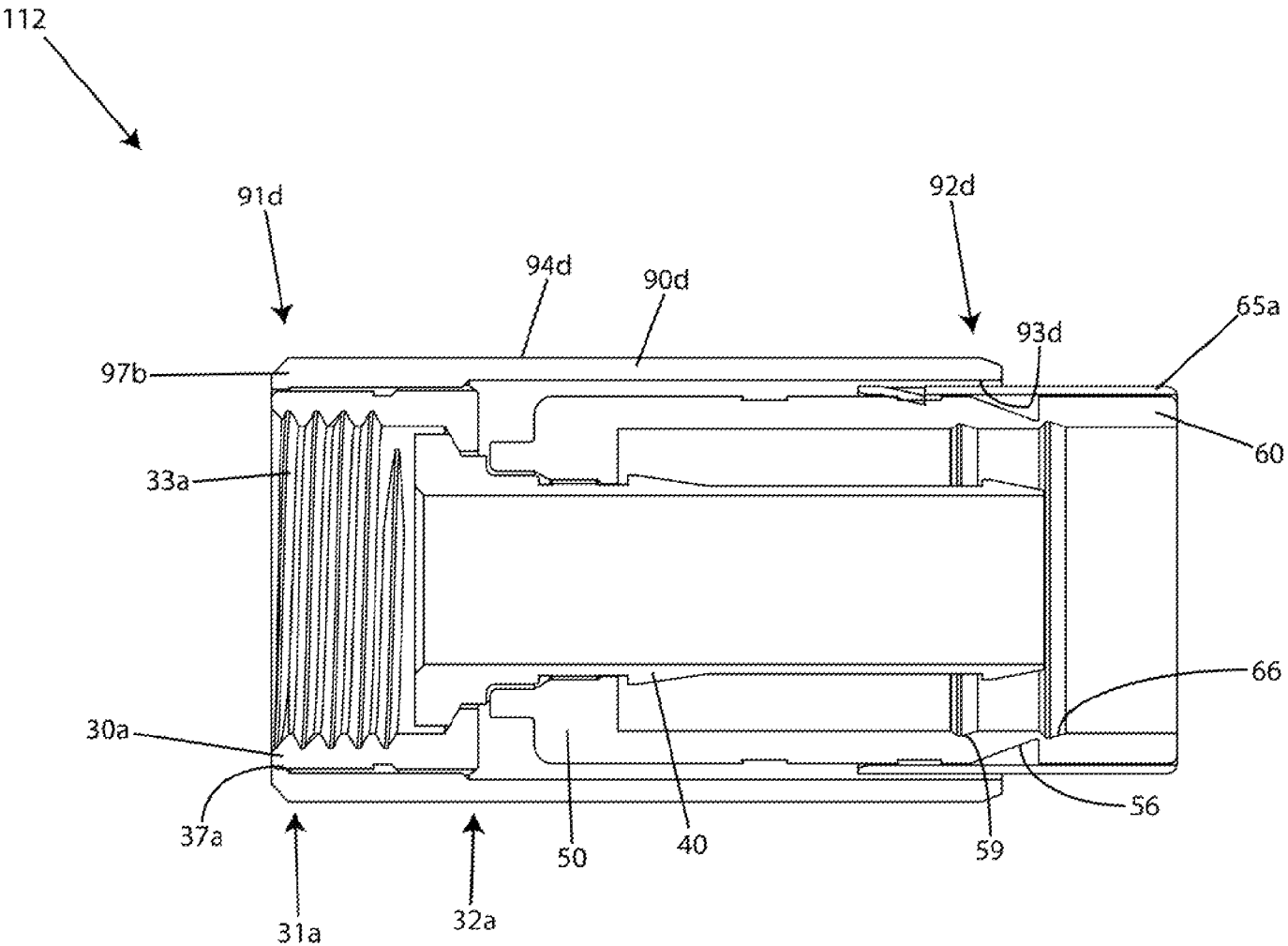
FIG. 13 depicts a cross-section view of a thirteenth embodiment of a coaxial cable connector including an embodiment of an outer sleeve, an embodiment of a compression portion, and an embodiment of a radial restriction member.

With continued reference to the drawings, FIG. 13 depicts an embodiment of connector 112. Embodiments of connector 112 may include a coupling member 30*a*, a post 40, a connector body 50, a sleeve 90*d*, a compression portion 60, and a radial restriction member 65*a*.

Embodiments of connector 112 may include a sleeve 90*d*. Sleeve 90*d* may be engageable with the coupling member 30*a*. Sleeve 90*d* may share the same or substantially the same structural and functional aspects of sleeve 90*a*. Accordingly, sleeve 90*d* may include an engagement member 97*d* that is configured to mate or engage with a retaining structure 37*a* of the coupling member 30*a*. Additionally, the sleeve 90*d* may include a first end 91*d*, a second end 92*d*, an inner surface 93*d*, and an outer surface 94*d*, and may be a generally annular member having a generally axial opening therethrough. Additionally, sleeve 90*d* may surround the coupling member 30*a*, the post 40, the connector body 50, or a portion thereof, the compression portion 60, and a radial restriction member 65, or a portion thereof when in an assembled and/or compressed position. However, the sleeve 90*d* may extend towards the first end 31*a* of coupling member 30*a*. In one embodiment, the first end 91*d* of the sleeve 90*d* may be flush or substantially flush with an edge of the coupling member 30*a* proximate or otherwise near the first end 31*a* of the coupling member 30*a*. Moreover, the engagement member 97*d* may be located proximate or otherwise near the edge of the first end 91*d* of the sleeve 90*d*. The engagement member 97*d* may be configured to mate or engage a retaining structure 37*a* of the coupling member 30*a* that is correspondingly located proximate or otherwise near the first end 31*a* of the coupling member 30*a*.

Figure 14:
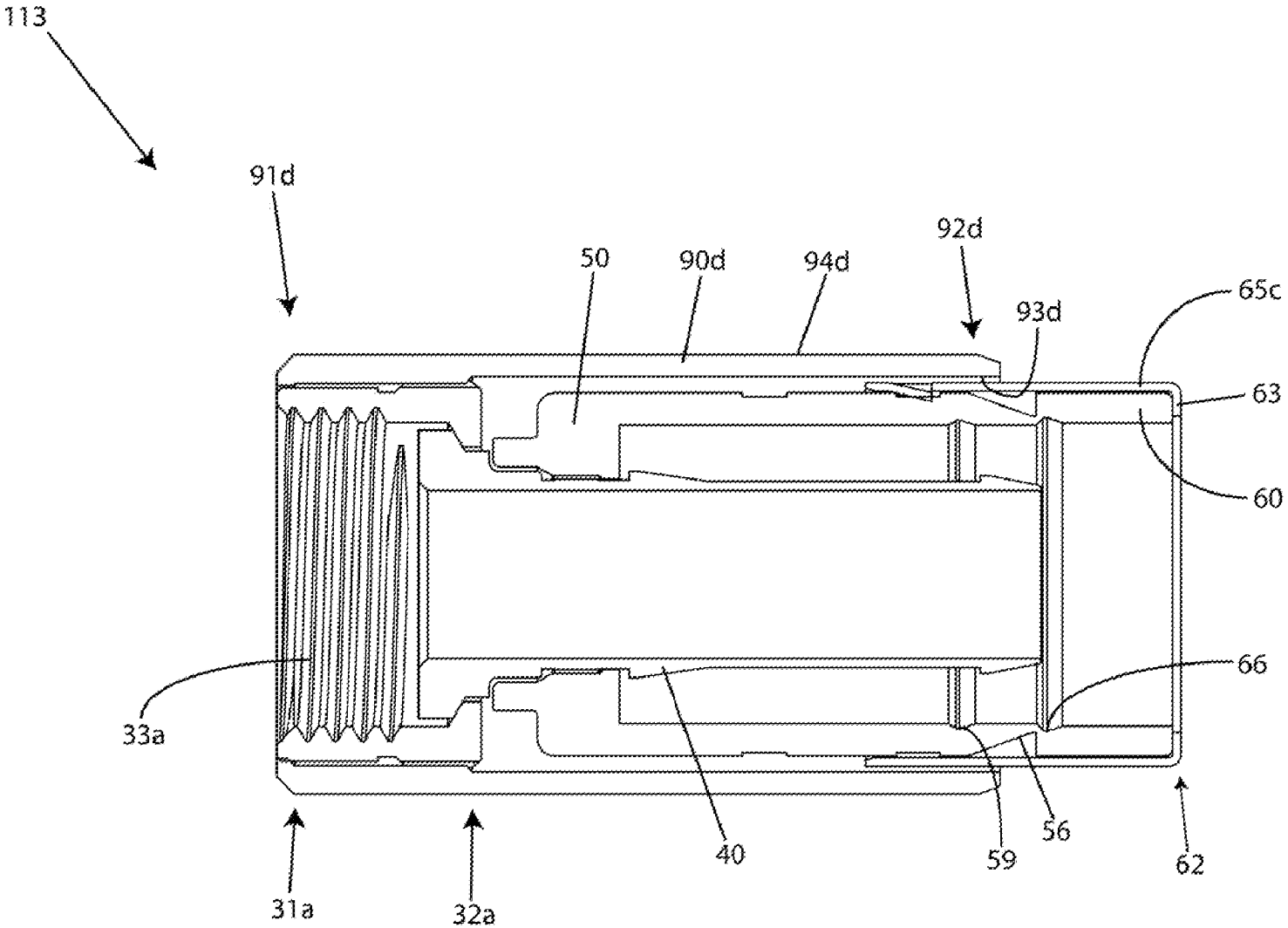
FIG. 14 depicts a cross-section view of a fourteenth embodiment of a coaxial cable connector including an embodiment of an outer sleeve, an embodiment of a compression portion, and an embodiment of a radial restriction member.

FIG. 14 depicts an embodiment of connector 113. Embodiments of connector 113 may include a coupling member 30*a*, a post 40, a connector body 50, an outer sleeve 90*d*, a compression portion 60, and a radial restriction member 65*c*.

Figure 15:
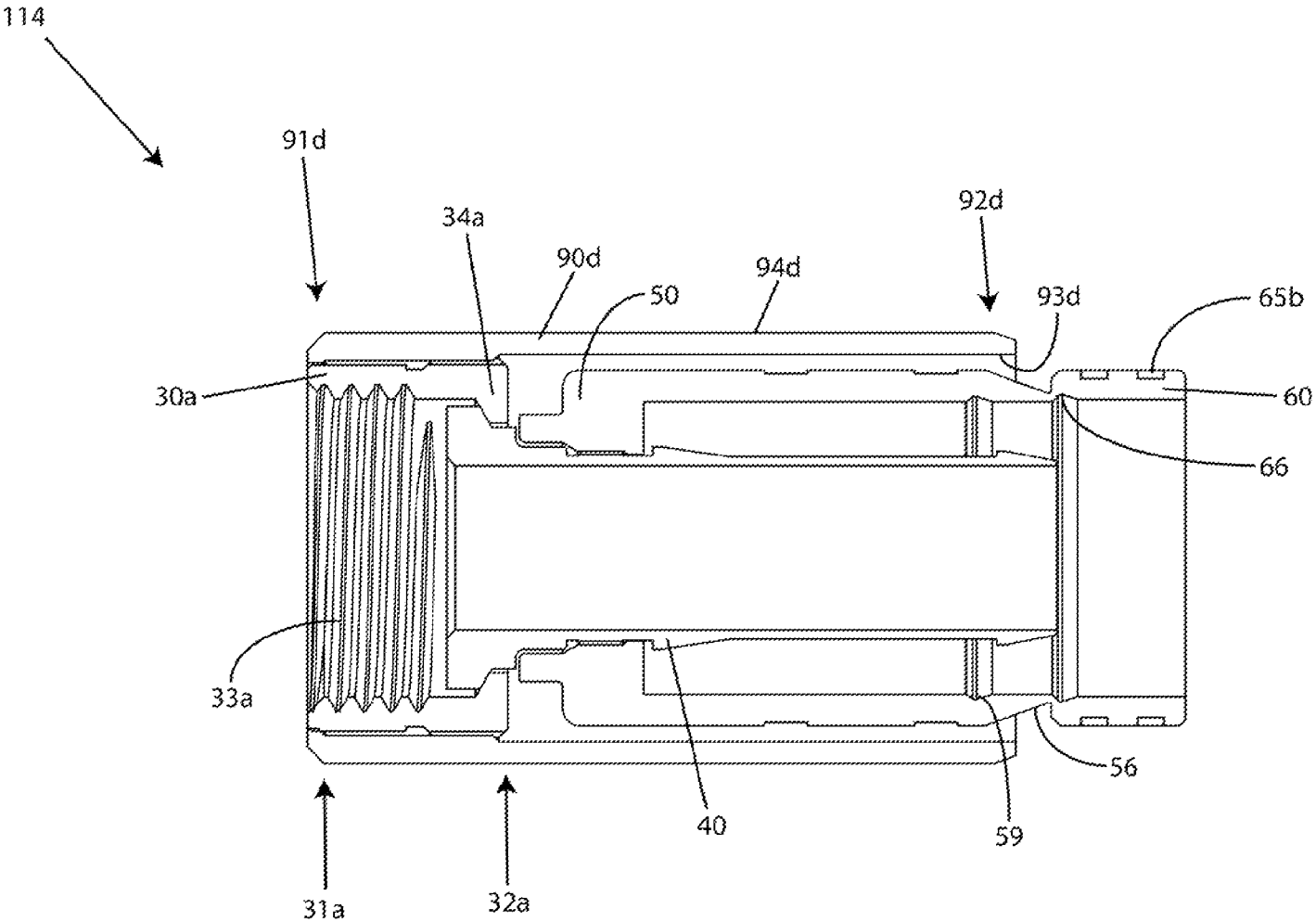
FIG. 15 depicts a cross-section view of a fifteenth embodiment of a coaxial cable connector including an embodiment of an outer sleeve, an embodiment of a compression portion, and an embodiment of a radial restriction member.

FIG. 15 depicts an embodiment of connector 114. Embodiments of connector 114 may include a coupling member 30*a*, a post 40, a connector body 50, an outer sleeve 90*d*, a compression portion 60, and a radial restriction member 65*b*.

Figure 16:
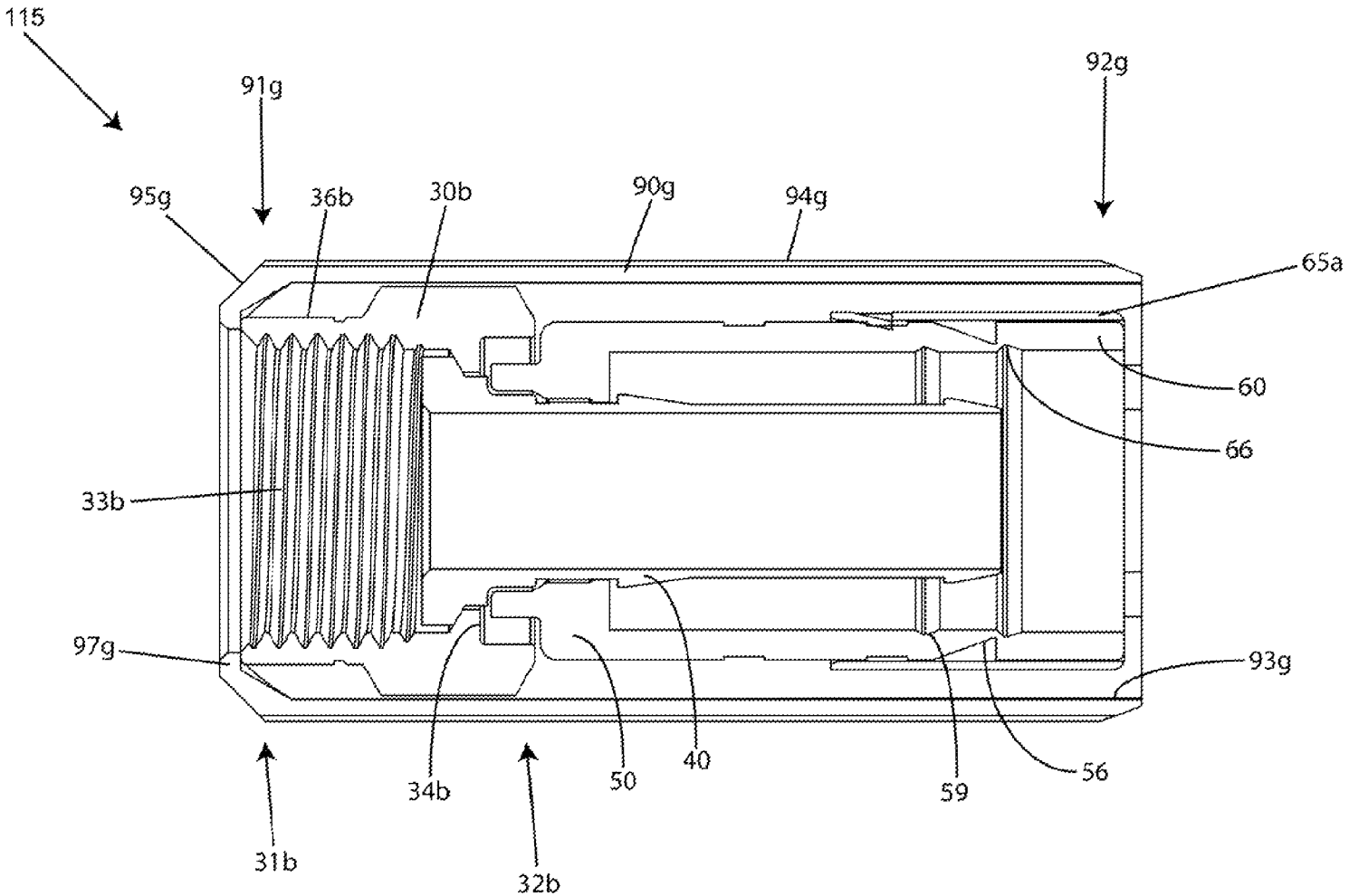
FIG. 16 depicts a cross-section view of a sixteenth embodiment of a coaxial cable connector including an embodiment of an outer sleeve, an embodiment of a compression portion, and an embodiment of a radial restriction member.

Referring now to FIG. 16, embodiments of connector 115 may include a coupling member 30*b*, a post 40, a connector body 50, an outer sleeve 90*g*, a compression portion 60, and a radial restriction member 65*a*.

Embodiments of connector 115 may include an outer sleeve 90*g*. Sleeve 90*g* may be engageable with the coupling member 30*b*. Sleeve 90*g* may share the same or substantially the same function as sleeve 90*b* and sleeve 90*f* described infra. Accordingly, the sleeve 90*g* may include a first end 91*g*, a second end 92*g*, an inner surface 93*g*, and an outer surface 94*g*, and may be a generally annular member having a generally axial opening therethrough. Sleeve 90*g* may surround the coupling member 30*b*, the post 40, the connector body 50, or a portion thereof, the compression portion 60, and a radial restriction member 65, or a portion thereof, when in an assembled and/or compressed position. Moreover, the sleeve 90*g* may extend towards the first end 31*b* of coupling member 30*b*. However, sleeve 90*g* may include an inwardly extending lip 97*g* proximate or otherwise near the first end 91*g* of the sleeve 90*g*, which can help guide the coupling member 30*b* onto a corresponding interface port. The lip 97*g* may share the same structural and functional aspects of the engagement member 97*b*. For instance, the lip 97*g* may radially inwardly extend a distance sufficient to prevent axial movement of the sleeve 90*g* in a direction towards the second end 32*b* of the coupling member 30*b* when operably assembled and/or in a compressed position. An embodiment of an assembled configuration of connector 115 with respect to the sleeve 90*g* may involve sliding the sleeve 90*g* over the coupling member 30*b* in an axial direction starting from the first end 31*b* and continuing toward the second end 32*b* of the coupling member 30*b* until sufficient mechanical interference and/or engagement occurs between the lip 97*g* of the sleeve 90*g* and frontal edge or mating surface of the coupling member 30*b*. The simultaneous rotation/twisting of the sleeve 90*g* and the coupling member 30*b* may be effectuated in the same or similar manner as described between the sleeve 90*b* and the coupling member 30*b*.

Figure 17:
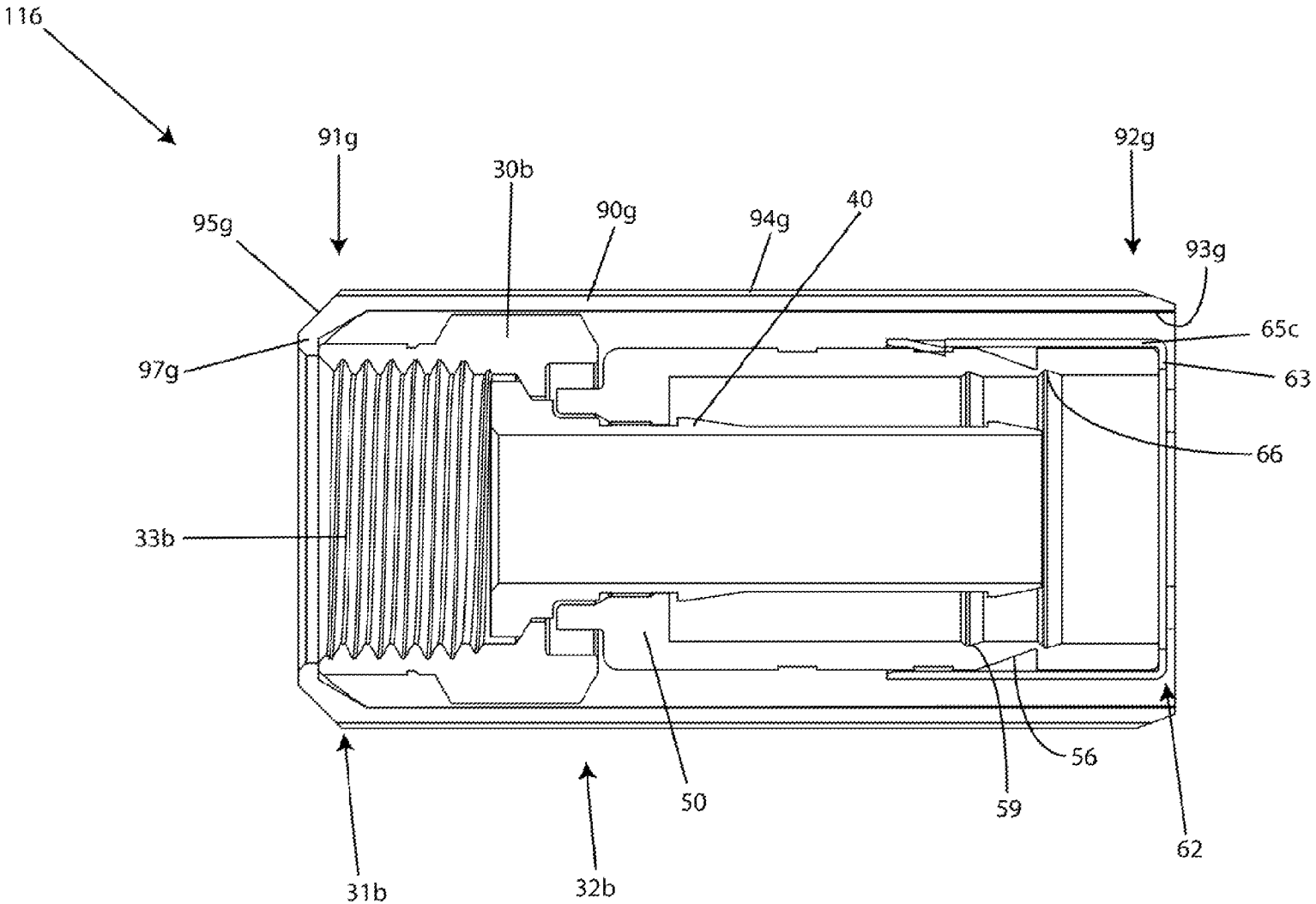
FIG. 17 depicts a cross-section view of a seventeenth embodiment of a coaxial cable connector including an embodiment of an outer sleeve, an embodiment of a compression portion, and an embodiment of a radial restriction member.

FIG. 17 depicts an embodiment of connector 116. Embodiments of connector 116 may include a coupling member 30*b*, a post 40, a connector body 50, an outer sleeve 90*g*, a compression portion 60, and a radial restriction member 65*c*.

Figure 18:
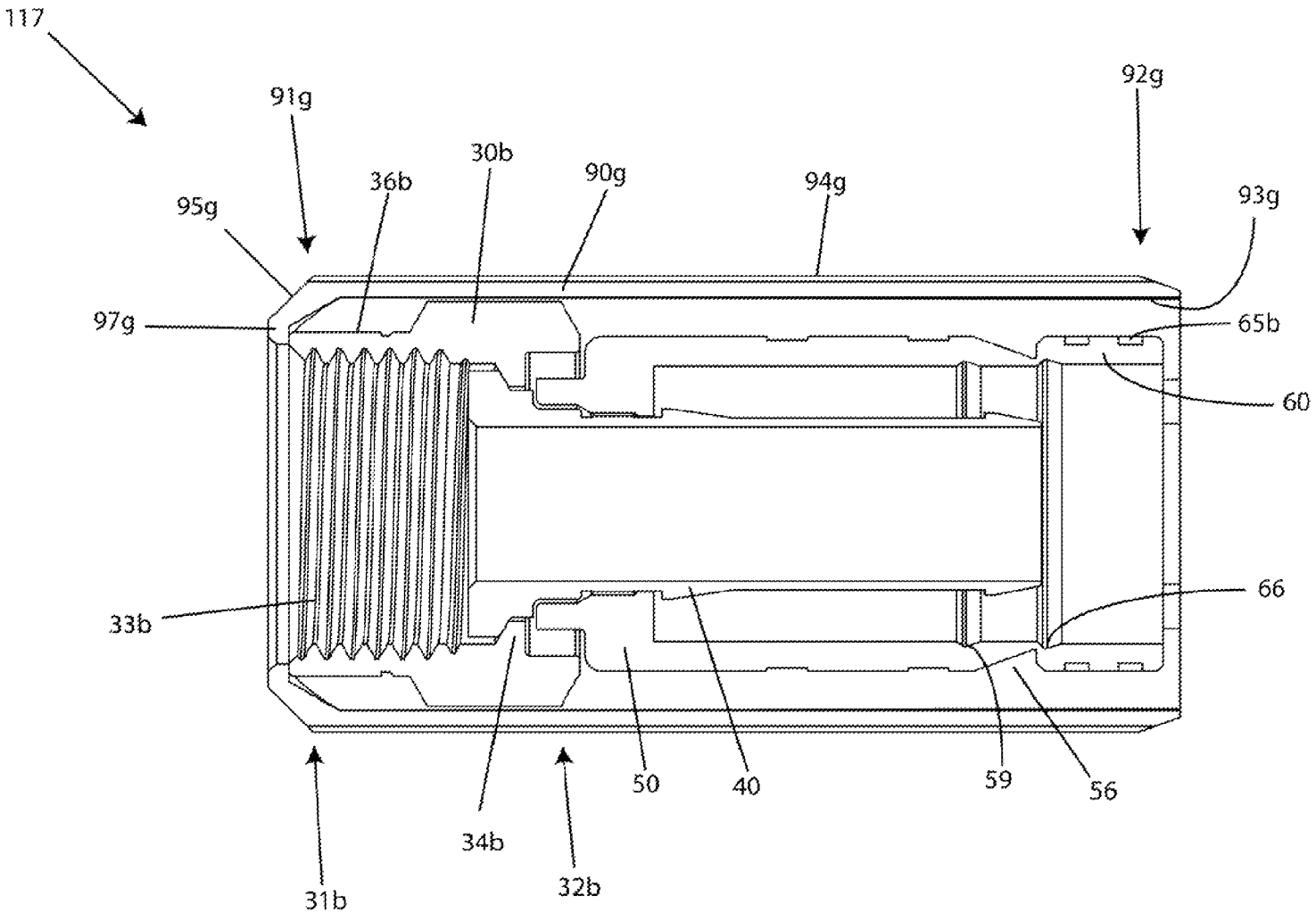
FIG. 18 depicts a cross-section view of an eighteenth embodiment of a coaxial cable connector including an embodiment of an outer sleeve, an embodiment of a compression portion, and an embodiment of a radial restriction member.

FIG. 18 depicts an embodiment of connector 117. Embodiments of connector 117 may include a coupling member 30*b*, a post 40, a connector body 50, an outer sleeve 90*g*, a compression portion 60, and a radial restriction member 65*b*.

Figure 19:
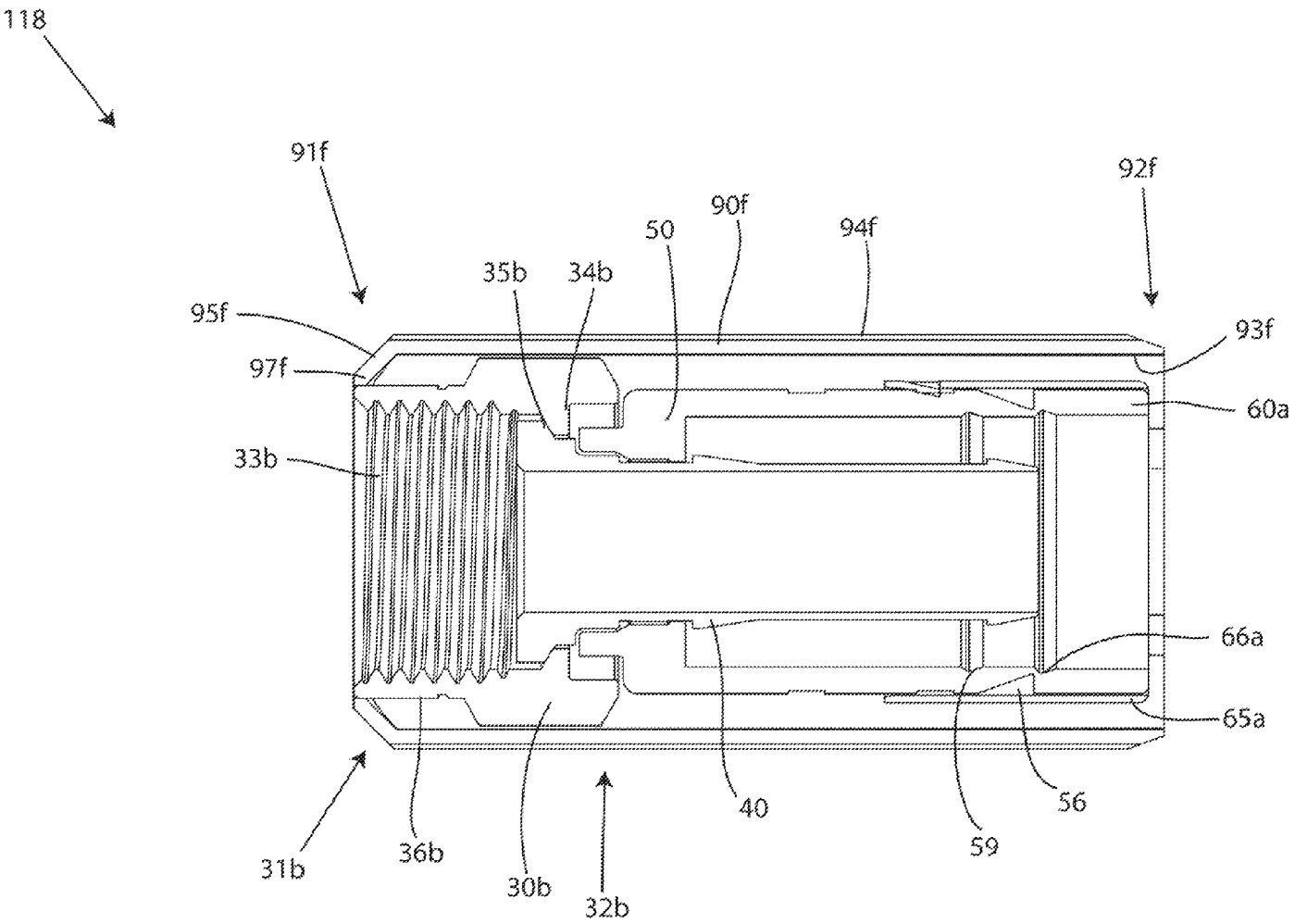
FIG. 19 depicts a cross-section view of a nineteenth embodiment of a coaxial cable connector including an embodiment of an outer sleeve, an embodiment of a compression portion, and an embodiment of a radial restriction member.

With reference now to FIG. 19, embodiments of connector 118 may include a coupling member 30*b*, a post 40, a connector body 50, an outer sleeve 90*f*, a compression portion 60, and a radial restriction member 65*a*.

Embodiments of connector 118 may include an outer sleeve 90*f*. Sleeve 90*f* may share the same or substantially the same structural and functional aspects of sleeve 90*b*. Accordingly, sleeve 90*f* may include an engagement member 97*f* that is configured to mate or engage with a retaining structure 37*b* of the coupling member 30*b*. For example, the sleeve 90*f* may include a first end 91*f*, a second end 92*f*, an inner surface 93*f*, and an outer surface 94*f*, and may be a generally annular member having a generally axial opening therethrough. Additionally, sleeve 90*f* may surround the coupling member 30*b*, the post 40, the connector body 50, or a portion thereof, the compression portion 60, and a radial restriction member 65, or a portion thereof when in an assembled and/or compressed position. However, the sleeve 90*f* may extend towards the first end 31*b* of coupling member 30*b*. In one embodiment, the first end 91*f* of the sleeve 90*f* may be flush or substantially flush with an edge of the coupling member 30*b* proximate or otherwise near the first end 31*b* of the coupling member 30*b*. Moreover, the engagement member 97*f* may be located proximate or otherwise near the edge of the first end 91*f* of the sleeve 90*f*. The engagement member 97*f* may be configured to mate or engage a retaining structure 37*b* of the coupling member 30*b* that is correspondingly located proximate or otherwise near the first end 31*b* of the coupling member 30*b*.

Figure 20:
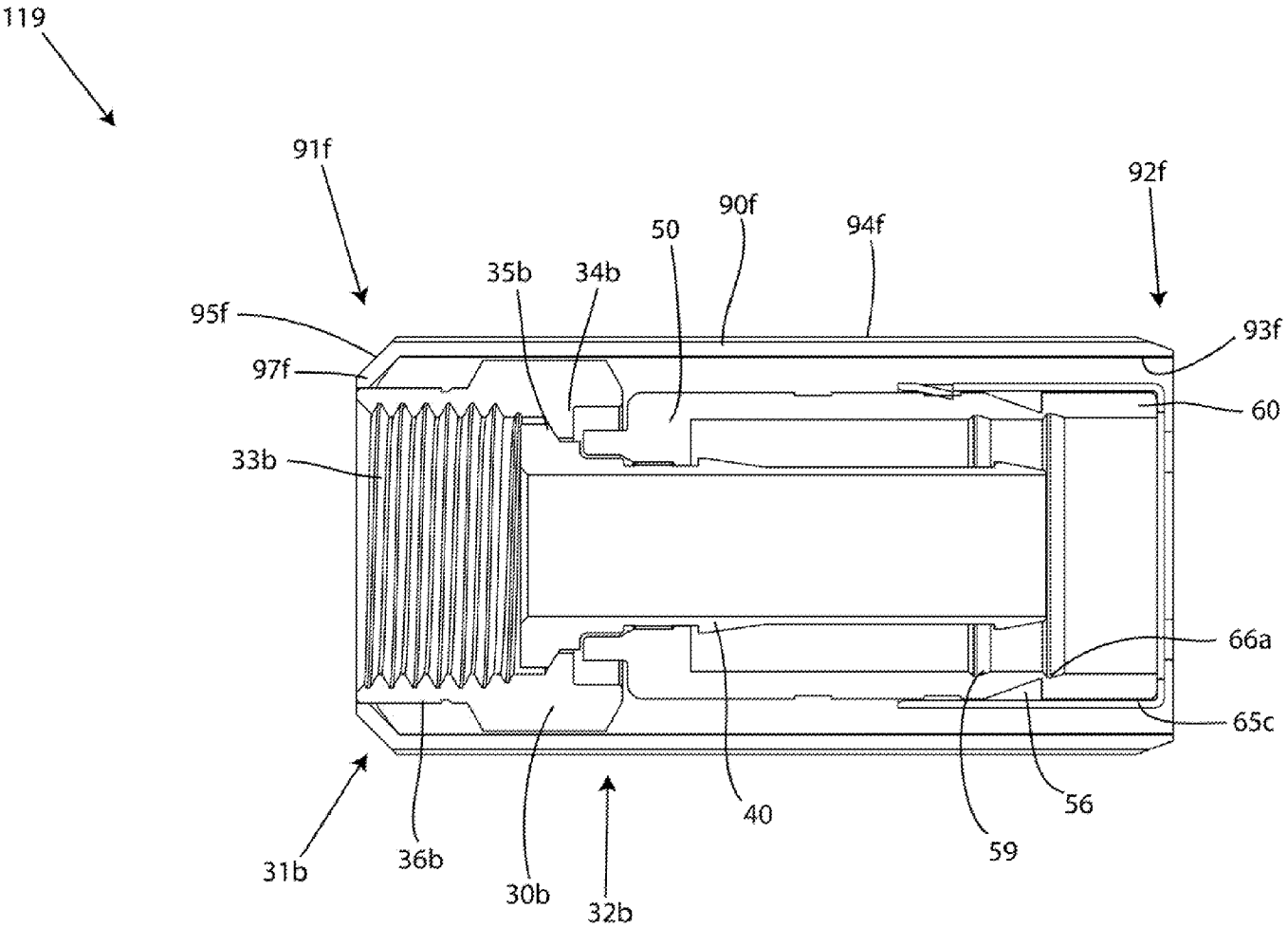
FIG. 20 depicts a cross-section view of a twentieth embodiment of a coaxial cable connector including an embodiment of an outer sleeve, an embodiment of a compression portion, and an embodiment of a radial restriction member.

FIG. 20 depicts an embodiment of connector 119. Embodiments of connector 119 may include a coupling member 30*b*, a post 40, a connector body 50, an outer sleeve 90*f*, a compression portion 60, and a radial restriction member 65*c*.

Figure 21:
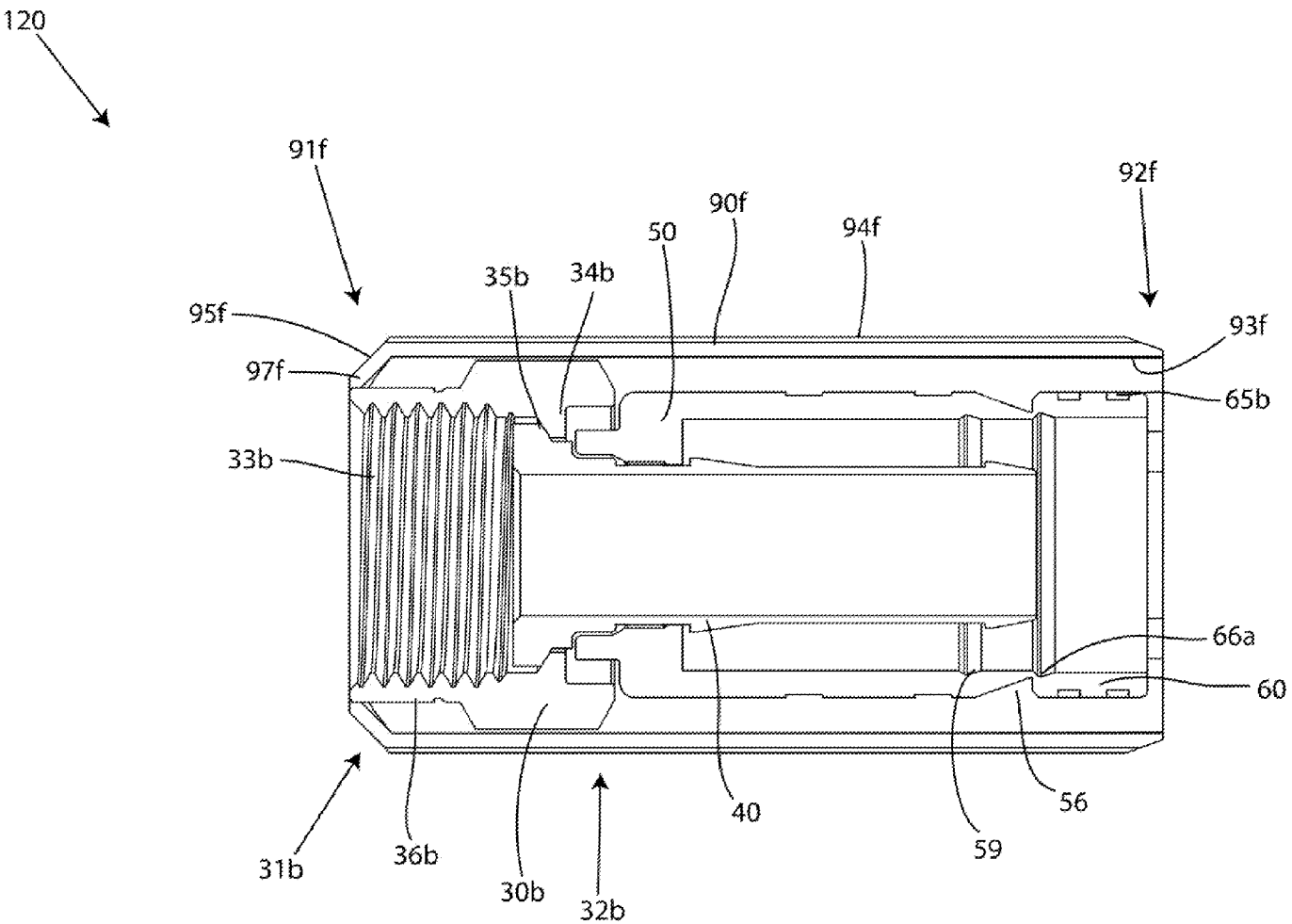
FIG. 21 depicts a cross-section view of a twenty-first embodiment of a coaxial cable connector including an embodiment of an outer sleeve, an embodiment of a compression portion, and an embodiment of a radial restriction member.

FIG. 21 depicts an embodiment of connector 120. Embodiments of connector 120 may include a coupling member 30*b*, a post 40, a connector body 50, an outer sleeve 90*f*, a compression portion 60, and a radial restriction member 65*b*.

Figure 22:
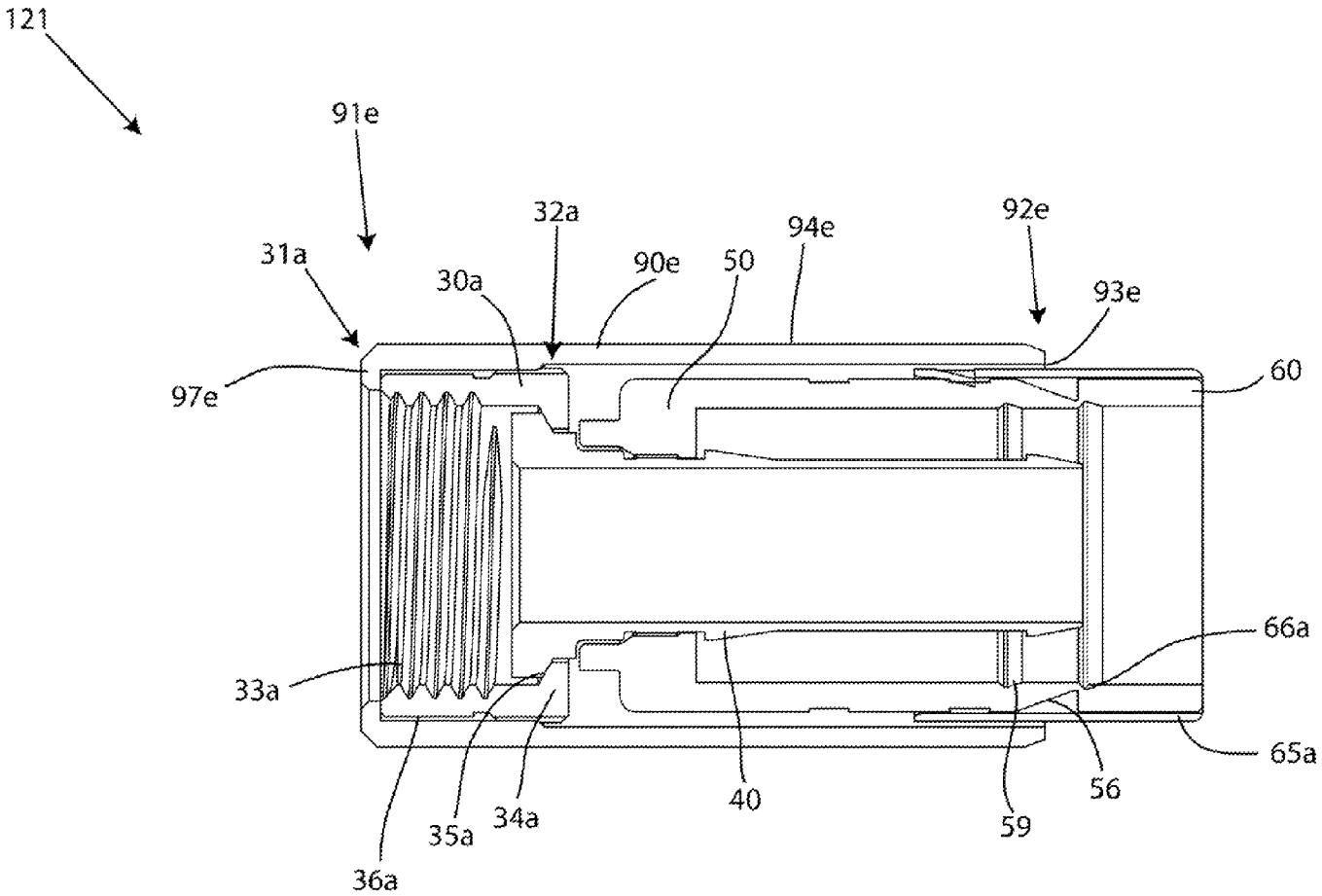
FIG. 22 depicts a cross-section view of a twenty-second embodiment of a coaxial cable connector including an embodiment of an outer sleeve, an embodiment of an outer sleeve, an embodiment of a compression portion, and an embodiment of a radial restriction member.

Referring now to FIG. 22, embodiments of connector 121 may include a coupling member 30*a*, a post 40, a connector body 50, an outer sleeve 90*e*, a compression portion 60, and a radial restriction member 65*a*.

Embodiments of connector 121 may include an outer sleeve 90*e*. Sleeve 90*e* may share the same or substantially the same function as sleeve 90*a* and sleeve 90*d*. Accordingly, the sleeve 90*e* may include a first end 91*e*, a second end 92*e*, an inner surface 93*e*, and an outer surface 94*e*, and may be a generally annular member having a generally axial opening therethrough. Sleeve 90*e* may surround the coupling member 30*a*, the post 40, the connector body 50, or a portion thereof, the compression portion 60, and a radial restriction member 65, or a portion thereof when in an assembled and/or compressed position. Moreover, the sleeve 90*e* may extend towards the first end 31*a* of coupling member 30*a*. However, sleeve 90*e* may include an inwardly extending lip 97*e* proximate or otherwise near the first end 91*e* of the sleeve 90*e*, which can help guide the coupling member 30*a* onto a corresponding interface port. The lip 97*e* may share the same functional aspects of the engagement member 97*a*, 97*d* of sleeve 90*a*, 90*d*, respectively. For instance, the lip 97*e* may radially inwardly extend a distance sufficient to prevent axial movement of the sleeve 90*e* in a direction towards the second end 32*a* of the coupling member 30*a* when operably assembled and/or in a compressed position. An embodiment of an assembled configuration of connector 121 with respect to the sleeve 90*e* may involve sliding the sleeve 90*e* over the coupling member 30*a* in an axial direction starting from the first end 31*a* and continuing toward the second end 32*a* of the coupling member 30*a* until sufficient mechanical interference and/or engagement occurs between the lip 97*e* of the sleeve 90*e* and frontal edge or mating surface of the coupling member 30*a*. The simultaneous rotation/twisting of the sleeve 90*e* and the coupling member 30*a* may be effectuated in the same or similar manner as described between the sleeve 90*a* and the coupling member 30*a*.

Figure 23:
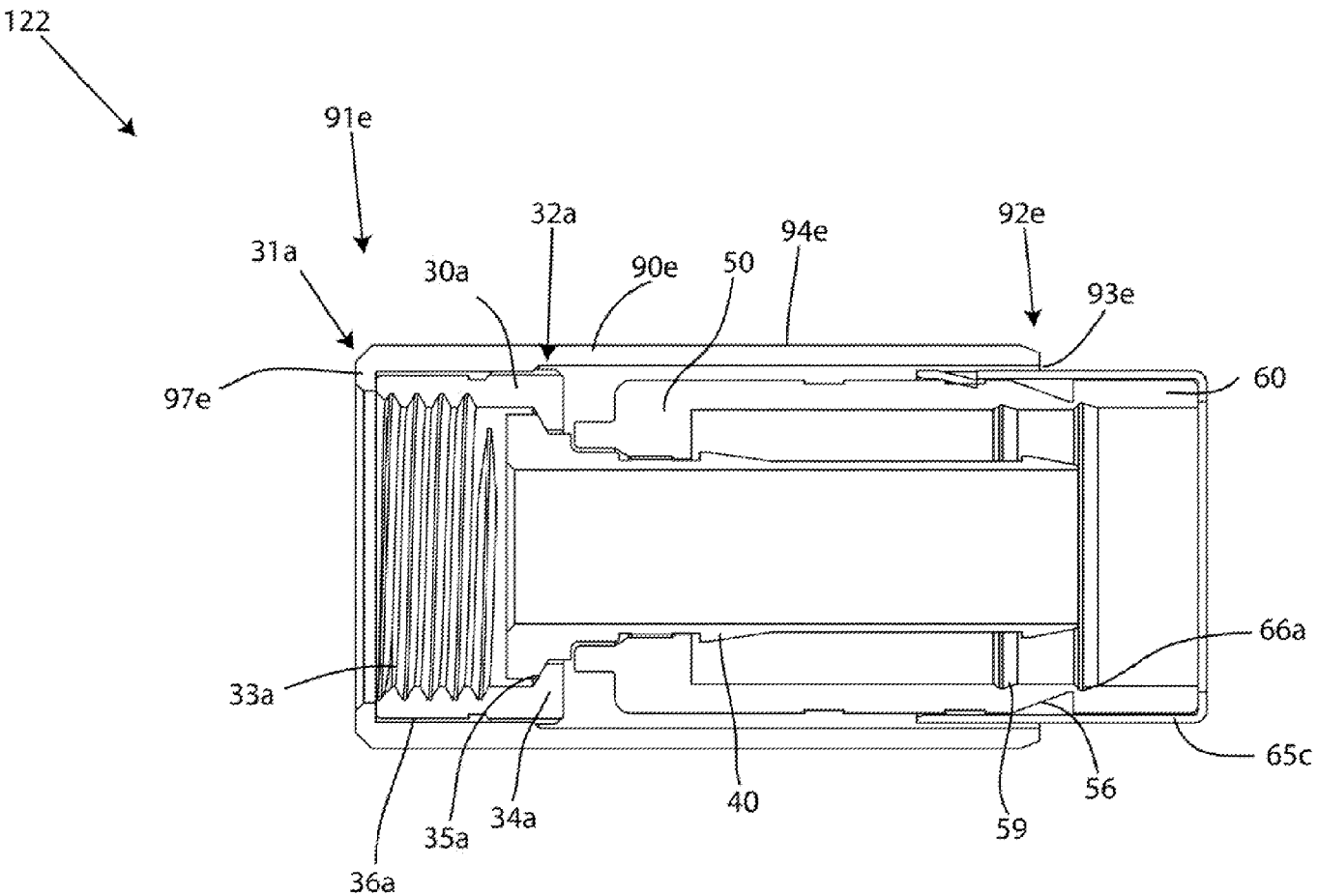
FIG. 23 depicts a cross-section view of a twenty-third embodiment of a coaxial cable connector including an embodiment of an outer sleeve, an embodiment of an outer sleeve, and an embodiment of a compression portion, and an embodiment of a radial restriction member.

FIG. 23 depicts an embodiment of connector 122. Embodiments of connector 122 may include a coupling member 30*b*, a post 40, a connector body 50, an outer sleeve 90*e*, a compression portion 60, and a radial restriction member 65*c*.

Figure 24:
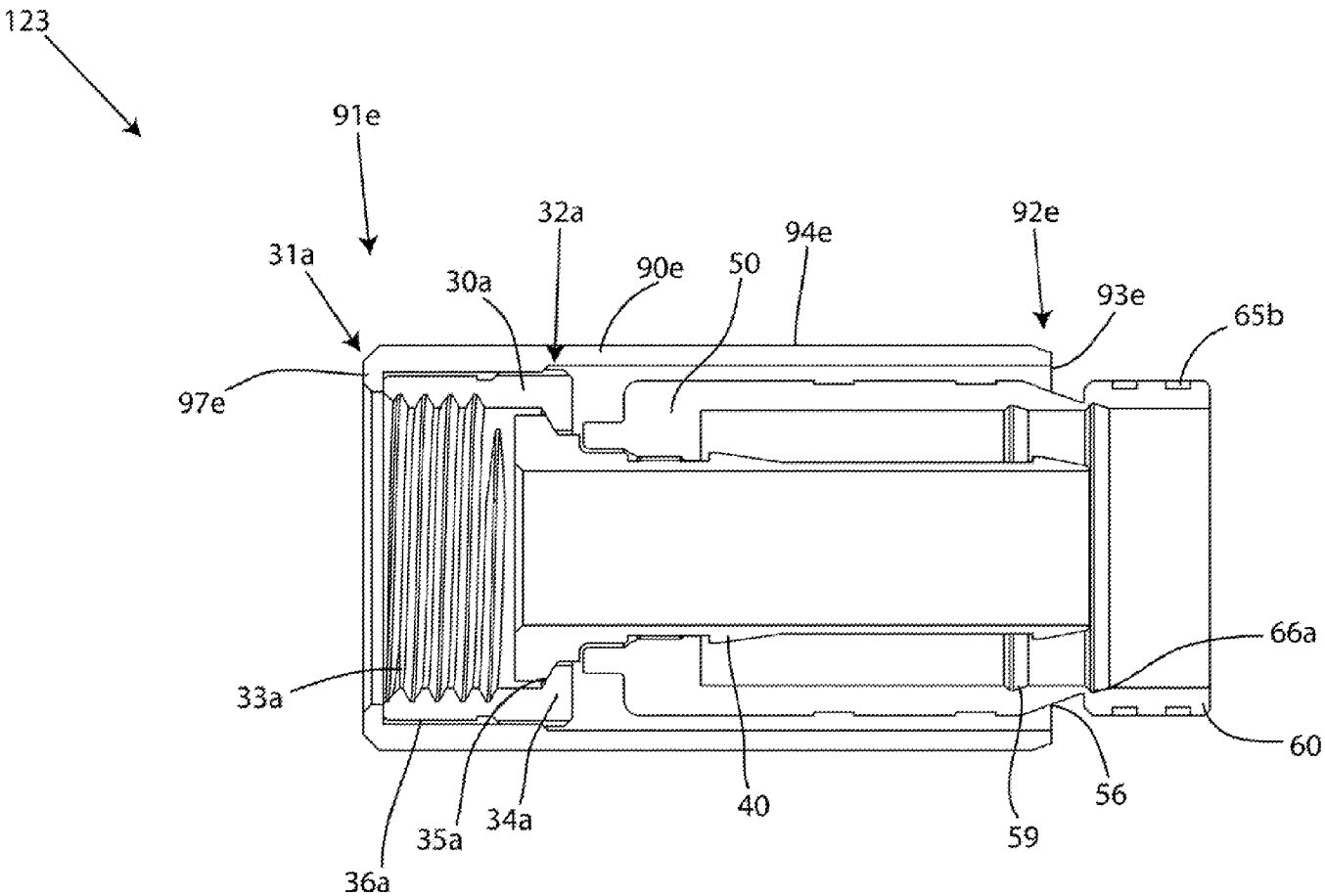
FIG. 24 depicts a cross-section view of a twenty-fourth embodiment of a coaxial cable connector including an embodiment of an outer sleeve, an embodiment of an outer sleeve, an embodiment of a compression portion, and an embodiment of a radial restriction member.

FIG. 24 depicts an embodiment of connector 123. Embodiments of connector 123 may include a coupling member 30*b*, a post 40, a connector body 50, an outer sleeve 90*e*, a compression portion 60, and a radial restriction member 65*b*

Figure 25:
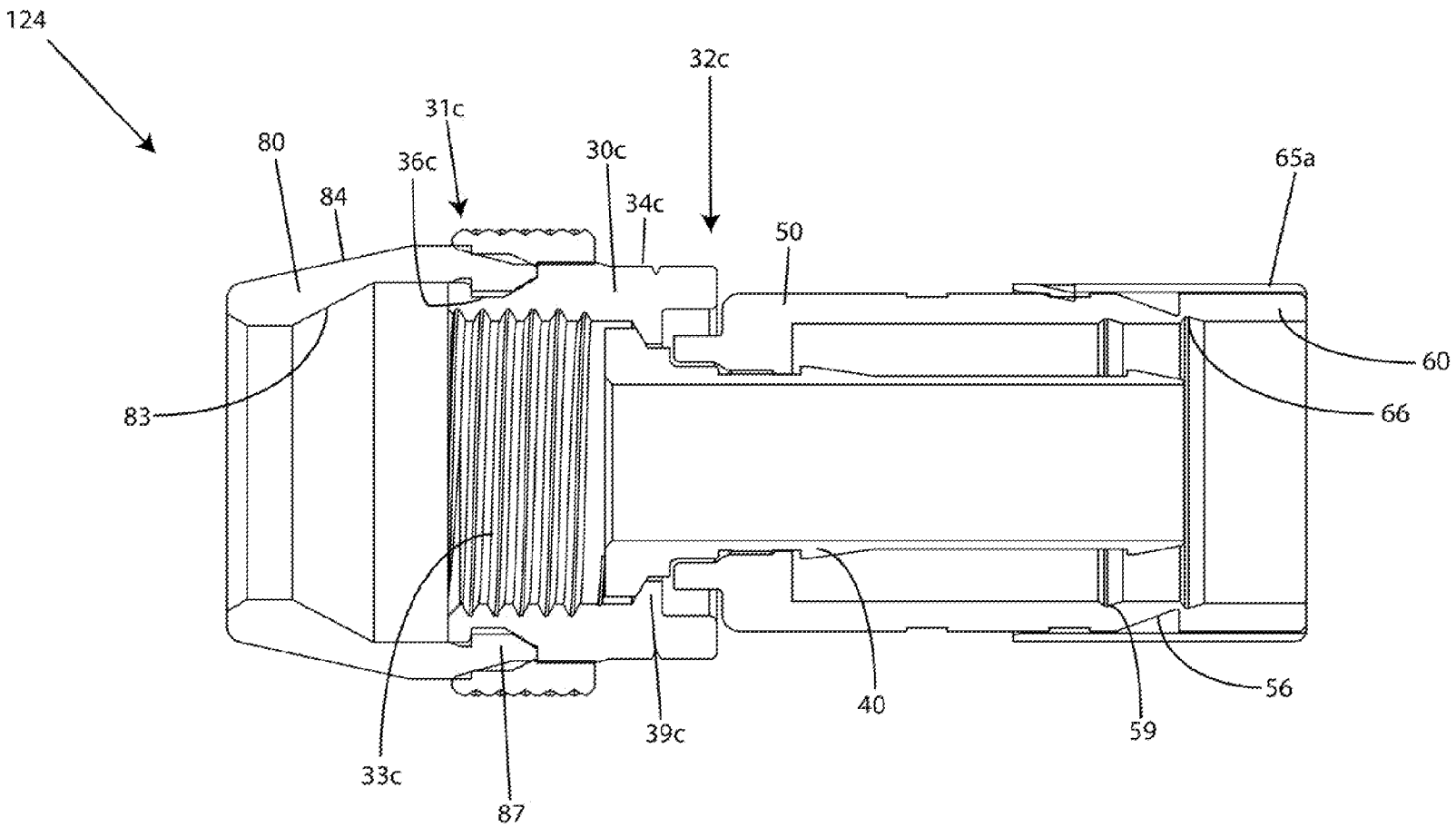
FIG. 25 depicts a cross-section view of a twenty-fifth embodiment of a coaxial cable connector including an embodiment of a sealing member, an embodiment of a compression portion, and an embodiment of a radial restriction member.
Figure 26:
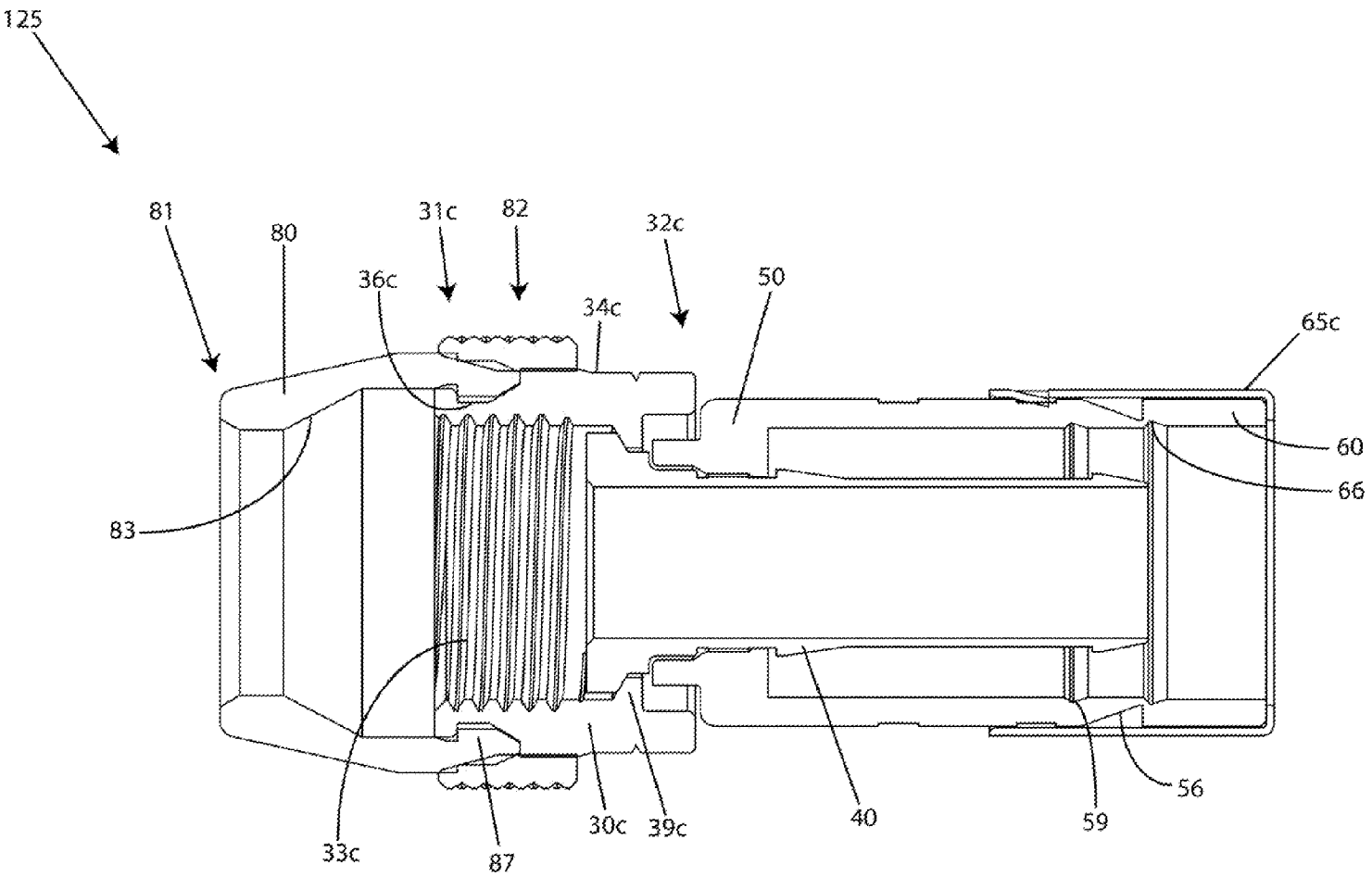
FIG. 26 depicts a cross-section view of a twenty-sixth embodiment of a coaxial cable connector including an embodiment of a sealing member, an embodiment of a compression portion, and an embodiment of a radial restriction member.
Figure 27:
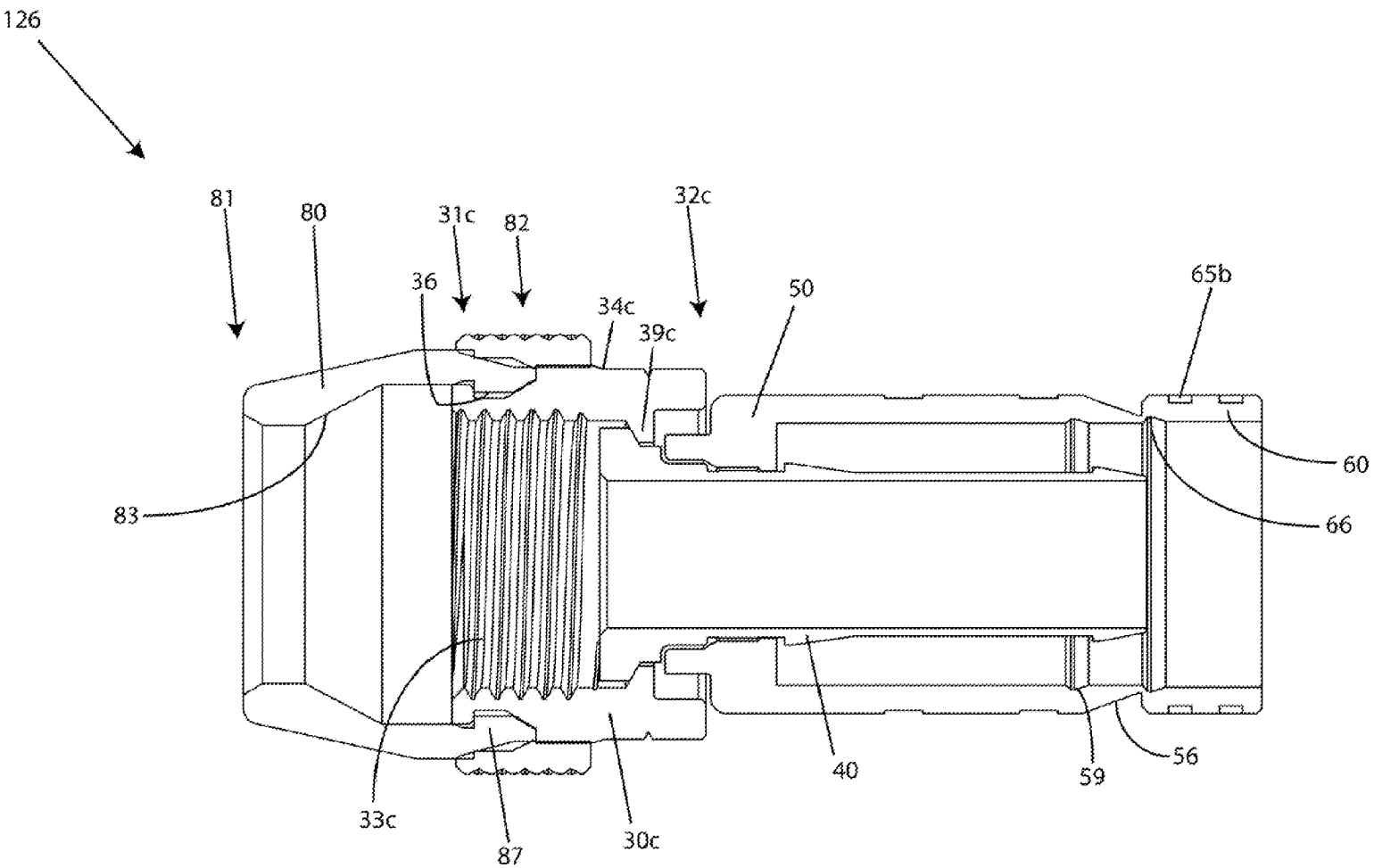
FIG. 27 depicts a cross-section view of a twenty-seventh embodiment of a coaxial cable connector including an embodiment of a sealing member, an embodiment of a compression portion, and an embodiment of a radial restriction member.

Continuing to refer to the drawings, FIGS. 25-27 depict an embodiment of connector 124-128 that may include a coupling member 30*c*, a post 40, a seal member 80, a connector body 50, a connector body seal element 5, a compression portion 60, and a radial restriction member 65. Embodiments of a radial restriction member 65 may be radial restriction member 65*a*, radial restriction member 65*b*, or radial restriction member 65*c*.

Referring to FIG. 25, embodiments of connector 124 may include a coupling member 30*c*, a post 40, a connector body 50, a sealing member 80, a connector body seal element 5, a compression portion 60, and a radial restriction member 65*a*.

FIG. 26 depicts an embodiment of connector 125. Embodiments of connector 125 may include a coupling member 30*c*, a post 40, a connector body 50, a sealing member 80, a compression portion 60, and a radial restriction member 65*c*.

FIG. 27 depicts an embodiment of connector 126. Embodiments of connector 127 may include a coupling member 30*c*, a post 40, a connector body 50, a sealing member 80, a compression portion 60, and a radial restriction member 65*b*.

Figure 29:
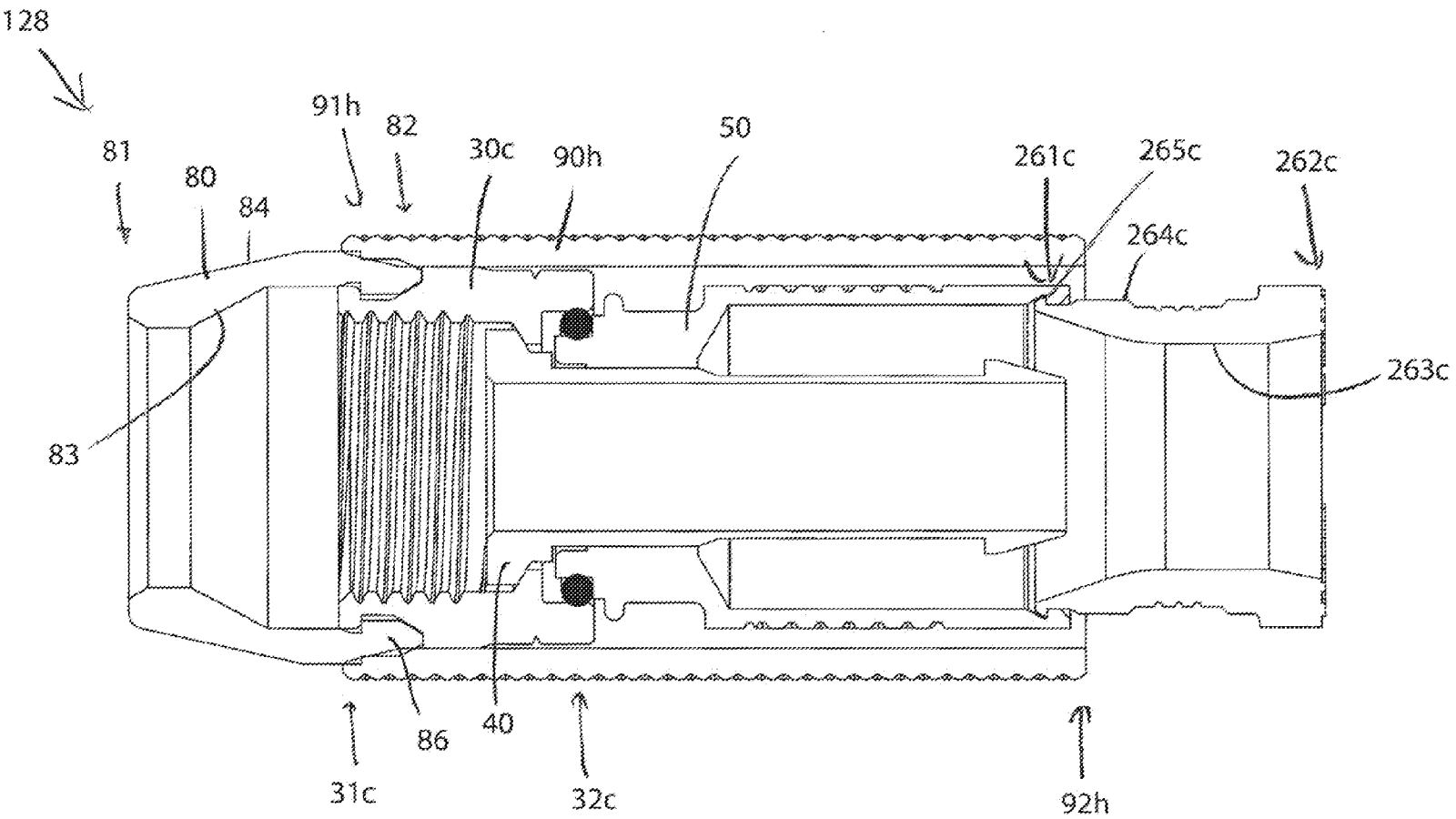
FIG. 29 depicts a cross-section view of a twenty-ninth embodiment of a coaxial cable connector including an embodiment of a sealing member, an embodiment of an outer sleeve, and an embodiment of a compression portion configured to move axially within an embodiment of a connector body.

With reference to FIGS. 28 and 29, embodiments of connector 127-128 may include a coupling member 30*c*, a post 40, a seal member 80, a connector body 50, a sleeve 90*h*, a connector body seal element 5, and a compression portion 260. Embodiments of a compression portion 260 may be compression portion 260*b* or compression portion 260*c*.

FIG. 28 depicts an embodiment of connector 127. Embodiments of connector 127 may include a coupling member 30*c*, a post 40, a connector body 50, a connector body seal member 5, a sleeve 90*h*, and a compression portion 260*b*.

Embodiments of connector 127 may include a compression portion 260*b*. Compression portion 260*b* may be a fastener member that is inserted over the connector body 50 to deformably compress the connector body 50 onto the cable 10. The compression portion 260*b* may have a first end 261 and opposing second end 262. In addition, the compression portion 260 may include an internal annular protrusion 263 located proximate the first end 261 of the compression portion 260*b* and configured to mate and achieve purchase with the annular detent 53 on the outer surface 55 of connector body 50. Moreover, the compression portion 260*b* may comprise a central passageway defined between the first end 261 and second end 262 and extending axially through the compression portion 260*b*. The central passageway may comprise a ramped surface 266 which may be positioned between a first opening or inner bore having a first diameter positioned proximate with the first end 261 of the compression portion 260*b* and a second opening or inner bore having a second diameter positioned proximate with the second end 262 of the compression portion 260*b*. The ramped surface 266 may act to deformably compress the outer surface 55 of a connector body 50 when the compression portion 260*b* is operated to secure a coaxial cable 10. For example, the narrowing geometry will compress squeeze against the cable, when the compression portion is compressed into a tight and secured position on the connector body. Additionally, the compression portion 260*b* may comprise an exterior surface feature 269 positioned proximate with or close to the second end 262 of the compression portion 260*b*. The surface feature 269 may facilitate gripping of the compression portion 260*b* during operation of the connector. Although the surface feature 269 is shown as an annular detent, it may have various shapes and sizes such as a ridge, notch, protrusion, knurling, or other friction or gripping type arrangements. It should be recognized, by those skilled in the requisite art, that the compression portion 260*b* may be formed of rigid materials such as metals, hard plastics, polymers, composites and the like, and/or combinations thereof. Furthermore, the compression portion 260*b* may be manufactured via casting, extruding, cutting, turning, drilling, knurling, injection molding, spraying, blow molding, component overmolding, combinations thereof, or other fabrication methods that may provide efficient production of the component.

FIG. 29 depicts an embodiment of connector 128. Embodiments of connector 128 may include a coupling member 30*c*, a post 40, a connector body 50, a sealing member 80, a connector body seal member 5, a sleeve 90*h*, and a compression portion 260*c*.

Embodiments of connector 128 may include a compression portion 260*c*. Compression portion 260*c* may be an insertable compression sleeve or tubular locking compression member that resides internally with respect to the connector body 50 in the compressed position. The compression portion 260*c* may include a first end 261*c*, a second end 262*c*, an inner surface 263, and an outer surface 264*c*. The compression portion 260*c* may be pushed into the connector body 50 to squeeze against and secure the cable 10. For instance, the compression portion 260*c* may protrude axially into an annular chamber through the rear opening, and may be slidably coupled or otherwise movably affixed to the connector body 50 to compress into the connector body 50 and retain the cable 10. The compression portion 260*c* may be displaceable or movable axially or in the general direction of the axis of the connector between a first open position (accommodating insertion of the tubular inner post 40 into a prepared cable 10 end to contact the grounding shield 14), and a second clamped position compressibly fixing the cable 10 within the chamber of the connector because the compression portion 260*c* is squeezed into retraining contact with the cable 10 within the connector body 50. Furthermore, the compression portion 260*c* may include a lip 265*c* proximate the first end 261*c*, wherein the lip 265*c* of the compression portion 260*c* mates with the internal groove of the connector body 50.

Further embodiments of a coaxial cable connector may include a coupling member 30, a post 40, a connector body 50, a sealing member 80, a connector body seal member 5, a sleeve 90, a compression portion 60/260, and a radial restriction member 65*a*/65*b*/65*c*. Embodiments of sleeve 90 may include sleeve 90*a*/90*b*/90*d*/90*e*/90*f*/90*g*/90*h*, or may simply share the same structural and functional aspects, yet be configured to operably attach to a coupling member having molded plastic threads, or a coupling member that is completely molded. Embodiments of a coupling member 30, which may share the same or substantially the same structural and functional aspects of 30*a*/30*b*/30*c*, may include plastic threads designed to seal against the external threads 23 of port 20 to keep moisture and other physical contaminants out. For example, the threads may be cut slightly different resulting in a differently shaped or dimensioned thread from the threads 23 of the port 20 to achieve a seal with the port 20. Furthermore, the threads could be slightly over-sized causing the metallic threads 23 of the port 20 to slice, pierce, grind, etc., into and against the plastic threads of the plastic coupling member 30 as the plastic coupling member 30 is being threaded onto the port 20. The threads can be molded or machined, and the coupling member 30 can be all plastic (molded or machined) or the coupling member 30 can have a plastic insert that has molded or cut threads. Additionally, the plastic threads may be shaped like pipe-threads causing the non-pipe-thread-shaped threads of the port 20 to seal against the plastic threads of the coupling member 30 when the coupling member 30 is advanced onto the port 20. The threads may also include a small protrusion feature running along the threads that forms a seal with the threads of the port 20 as the coupling member 30 is advanced onto the port 20. Embodiments of a plastic coupling member (or partially plastic coupling member having plastic threads), in addition to creating a physical seal, may inherently create a secure connection to the port 20 because a tight friction-fit may likely be formed with the port 20 as the threads of the coupling member 30 are advanced (with some amount of force that may be necessary to overcome the friction) onto the threads of the port 20.

Those skilled in the art should appreciate that various combinations and embodiments disclosed and described in detail herein may include a body seal element, such as connector body seal element 5, to provide an environmental seal for the coaxial cable connector.

With reference to FIGS. 1-29, a method of fastening a coaxial cable, such as coaxial cable 10, to a communication port, such as port 20. The method may comprise a step of providing a coaxial cable connector 100-128 including: a connector body 50, a post 40 operably attached to the connector body 50, the post 40 having a flange 44, a coupling member 30*a*/30*b*/30*c* axially rotatable with respect to the post 40 and the connector body 50, the coupling member 30*a*/30*b*/30*c* including a lip 34*a*/34*b*/36*c*, an outer sleeve 90*a*/90*b*/90*c*/90*d*/90*e*/90*f*/90*g*/90*h* engageable with the coupling member 30*a*/30*b*/30*c*, and a compression portion 60 structurally integral with the connector body 50. Another method step may include axially compressing the compression portion 60 to form an environmental seal around the coaxial cable 10, wherein when axially compressed, the compression portion 60 breaks away from the connector body 50 and securely connects to the coaxial cable 10. Still another method step may include fastening the coupling member 30*a*/30*b*/30*c* to an interface port by operating the outer sleeve 90*a*/90*b*/90*c*/90*d*/90*e*/90*f*/90*g*/90*h*.

While this invention has been described in conjunction with the specific embodiments outlined above, it is evident that many alternatives, modifications and variations will be apparent to those skilled in the art. Accordingly, the preferred embodiments of the invention as set forth above are intended to be illustrative, not limiting. Various changes may be made without departing from the spirit and scope of the invention as defined in the following claims. The claims provide the scope of the coverage of the invention and should not be limited to the specific examples provided herein.

What is claimed is:

1. A coaxial cable connector comprising;

a connector body;

a post, engageable with the connector body;

a coupling member, axially rotatable with respect to the connector body, the coupling member having a first end and opposing second end;

an outer sleeve engageable with the coupling member, the sleeve configured to rotate the coupling member;

a compression portion structurally integral with the connector body, wherein the compression portion is configured to break apart from the body when axially compressed; and a radial restriction member, wherein at least some part of the radial restriction member is disposed radially extent of the compression portion to restrict radial expansion of the compression portion.

2. The coaxial cable connector of claim 1, wherein the radial restriction member comprises at least one strap positioned around at least a section of the compression portion.

3. The coaxial cable connector of claim 1, wherein the radial restriction member includes an inwardly extending lip.

4. The coaxial cable connector of claim 1, wherein the outer sleeve extends to the first end of the coupling member.

5. The coaxial cable connector of claim 1, wherein the outer sleeve extends beyond the first end of the coupling member, to guide the coupling member onto a corresponding port.

6. The coaxial cable connector of claim 1, wherein the outer sleeve includes an engagement member configured to mate with a retaining structure of the coupling member.

7. A coaxial cable connector comprising;

a connector body;

a post engageable with connector body;

a coupling member, axially rotatable with respect to the connector body, the coupling member having a first end and opposing second end portion;

a sealing element attached to the first end of the coupling member, wherein the sealing element prevents ingress of environmental elements proximate the first end of the coupling member that is configured to mate with a port; and an outer sleeve engageable with the coupling member, the sleeve configured to rotate the coupling member.

8. The coaxial cable connector of claim 7, further comprising a compression portion.

9. The coaxial cable connector of claim 8, wherein the compression portion is a separate fastener member radially disposed over the connector body to radially compress the connector body onto a coaxial cable.

10. The coaxial cable connector of claim 8, wherein the compression portion is a separate insertable compression sleeve configured to be inserted within an opening of the connector body proximate a rearward end of the connector body.

11. The coaxial cable connector of claim 7, wherein the outer sleeve extends to the first end of the coupling member.

12. The coaxial cable connector of claim 7, wherein the outer sleeve includes an engagement member configured to mate with a retaining structure of the coupling member.

13. A coaxial cable connector comprising;

a connector body;

a post engageable with connector body;

a coupling member, axially rotatable with respect to the connector body, the coupling member having a first end and opposing second end;

a sealing element attached to the first end of the coupling member, wherein the sealing element prevents ingress of environmental elements proximate the first end of the coupling member that is configured to mate with a port; and a compression portion structurally integral with the connector body, wherein the compression portion is configured to break apart from the body when axially compressed.

14. The coaxial cable connector of claim 13, further comprising a radial restriction member, wherein at least some part of the radial restriction member is disposed radially extent of the compression portion to restrict radial expansion of the compression portion.

15. The coaxial cable connector of claim 14, wherein the radial restriction member comprises at least one strap positioned around at least a section of the compression portion.

16. The coaxial cable connector of claim 14, wherein the radial restriction member includes an inwardly extending lip.

17. A method of fastening a coaxial cable to a communication port, the method comprising:

providing a coaxial cable connector including:

a connector body;

a post operably attached to the connector body;

a coupling member axially rotatable with respect to the connector body;

an outer sleeve engageable with the coupling member;

a compression portion structurally integral with the connector body; and a radial restriction member, wherein at least some part of the radial restriction member is disposed radially extent of the compression portion to restrict radial expansion of the compression portion;

axially compressing the compression portion to form an environmental seal around the coaxial cable, wherein when axially compressed, the compression portion breaks away from the body and securely connects to the coaxial cable; and fastening the coupling member to an interface port by operating the outer sleeve.

18. A coaxial cable connector comprising;

a connector body;

a post engageable with connector body;

a coupling member, axially rotatable with respect to the connector body, the coupling member having a first end and opposing second end;

a sealing element attached to the first end of the coupling member, wherein the sealing element prevents ingress of environmental elements proximate the first end of the coupling member that is configured to mate with a port;

a compression portion structurally integral with the connector body, wherein the compression portion is configured to break apart from the body when axially compressed; and an outer sleeve engageable with the coupling member, the sleeve configured to rotate the coupling member.

* * * * *